US007365725B2

(12) United States Patent
Nakayoshi et al.

(10) Patent No.: US 7,365,725 B2
(45) Date of Patent: Apr. 29, 2008

(54) LIQUID CRYSTAL DISPLAY DEVICE

(75) Inventors: Yoshiaki Nakayoshi, Ooamishirasato (JP); Yoshihiro Imajo, Mobara (JP); Kazuhiko Yanagawa, Mobara (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 706 days.

(21) Appl. No.: 10/796,192

(22) Filed: Mar. 10, 2004

(65) Prior Publication Data

US 2004/0178977 A1 Sep. 16, 2004

(30) Foreign Application Priority Data

Mar. 10, 2003 (JP) ..... 2003-063392

(51) Int. Cl.
*G09G 3/36* (2006.01)

(52) U.S. Cl. ..... 345/94; 345/87; 345/92; 345/95; 345/96

(58) Field of Classification Search ..... 345/76, 345/80, 87, 204, 211, 93, 98, 208, 92, 75.2, 345/55, 205, 94, 95, 96, 209, 82, 89, 84, 345/90; 349/43, 141
See application file for complete search history.

(56) References Cited

U.S. PATENT DOCUMENTS 4,621,260 A * 11/1986 Suzuki et al. ..... 345/92
5,587,722 A * 12/1996 Suzuki et al. ..... 345/94
6,040,814 A * 3/2000 Murakami et al. ..... 345/94
6,266,116 B1 7/2001 Ohta et al. ..... 349/141
6,317,120 B1 * 11/2001 Eu ..... 345/211
6,356,331 B1 * 3/2002 Ono et al. ..... 349/141
6,624,801 B2 * 9/2003 Moriyama ..... 345/100
6,781,565 B2 * 8/2004 Ozawa ..... 345/84
6,903,711 B2 * 6/2005 Akiba ..... 345/67
7,042,431 B1 * 5/2006 Washio et al. ..... 345/98
7,148,870 B2 * 12/2006 Tada ..... 345/90
2001/0026331 A1 * 10/2001 Oota et al. ..... 349/43
2002/0180675 A1 * 12/2002 Tobita et al. ..... 345/87
2003/0174118 A1 * 9/2003 Sato et al. ..... 345/100

FOREIGN PATENT DOCUMENTS

JP 08-166599 6/1999
JP 11-271788 10/1999
JP 2001-282206 10/2001

* cited by examiner

*Primary Examiner*—Prabodh Dharia
(74) *Attorney, Agent, or Firm*—Antonelli, Terry, Stout & Kraus, LLP.

(57) ABSTRACT

In a liquid crystal display device, drain signal lines which supply the video signal are arranged to cross gate signal lines which supply the scanning signal and counter voltage signal lines which supply the reference signal. The reference signal is supplied to the pixels for every selected pixel row. Further, the counter voltage signal lines in other pixel rows except for the selected pixel rows are respectively configured to assume a floating state.

34 Claims, 48 Drawing Sheets

FIG. 3A
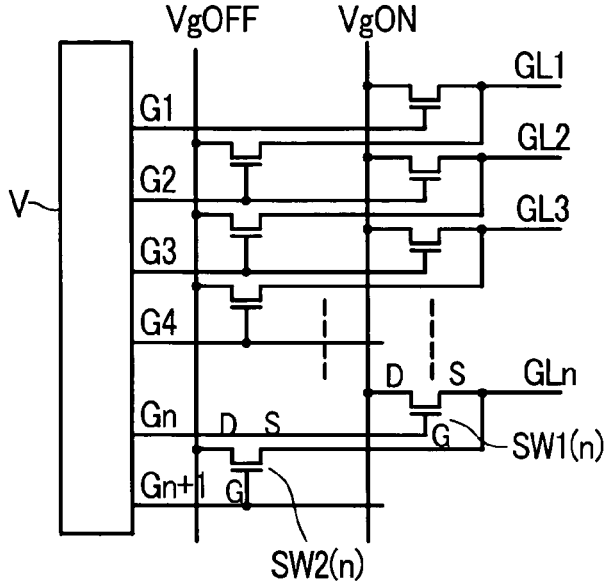
FIG. 3B
| | | | | |
|---|---|---|---|---|
| Gn | ON | OFF | OFF | OFF |
| Gn+1 | OFF | ON | OFF | OFF |
| Gn+2 | OFF | OFF | ON | OFF |
| GLn | ON | OFF | FT | FT |
| GLn+1 | FT | ON | OFF | FT |
| GLn+2 | FT | FT | ON | OFF |
| SW1(n) | ON | OFF | OFF | OFF |
| SW1(n+1) | OFF | ON | OFF | OFF |
| SW1(n+2) | OFF | OFF | ON | OFF |
| SW2(n) | OFF | ON | OFF | OFF |
| SW2(n+1) | OFF | OFF | ON | OFF |
| SW2(n+2) | OFF | OFF | OFF | ON |
FIG. 3C
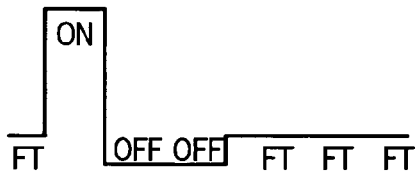

| | | | | |
|---|---|---|---|---|
| SW1(n) | ON | OFF | OFF | OFF |
| SW2(n) | OFF | ON | OFF | OFF |
| SW3(n) | ON | OFF | OFF | OFF |
| SW4(n) | OFF | ON | OFF | OFF |
| SW5(n) | ON | OFF | OFF | OFF |
| SW1(n+1) | OFF | ON | OFF | OFF |
| SW2(n+1) | OFF | OFF | ON | OFF |
| SW3(n+1) | OFF | ON | OFF | OFF |
| SW4(n+1) | OFF | OFF | ON | OFF |
| SW5(n+1) | OFF | ON | OFF | OFF |
| SW1(n+2) | OFF | OFF | ON | OFF |
| SW2(n+2) | OFF | OFF | OFF | ON |
| SW3(n+2) | OFF | OFF | ON | OFF |
| SW4(n+2) | OFF | OFF | OFF | ON |
| SW5(n+2) | OFF | OFF | ON | OFF |

LIQUID CRYSTAL DISPLAY DEVICE

BACKGROUND OF THE INVENTION

The present invention relates to a liquid crystal display device; and, more particularly, the invention relates to a liquid crystal display device in which gate signal lines, drain signal lines and counter voltage signal lines are formed on a liquid-crystal-side surface of one of a pair of substrates which are arranged to face each other with liquid crystal material disposed therebetween.

For example, in a so-called lateral-electric field type (IPS type) liquid crystal display device, pixels are formed on a liquid crystal side of one substrate, and each pixel includes a pixel electrode and a counter electrode, whereby an electric field is generated between the counter electrode and the pixel electrode.

Further, video signals are supplied to the pixel electrode from a drain signal line by way of a switching element which is driven in response to a scanning signal received from a gate signal line, while a reference signal, which becomes the reference with respect to the above-mentioned video signals, is supplied to the counter electrodes through counter voltage signal lines.

Here, as shown in FIG. 53, on a liquid-crystal-side of one substrate, for example, the above-mentioned gate signal lines GL1, GL2, . . . , GLn are usually configured such that they extend in the x direction and are arranged in parallel in the y direction, while the above-mentioned drain signal lines DL1, DL2, . . . , DLn are usually configured such that they extend in the y direction and are arranged in parallel in the x direction. Further, counter voltage signal lines CL1, CL2, . . . , CLn are usually arranged between respective gate signal lines GL1, GL2, . . . , GLn such that the counter voltage signal lines CL1, CL2, . . . , CLn are arranged substantially parallel to the gate signal lines GL1, GL2, . . . , GLn.

Here, the respective gate signal lines GL1, GL2, . . . , GLn are, for example, sequentially selected in response to scanning signals supplied from a scanning signal driver circuit V which is connected with one end of each of the respective gate signal lines GL1, GL2, . . . , GLn. In conformity with this selection timing, to the respective drain signal lines DL1, DL2, . . . , DLn, for example, the video signals are supplied from a video signal driver circuit He which is connected with one end of each of the drain signal lines DL1, DL2, . . . , DLn. The respective counter voltage signal lines CL1, CL2, . . . , CLn have, for example, one end thereof connected in common, and, hence, a reference signal is supplied to the respective counter voltage signal lines CL1, CL2, . . . , CLn. Such a technique is disclosed in Japanese Unexamined Patent Publication Hei11(1999)-271788.

SUMMARY OF THE INVENTION

However, with respect to a liquid crystal display device having such a constitution, a large number of gate signal lines GL and a large number of counter voltage signal lines CL are arranged to cross the respective drain signal lines DL. For example, when the resolution of the liquid crystal display device is SXGA (1280×1024), the gate signal lines GL and the counter voltage signal lines CL respectively have at least 1024 crossing points with respect to the drain signal lines DL, and the number of these crossing points is increased with an enhancement of the resolution.

Here, a drain-gate parasitic capacitance Cgd, which is generated at the crossing point of the drain signal line DL and the gate signal line GL, and a drain-common parasitic capacitance Ccd, which is generated at the crossing point of the drain signal line DL and the counter voltage signal line CL, are respectively connected in parallel; and, hence, for example, with the resolution SXGA, the liquid crystal display device has a parasitic capacitance of at least 1024×(Cgd+Ccd) for one drain signal line DL. This implies that writing of the signal to the drain signal line DL brings about a simultaneous charging of the parasitic capacitance.

Further, although the signal which is written in the pixel by the drain signal line DL via the switching element is supplied for every pixel, the parasitic capacitance is generated over all pixels. That is, this implies that to supply a charge to one pixel, it is necessary to supply the charge to respective parasitic capacitances of the 1024 pixels. That is, it is necessary to supply an undesired charge for display.

Accordingly, a large quantity of charge is consumed by the above-mentioned respective parasitic capacitances, and, hence, the electric current which is to be supplied to the drain signal lines DL largely exceeds a value which is an originally required value, thus leading to a large increase in the power consumption.

A technique to cope with a similar drawback is suggested in the above-mentioned Japanese Unexamined Patent Publication Hei11(1999)-271788. That is, in paragraph [0015] of this publication, for example, it is indicated that, by performing the supply of signals from counter voltage signal lines to counter electrodes through switching elements, it is possible to set the counter electrodes in a floating state, and, hence, the parasitic capacitances can be decreased. However, the technique disclosed in this publication has not yet achieved the desired reduction of the parasitic capacitances at the above-mentioned respective crossing portions.

The present invention has been made in view of such circumstances, and it is an object of the present invention to provide a liquid crystal display device in which it is possible to largely reduce the generation of an undesired power consumption when video signals are supplied to the drain signal lines therein.

Further, it is another object of the present invention to provide a liquid crystal display device in which it is possible to sufficiently cope with static electricity in achieving the above-mentioned object.

A brief summary of representative Examples of the invention disclosed in this specification is as follows.

EXAMPLE (1)

In the liquid crystal display device according to the present invention, for example, respective pixels are arranged in a matrix array by arranging a plurality of pixel rows, each of which includes a plurality of pixels arranged in parallel in one direction in rows arranged in another direction which crosses the one direction, each pixel row is selected in response to a scanning signal, and a video signal and a reference signal which becomes the reference with respect to the video signal are supplied to the respective pixels in each selected pixel row. In this device, drain signal lines which supply the video signal are arranged to cross gate signal lines which supply the scanning signal and counter voltage signal lines which supply the reference signal; and, the reference signal is supplied to the pixels for every selected pixel row, and, at the same time, the counter voltage signal lines in other pixel rows, except for the selected pixel rows, are respectively configured to assume a floating state.

EXAMPLE (2)

In the liquid crystal display device according to the present invention, for example, respective pixels are arranged in a matrix array by arranging a plurality of pixel rows, each of which includes a plurality of pixels arranged in parallel in one direction in rows arranged in another direction which crosses the one direction, each pixel row is selected in response to a scanning signal, and a video signal and a reference signal which becomes the reference with respect to the video signal are supplied to the respective pixels in each selected pixel row. In this device, drain signal lines which supply the video signal are arranged to cross gate signal lines which supply the scanning signal and counter voltage signal lines which supply the reference signal; and, the reference signal is supplied to the pixels for every selected pixel row, and, at the same time, most of the gate signal lines and the counter voltage signal lines in other pixel rows, except for the selected pixel rows, are respectively configured to assume a floating state.

EXAMPLE (3)

In the liquid crystal display device according to the present invention, for example, regions are surrounded by gate signal lines which extend in a first direction and are arranged in parallel in the second direction and drain signal lines which extend in the second direction and are arranged in parallel in the first direction and these regions serve as pixel regions. In this device, each pixel region includes a thin film transistor which is driven in response to a scanning signal received from the gate signal line, a pixel electrode to which a video signal is supplied from the drain signal line by way of the thin film transistor and a counter electrode which generates an electric field between the counter electrode and the pixel electrode.

The liquid crystal display device includes counter voltage signal lines which run between respective gate signal lines and are connected to the counter electrodes; means which makes most of other gate signal lines except for the gate signal line for supplying scanning signal assume a floating state; and means which supplies a counter voltage signal to the counter voltage signal lines which run in the pixel regions which the thin film transistors drive by the gate signal lines to which the scanning signal is supplied to place other counter voltage signal lines in a floating state.

EXAMPLE (4)

The liquid crystal display device according to the present invention is, for example, based on the constitution of any one of the Examples (1) to (3), characterized in that, to each counter voltage signal line, a counter voltage signal is supplied through a switch which is turned on in response to a signal scanned by a drive circuit thereof; and, when the signal is scanned and supplied to the next counter voltage signal line, the counter voltage signal line to which the counter voltage signal is supplied before the supply of the counter voltage signal to the next counter voltage signal line is caused to assume a floating state.

EXAMPLE (5)

The liquid crystal display device according to the present invention is, for example, based on the constitution of the Example (4), characterized in that, with respect to respective counter voltage signal lines, a plurality of selected counter voltage signal lines are formed into groups.

EXAMPLE (6)

The liquid crystal display device according to the present invention is, for example, based on the constitution of the Example (4), characterized in that the respective groups of counter voltage signal lines have end portions thereof, which are opposite to the counter-voltage-signal supply side, connected to each other.

EXAMPLE (7)

The liquid crystal display device according to the present invention is, for example, based on the constitution of the Example (4), characterized in that the respective counter voltage signal lines are formed such that the respective counter voltage signal lines are connectable with correction wiring to which the counter voltage signal can be always supplied at respective end portions thereof opposite to the counter-voltage-signal supply side.

EXAMPLE (8)

The liquid crystal display device according to the present invention is, for example, based on the constitution of any one of the Examples (2) or (3), characterized in that the scanning signal is supplied to the respective gate signal lines through switches which are turned on in response to a signal scanned by the drive circuit, such that when the signal is scanned and supplied to the next gate signal line, the switches are turned off in response to an OFF signal, and when the scanning signal is supplied to the further next gate signal line, the gate signal line to which the scanning signal is supplied at the two preceding stages is made to assume a floating state.

EXAMPLE (9)

The liquid crystal display device according to the present invention is, for example, based on the constitution of the Examples (2) or (3), characterized in that the polarities of the video signals which are respectively supplied to the respective drain signal lines have the same phase with respect to neighboring drain signal lines.

EXAMPLE (10)

The liquid crystal display device according to the present invention is, for example, based on the constitution of the Example (9), characterized in that the polarity of the counter voltage signal which is supplied to the respective counter voltage signal lines by scanning is inverted for every supply of the counter voltage signal.

EXAMPLE (11)

In the liquid crystal display device according to the present invention, for example, pixels are surrounded by gate signal lines which extend in a first direction and are arranged in parallel in a second direction which crosses the first direction and drain signal lines which extend in the second direction and are arranged in parallel in the first direction. Each pixel includes a switching element which is turned on in response to a scanning signal from a gate signal line, a pixel electrode to which a video signal is supplied from the drain signal line through the switching element, and a counter electrode which is provided for generating an electric field between the counter electrode and the pixel electrode and to which a counter voltage signal scanned from a counter voltage signal line arranged substantially parallel to the gate signal line is supplied. The counter voltage signal line is formed to cover the gate signal line by way of an insulation film; and, at the same time, the counter electrode is connected to a counter voltage signal line which covers the gate signal line and another gate signal line which is formed to sandwich the pixel with the gate signal line. Most of other gate signal lines, except for the gate signal line to which the scanning signal is supplied, are caused to assume a floating state, and other counter voltage signal lines, other than counter voltage signal lines to which counter video signal is supplied, are caused to assume a floating state.

EXAMPLE (12)

The liquid crystal display device according to the present invention is, for example, based on the constitution of the Example (11), characterized in that the counter voltage signal lines and the counter electrodes, which are connected to the counter voltage signal lines, are formed of a light transmitting conductive layer.

EXAMPLE (13)

The liquid crystal display device according to the present invention is, for example, based on the constitution of the Example (12), characterized in that the counter voltage signal lines are electrically connected with metal conductive layers, which are arranged on the same layer as and close to the gate signal lines which are covered with the counter voltage signal lines; via a through hole.

EXAMPLE (14)

In the liquid crystal display device according to the present invention, for example, respective pixels are arranged in a matrix array by arranging a plurality of pixel rows, each of which includes a plurality of pixels arranged in parallel in one direction in rows arranged in another direction which crosses the one direction, each pixel row is selected in response to a scanning signal, and a video signal and a reference signal which becomes the reference with respect to the video signal are supplied to the respective pixels in each selected pixel row. In this device, drain signal lines which supply the video signal are arranged to cross gate signal lines which supply the scanning signal and counter voltage signal lines which supply the reference signal; and, the reference signal is supplied to the pixels for every selected pixel row, and, at the same time, most of the gate signal lines and the counter voltage signal lines in other pixel rows, except for the selected pixel rows, are respectively configured to assume a floating state. The scanning signal and the reference signal are respectively supplied from a single circuit and signals containing ON/OFF levels of the scanning signal and the reference signal are transmitted by shifting the transmitting times relative to each other.

EXAMPLE (15)

The liquid crystal display device according to the present invention is, for example, based on the constitution of the Example (14), characterized in that the circuit includes terminals to which the signal containing ON/OFF levels of the scanning signal is always supplied and terminals to which the reference signal is always supplied, and the scanning signal and the reference signal are respectively transmitted to the gate signal lines and the counter voltage signal lines from the respective terminals selected through a switch circuit.

EXAMPLE (16)

The liquid crystal display device according to the present invention is, for example, based on the constitution of the Example (1), characterized in that the reference signal supplied to the counter voltage signal lines is a signal obtained by boosting an AC voltage waveform.

EXAMPLE (17)

In the liquid crystal display device according to the present invention, for example, respective pixels are arranged in a matrix array by arranging a plurality of pixel rows, each of which includes a plurality of pixels arranged in parallel in one direction in rows arranged in another direction which crosses the one direction, each pixel row is selected in response to a scanning signal, and a video signal and a reference signal which becomes the reference with respect to the video signal are supplied to the respective pixels in each selected pixel row. In this device, drain signal lines which supply the video signal are arranged to cross gate signal lines which supply the scanning signal and counter voltage signal lines which supply the reference signal; and, the reference signal is supplied to the pixels for every selected pixel row, and, at the same time, a voltage value of the signal is set corresponding to a voltage value of the video signal supplied to the pixel row.

EXAMPLE (18)

In the liquid crystal display device according to the present invention, for example, respective pixels are arranged in a matrix array by arranging a plurality of pixel rows, each of which includes a plurality of pixels arranged in parallel in one direction in rows arranged in another direction which crosses the one direction, each pixel row is selected in response to a scanning signal, and a video signal and a reference signal which becomes the reference with respect to the video signal are supplied to the respective pixels in each selected pixel row. In this device, drain signal lines which supply the video signals are arranged to cross gate signal lines which supply the scanning signal and counter voltage signal lines which supply the reference signal; and, the reference signal is supplied to the pixels for every selected pixel row, and, at the same time, the counter voltage signal lines of other pixel rows except for the selected pixel row are made to assume a floating state. A drive circuit which transmits the reference signal is arranged in parallel to a drive circuit which transmits the video signal.

EXAMPLE (19)

The liquid crystal display device according to the present invention is, for example, based on the constitution of the Example (18), characterized in that the drive circuit which transmits the reference signal and the drive circuit which transmits the video signal are respectively constituted of a plurality of semiconductor devices, the semiconductor devices which transmit the reference signal and the semiconductor device which transmits the video signal are alternately arranged, and, at the same time, these respective semiconductor devices are connected to each other through data transmission lines.

EXAMPLE (20)

In the liquid crystal display device according to the present invention, for example, respective pixels are arranged in a matrix array by arranging a plurality of pixel rows, each of which includes a plurality of pixels arranged in parallel in one direction in rows arranged in another direction which crosses the one direction, each pixel row is selected in response to a scanning signal, and a video signal is supplied to the respective pixels in each selected pixel row. In this device, drain signal lines which supply the video signal are arranged to cross gate signal lines which supply the scanning signal; and, the scanning signal is supplied to the respective gate signal lines through switches which are turned on in response to a signal scanned by the drive circuit, such that when the signal is scanned and supplied to the next gate signal line, the switches are turned off in response to an OFF signal, and when the scanning signal is supplied to the further next gate signal line, the gate signal line to which the scanning signal is supplied at the two preceding stage is made to assume a floating state. The respective gate signal lines are connected to the signal lines to which the OFF signal is supplied through portions thereof which assume a floating state and diodes.

EXAMPLE (21)

In the liquid crystal display device according to the present invention, for example, respective pixels are arranged in a matrix array by arranging a plurality of pixel rows, each of which includes a plurality of pixels arranged in parallel in one direction in rows arranged in another direction which crosses the one direction, each pixel row is selected in response to a scanning signal, and a video signal is supplied to the respective pixels in each selected pixel row. In this device, drain signal lines which supply the video signal are arranged to cross gate signal lines which supply the scanning signal; and, the scanning signal is supplied to the respective gate signal lines through switches which are turned on in response to signal scanned by a drive circuit thereof, such that when the signal is scanned and supplied to the next gate signal line, the switches are turned off in response to an OFF signal, and when the scanning signal is supplied to the further next gate signal line, the gate signal line to which the scanning signal is supplied at the two preceding stage is made to assume a floating state. The respective gate signal lines are connected to a voltage signal line which is made to assume a floating state through portions thereof which assume a floating state and diodes.

EXAMPLE (22)

In the liquid crystal display device according to the present invention, for example, respective pixels are arranged in a matrix array by arranging a plurality of pixel rows, each of which includes a plurality of pixels arranged in parallel in one direction in rows arranged in another direction which crosses the one direction. Each pixel includes a counter electrode which generates an electric field with a pixel electrode and a counter voltage signal line which supplies a counter voltage signal to counter electrodes of respective pixels of the sequentially selected pixel row in response to the selection. Drain signal lines which supply the video signals to the pixel electrode are arranged to cross the counter voltage signal line. A counter voltage signal is supplied to the respective counter voltage signal lines through switches which are turned on in response to a signal scanned by a drive circuit thereof, such that when the signal is scanned and supplied to the next counter voltage signal line, the counter voltage signal line to which the counter voltage signal is supplied before the supply of the counter voltage signal to the next counter voltage signal line is made to assume a floating state. The respective counter voltage signal lines are connected to the voltage signal line to which the counter voltage signal is supplied through portions thereof which assume a floating state and diodes.

EXAMPLE (23)

In the liquid crystal display device according to the present invention, for example, respective pixels are arranged in a matrix array by arranging a plurality of pixel rows, each of which includes a plurality of pixels arranged in parallel in one direction in rows arranged in another direction which crosses the one direction. Each pixel includes a counter electrode which generates an electric field between the counter electrode and a pixel electrode and a counter voltage signal line which supplies a counter voltage signal to the counter electrodes of respective pixels of the sequentially selected pixel row in response to the selection, and drain signal lines which supply the video signals to the pixel electrode are arranged to cross the counter voltage signal line. The counter voltage signal is supplied to the respective counter voltage signal lines through switches which are turned on in response to a signal scanned by a drive circuit thereof, such that when the signal is scanned and supplied to the next counter voltage signal line, the counter voltage signal line to which the counter voltage signal is supplied before the supply of the counter voltage signal to the next counter voltage signal line is caused to assume a floating state. The respective counter voltage signal lines are connected to the voltage signal line which is caused to assume a floating state through portions thereof which assume a floating state and diodes.

EXAMPLE (24)

In the liquid crystal display device according to the present invention, for example, respective pixels are arranged in a matrix array by arranging a plurality of pixel rows, each of which includes a plurality of pixels arranged in parallel in one direction in rows arranged in another direction which crosses the one direction, each pixel row is selected in response to a scanning signal, and a video signal and a reference signal which becomes the reference with respect to the video signal are supplied to the respective pixels in each selected pixel row. In this device, drain signal lines which supply the video signal are arranged to cross gate signal lines which supply the scanning signal and counter voltage signal lines which supply the reference signal. The reference signal is supplied to the pixels for every selected pixel row, and, at the same time, most of the gate signal lines and the counter voltage signal lines in other pixel rows, except for the selected pixel rows, are respectively configured to assume a floating state. The respective gate signal lines are connected to a first voltage signal line which is made to assume a floating state through portions thereof which assume a floating state and first diodes, and the respective counter voltage signal lines are connected to a second voltage signal line, which is made to assume a floating state through portions thereof which assume a floating state and second diodes. The first voltage signal line and the second voltage signal line are connected to each other via a third diode.

EXAMPLE (25)

In the liquid crystal display device according to the present invention, for example, respective pixels are arranged in a matrix array by arranging a plurality of pixel rows, each of which includes a plurality of pixels arranged in parallel in one direction in rows arranged in another direction which crosses the one direction, each pixel row is selected in response to a scanning signal, and a video signal and a reference signal which becomes the reference with respect to the video signal are supplied to the respective pixels in each selected pixel row. In this device, drain signal lines which supply the video signal are arranged to cross gate signal lines which supply the scanning signal and counter voltage signal lines which supply the reference signal. The reference signal is supplied to the pixels for every selected pixel row, and, at the same time, most of the gate signal lines and the counter voltage signal lines in other pixel rows, except for the selected pixel rows, are respectively configured to assume a floating state. The respective gate signal lines are connected to a first voltage signal line which is made to assume a floating state through portions thereof which assume a floating state and first diodes, and the respective counter voltage signal lines are connected to a second voltage signal line which is made to assume a floating state through portions thereof which assume a floating state and second diodes. The first voltage signal line and the second voltage signal line are connected to signal lines which are grounded via a third diode and a fourth diode, respectively.

EXAMPLE (26)

The liquid crystal display device according to the present invention is, for example, based on the constitution of any one of the Examples (20) to (25), characterized in that the diode is a double-way diode.

EXAMPLE (27)

The liquid crystal display device according to the present invention is, for example, based on the constitution of the Example (26), characterized in that the double-way diode has a semiconductor layer thereof formed of polysilicon and the double-way diodes are formed on a substrate on which the gate signal lines and the counter voltage signal lines are formed.

The present invention is not limited to the above-mentioned constitutions and various modifications are conceivable without departing from the technical concept of the present invention.

BRIEF DESCRIPTION OF THE DRAWINGS

FIG. 3A is a specific circuit diagram showing one embodiment of the switching circuit SW1 shown in FIG. 2, and FIGS. 3B and 3C are operational timing diagrams;

FIGS. 29A and 29B are diagrams of another embodiment of the liquid crystal display device according to the present invention showing examples of the arrangement of respective drivers and the like;

DESCRIPTION OF THE PREFERRED EMBODIMENTS

Embodiments of a liquid crystal display device according to the present invention will be explained in detail in conjunction with the drawings.

Embodiment 1

Figure 1:
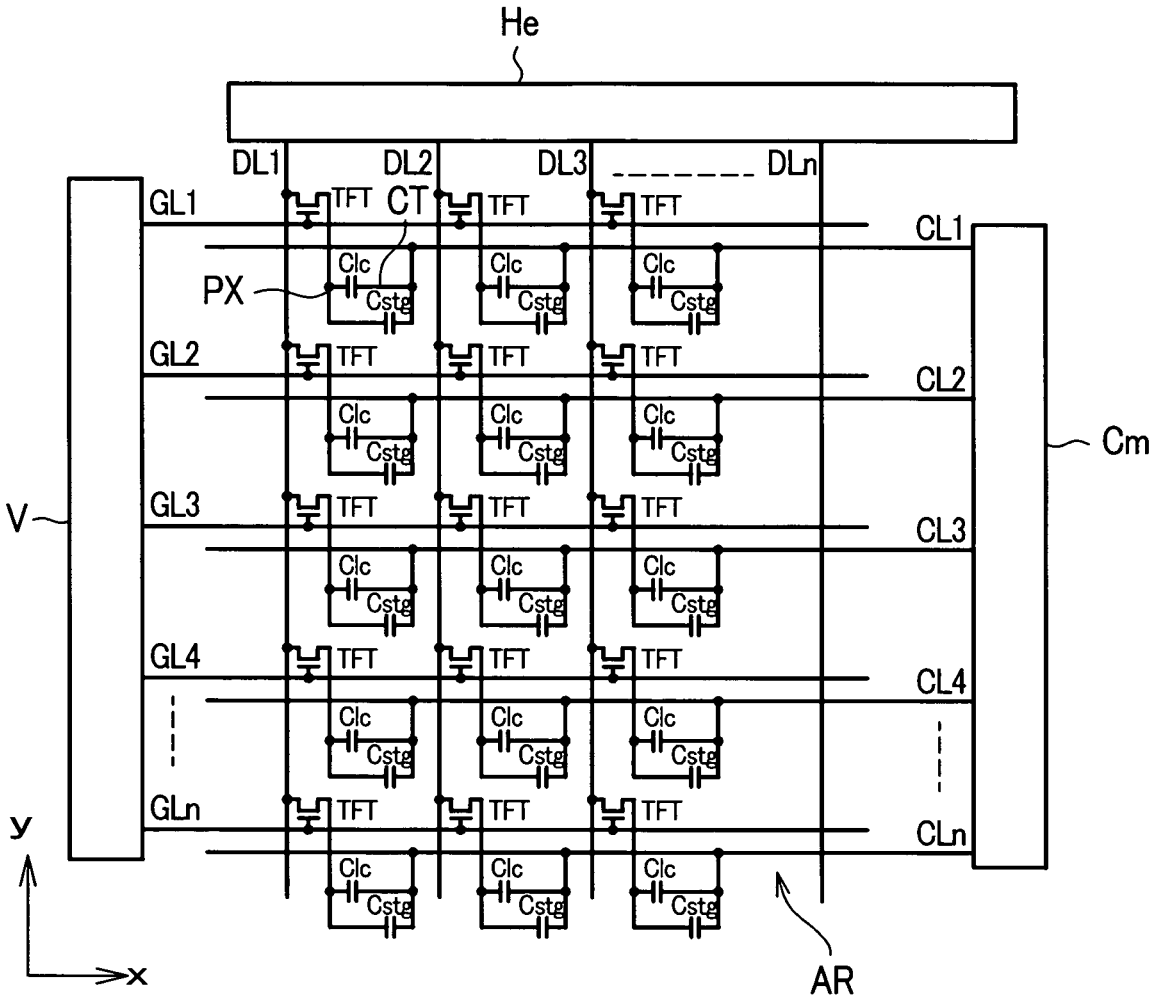
FIG. 1 is an equivalent circuit diagram showing one embodiment of the liquid crystal display device according to the present invention.

FIG. 1 is an equivalent circuit diagram showing one embodiment of the liquid crystal display device according to the present invention.

With respect to respective substrates which are arranged to face each other with liquid crystal material disposed therebetween, the equivalent circuit shown in FIG. 1 represents a circuit which is formed on a liquid-crystal-side surface of one substrate of the respective substrates.

In the drawing, gate signal lines GL (GL1, GL2, . . . , GLn, . . . ) extend in the x direction and are arranged in parallel in the y direction and drain signal lines DL (DL1, DL2, . . . , DLn, . . . ) extend in the y direction and are arranged in parallel in the x direction.

Regions which are surrounded by the respective gate signal lines GL and the respective drain signal lines DL constitute pixel regions and these respective pixel regions in a matrix array constitute a liquid crystal display part AR.

Further, in respective pixel regions which are arranged in parallel in the x direction, a common counter voltage signal line CL (CL1, CL2, . . . , CLn, . . . ) runs within respective pixel regions. The counter voltage signal line CL becomes a signal line for supplying a counter voltage signal which becomes the reference with respect to a video signal to respective counter electrodes CT of the respective pixel regions, as will be described later.

In each pixel region, a thin film transistor TFT is operated in response to a scanning signal from the one-side gate signal line GL, and a pixel electrode PX is provided to which the video signal from the one-side drain signal line DL is supplied through the thin film transistor TFT.

An electric field is generated between the pixel electrode PX and the counter electrode CT, and the optical transmissivity of the liquid crystal is controlled based on the electric field. Here, in the drawing, a capacitance which is generated between the pixel electrode PX and the counter electrode CT by way of the liquid crystal is indicated by CIc.

One end (at the left side of the drawing, for example) of each of the respective gate signal lines GL is connected to a scanning signal drive circuit V. Further, one end (at the upper side of the drawing, for example) of each of the respective drain signal lines DL is connected to a video signal drive circuit He.

The respective gate signal lines GL are sequentially selected one after another in response to the scanning signals supplied from the scanning signal drive circuit V, and the video signals are supplied to the respective drain signal lines DL in the time with the selecting of the gate signal lines GL.

Further, in this embodiment, one end (at the right side of the drawing, for example) of each of the respective counter voltage signal lines CL is connected to a common electrode drive circuit Cm. The common electrode drive circuit Cm is configured to supply a reference signal which becomes a reference with respect to the video signals to the counter voltage signal line CL which is connected to the counter electrodes CT of the pixel row selected by the scanning signal drive circuit V. Here, in the explanation presented hereinafter, the reference signal is referred to as a counter voltage signal in some cases.

Further, as seen in FIG. 1, a capacitive element Cstg is formed between the pixel electrode PX and the counter voltage signal line CL. The capacitive element Cstg is provided for storing the video signal supplied to the pixel electrode PX for a relatively long time.

Figure 2:
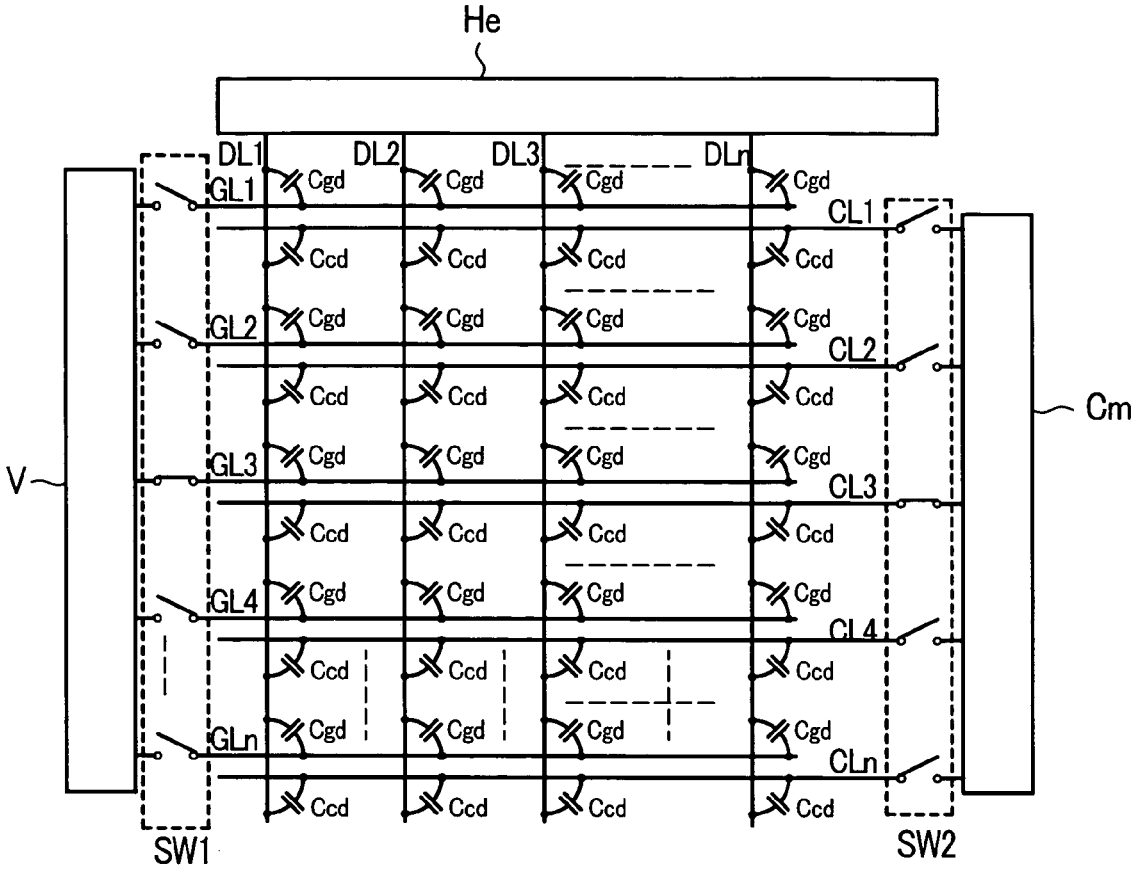
FIG. 2 is a schematic diagram of one embodiment of the liquid crystal display device according to the present invention.

FIG. 2 is a view showing the concept of driving method of the above-mentioned common electrode drive circuit Cm, wherein the thin film transistors TFT, the pixel electrodes PX, the counter electrodes CT and the capacitive elements Cstg shown in FIG. 1 are omitted from the drawing.

The supply of the scanning signals from the scanning signal drive circuit V is performed by changing over a switching circuit SW1, and, here, it is assumed that the gate signal line GL3 is selected. In this case, the supply of a counter voltage signal from the common electrode drive circuit Cm is performed by the changeover of a switching circuit SW2 so as to select the counter voltage signal line CL3.

Here, the gate signal line GL3 functions as a gate signal line for driving the respective thin film transistors TFT of the pixel row in which the pixels PX are arranged in parallel in the x direction, while the counter voltage signal line CL3 functions as a counter voltage signal line which is connected to the counter electrodes CT in the pixel row. The gate signal lines GL and the counter voltage signal lines CL in the pixel rows other than the above-mentioned pixel row are electrically separated from the scanning signal drive circuit V and the common electrode drive circuit Cm respectively thus assuming a floating state.

Here, the liquid crystal display part AR which consists of an array of pixel regions is positioned inside of a sealing material (not shown in the drawing), while the scanning signal drive circuit V, the video signal drive circuit He and the common electrode drive circuit Cm are respectively positioned outside of the sealing material. The sealing material is formed for fixing another substrate to one substrate and for sealing the liquid crystal between the substrates.

In the liquid crystal display device having such a constitution, the gate signal lines GL and the counter voltage signal lines CL in other pixel rows except for the pixel row selected by the scanned gate signal line GL are made to assume a floating state.

Due to such a constitution, the parasitic capacitance between the drain signal line DL and the gate signal line GL in which the potential fluctuates and the counter voltage signal line CL becomes 0 ideally. Here, to consider the constitution in an ideal state, out of 1024 gate signal lines GL, a single line constitutes the parasitic capacitance, and, hence, the parasitic capacitance Cgd is drastically reduced to 1/1024. Further, out of 1024 counter voltage signal lines CL, also a single line constitutes the parasitic capacitance, and, hence, the parasitic capacitance Ccd is drastically reduced to 1/1024. Accordingly, the parasitic capacitance as a whole can be drastically reduced to 1/1024.

In this case, it is necessary that both of the scanning signal and the counter voltage signal are turned off. This is because of the fact that, when only one of these signals is turned off by chance, for example, when the parasitic capacitance Cgd is becomes 1/1024, so long as the parasitic capacitance Ccd is not changed and is held at a conventional value, the parasitic capacitance as a whole is only reduced to approximately ½; and, hence, there arises a difference by two digits in advantageous effects as compared with 1/1024 in the case in which both signals are turned off.

Here, in this embodiment, both of the gate signal lines GL and the counter voltage signal lines CL in other pixel rows except for the selected pixel row are made to assume the floating state. However, it may be possible to make only the counter voltage signal lines CL assume the floating state.

By making only the counter voltage signal lines CL assume the floating state, it is possible to obtain another advantageous effect which is different from the advantageous effect obtained by making the gate signal lines GL assume the floating state. That is, to focus on one counter voltage signal line CL, the capacitive element Cstg is connected between the counter voltage signal line CL and the pixel electrodes PX of respective pixels, and, hence, a large number of capacitive elements Cstg are formed.

In such a case, the respective potentials of the pixel electrodes PX when the thin film transistors TFT are turned on are determined based on the potential of the video signal D supplied to the pixel electrodes PX through the thin film transistors TFT. Assuming that the voltage supplied to the pixel electrode PX when the thin film transistor TFT assumes the ON state is PXon, due to a jump voltage which is generated at the changeover of the thin film transistor TFT from the ON state to the OFF state, the pixel electrode PX assumes the potential PXoff during the hold time. Here, the jump voltage consists of the voltage difference (PXon−PXoff) of the pixel electrode PX. The liquid crystal molecules are driven based on the potential PXoff and the potential of the counter electrode CT.

The above-mentioned jump voltage depends on the sizes of respective portions of the thin film transistor TFT, the crossing area, the film thickness of an insulation film and the like. Further, irregularities within a certain range inevitably occur during the manufacturing steps with respect to these values, and, hence, it is extremely difficult to maintain the same values in all individual products. Accordingly, the value of the jump voltage also exhibits different characteristics for respective products.

On the other hand, the liquid crystal is usually driven by alternation in accordance with every line unit or every frame unit to avoid flicker, image retention attributed to the storage of a DC voltage. The alternation is performed with respect to the potential of the counter voltage signal line CL. That is, the alternation is performed to prevent the generation of a DC voltage component in the voltage difference between the counter voltage signal line and the pixel electrode PX on the average over a long time period.

Conventionally, the potential of the counter voltage signal line CL is supplied from the outside even during the OFF period of the thin film transistor TFT, and the voltage of the counter voltage signal line CL is a preset voltage. Further, this voltage is set to a center voltage between the potential PXoff of positive pole and negative pole to prevent the storage of the DC voltage. This center voltage is a voltage which is referred to as an optimum Vcom.

However, in a method which supplies the optimum Vcom from the outside, it is difficult to cope with the irregularities of potential PXoff attributed to the difference of the jump voltage among the above-mentioned respective products. Further, the characteristics of the thin film transistor TFT may fluctuate due to the use thereof for a long time depending on the environment where the thin film transistor TFT is used. Under the current circumstances in which the product lifetime of the personal computer is prolonged or the use of the liquid crystal display device for a TV receiver set for 10 years or more is taken for granted, this becomes a problem on which more attention should be focused.

Further, even when the characteristics of the thin film transistor TFT fluctuate, the jump voltage is subject to the influence of such a fluctuation and differs from the jump voltage at the time of manufacturing the product. Further, a driver which generates the gate voltage and a power source circuit which supplies the gate voltage to the driver may also give rise to a fluctuation in the characteristics thereof due to the use thereof for a long time. This also influences the jump voltage.

Accordingly, in the conventional method which supplies the optimum Vcom as a preset voltage from the outside, it has been pointed out that the method cannot cope with such a fluctuation for a long time.

To the contrary, as described above, by making the counter voltage signal line CL assume the floating state corresponding to the OFF time of the thin film transistor TFT, the counter voltage signal line CL is always set to the center voltage of the potential PXOFF in accordance with the line unit through the capacitive element Cstg in a self aligning manner. Here, the remarkable increase of the electrical capacitance between the pixel electrode PX and the counter voltage signal line CL due to the capacitive element Cstg effectively works.

Accordingly, even when irregularities in the jump voltage arise among individual products or the jump voltage fluctuates due to the use of products for a long time, the voltage of the counter voltage signal line CL is adjusted to the optimum voltage in a self aligning manner in conformity with a change in the circumstances. Accordingly, it is possible to obtain advantageous effects which can not be obtained by the conventional method, such as the avoidance of influence attributed to individual specificity of individual products or the avoidance of influence of fluctuation of characteristics attributed to the use of a product for a long time.

Embodiment 2

FIG. 3A is a circuit diagram showing one embodiment of the switching circuit SW1 shown in FIG. 2.

First of all, with respect to respective gate signal lines GL1, GL2, . . . , GLn, GLn+1 to which the scanning signals G1, G2, . . . , Gn, Gn+1 are respectively supplied from the scanning signal drive circuit V, to take the gate signal line GLn as an example, the signal line which supplies the scanning signal Gn from the scanning signal line drive circuit V is firstly connected to a gate electrode G of the switching element SW1(*n*).

The switching element SW1(*n*) has, for example, a drain electrode D thereof connected to a signal line VgON and a source electrode S thereof connected to the above-mentioned gate signal line GLn. Further, the source electrode S of the switching element SW1(*n*) is connected to a source electrode S of the switching element SW2(*n*). The above-mentioned switching element SW2(*n*) has a gate electrode G thereof connected to a signal line which supplies a scanning signal Gn+1 from the scanning signal line drive circuit V and a drain electrode thereof connected to a signal line VgOFF.

The respective other gate signal lines GL except for the gate signal line GLn also have substantially the same constitution and use the above-mentioned signal line VgON and signal line VgOFF in common.

Here, it is needless to say that the switching element SW1 may be formed on a surface of one substrate of the respective substrates which are arranged to face each other with liquid crystal disposed therebetween, or it may be incorporated into the scanning signal drive circuit V.

FIG. 3B is a timing diagram showing the operation of the above-mentioned switching element SW1. FIG. 3B indicates, from above, the scanning signals Gn, Gn+1, Gn+2 which are transmitted from the scanning signal drive circuit V, the scanning signals which are supplied to the scanning signal lines GLn, GLn+1, GLn+2 in such a case, and ON/OFF states of the switch SW1(*n*), the switch SW1(*n*+1), the switch SW1(*n*+2), the switch SW2(*n*), the switch SW2(*n*+1) and the switch SW2(*n*+2) in such a case.

In other words, in conformity with timing of the scanning signals Gn, Gn+1, Gn+2 which are transmitted from the scanning signal drive circuit V, the switch SW1(*n*), the switch SW1(*n*+1), the switch SW1(*n*+2), the switch SW2(*n*), the switch SW2(*n*+1) and the switch SW2(*n*+2) are turned on or off as shown in the drawing whereby the scanning signals shown in the drawing are supplied to the scanning signal lines GLn, GLn+1, GLn+2.

Here, even when "n" described above is replaced with a numeral such as 1 or 2, this embodiment is also established in the same manner.

In the drawing, when the scanning signal Gn is supplied, the switch SW1(*n*) is turned on and the ON voltage is supplied to the gate signal line GL(n) through the signal line VgON. Then, when the scanning signal is not supplied any more and the next scanning signal Gn+1 is supplied, the switch SW1(*n*) is turned off and the switch SW2(*n*) is turned on.

Accordingly, the OFF voltage is supplied to the gate signal line GLn through the signal line VgOFF.

Thereafter, neither one of scanning signals Gn, Gn+1 is supplied and both of the switches SW1(*n*), SW2(*n*) are turned off, the gate signal line GL(n) assumes the floating state FT and, thereafter, this floating state is maintained until the scanning signal Gn is supplied again.

In this embodiment which is operated in the above-mentioned manner, the explanation is directed to the case in which OFF is written for 1 line and, thereafter, the gate signal line GL(n) is shifted to the floating state. However, as shown in FIG. 3C, it is needless to say that OFF may be written for two lines (or more) and thereafter, the gate signal line GL(n) is shifted to the floating state. This is because, by sufficiently setting the thin film transistor TFT at the OFF potential, leakage from the thin film transistor TFT during the floating period can be prevented.

To extend of such an OFF period, there may be provided another switch SW3(*n*) which supplies a signal from the signal line VgOFF by controlling the gate signal line GLn in response to the scanning signal Gn+2.

Figure 4:
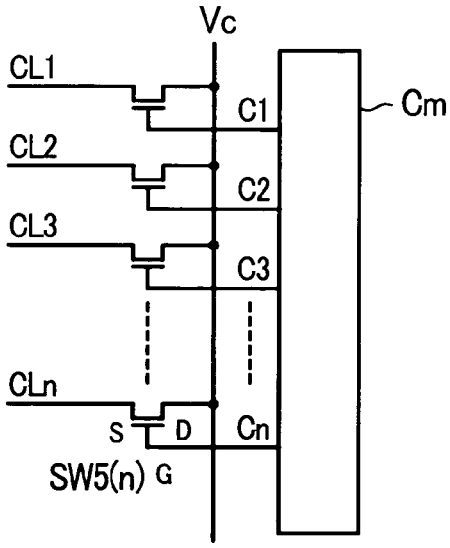
FIG. 4 is a specific circuit diagram showing one embodiment of the switching circuit SW2 shown in FIG. 2.

Further, FIG. 4 is a circuit diagram showing one embodiment of the switching circuit SW2 shown in FIG. 2.

First of all, of the respective counter voltage signal lines CL1, CL2, . . . , CLn, . . . to which the counter voltage signals C1, C2, . . . , Cn, . . . are respectively supplied from the common electrode drive circuit Cm, to take the counter voltage signal line CLn as an example, the signal line which supplies the counter voltage signal from the common electrode drive circuit Cm is connected to the gate electrode G of the switching element SW4(*n*).

Further, the switching element SW4(*n*) has a drain electrode D thereof connected to a signal line Vc and a source electrode S thereof connected to the counter voltage signal line CLn.

The respective other counter voltage signal lines CL except for the counter voltage signal line CLn also have substantially the same constitution and use the above-mentioned signal line Vc in common.

Here, it is needless to say that the switching element SW4 may be formed on a surface of one substrate of the respective substrates which are arranged to face each other with liquid crystal disposed therebetween, or the switching element SW4 may be incorporated into the scanning signal drive circuit V.

In such a constitution, respective counter voltage signals C1, C2, . . . , Cn, . . . from the common electrode drive circuit Cm are respectively supplied substantially in conformity with the timing of the supply of the scanning signals G1, G2, . . . , Gn, . . . from the scanning signal drive circuit V, wherein when the scanning signal G is supplied to the gate signal line GL in the pixel row of which a certain gate signal line GL is in charge, the counter voltage signal C is supplied to the counter voltage signal line CL which is formed in the inside of the pixel row.

Due to such a constitution, it is possible to make the counter voltage signal lines CL assume a floating state during a period in which the counter voltage signal is not supplied from the common electrode drive circuit Cm to the counter voltage signal lines CL.

Embodiment 3

Figure 5B:
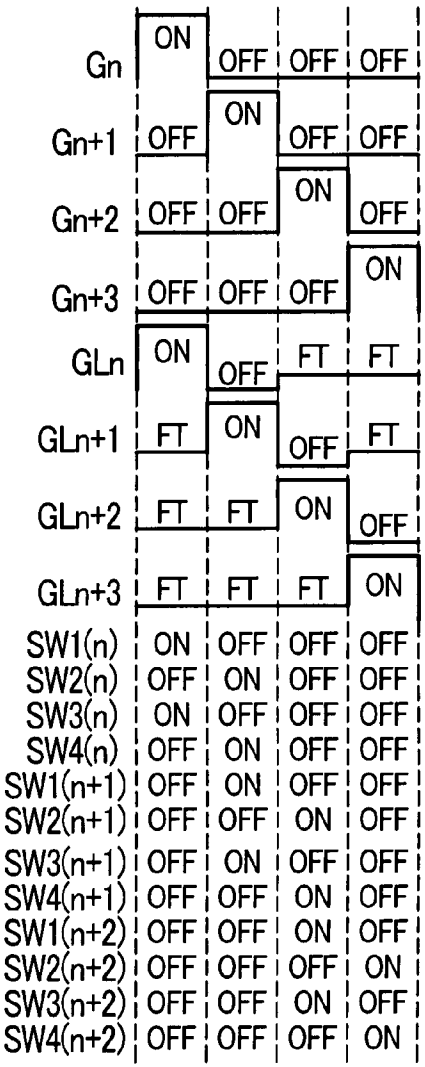
FIG. 5B is an operational timing diagram.
Figure 5A:
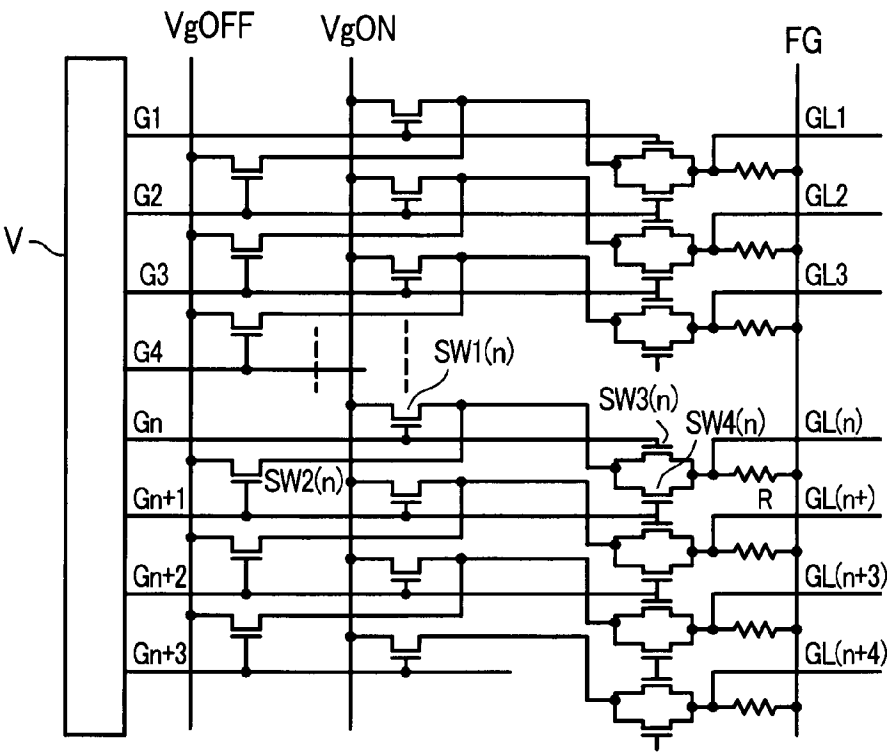
FIG. 5A is a specific circuit diagram showing another embodiment of the switching circuit SW1 shown in FIG. 2.

FIG. 5A is a circuit diagram showing another embodiment of the switching circuit SW1 shown in FIG. 2, and it corresponds to FIG. 3A.

The constitution which makes this embodiment different from the embodiment shown in FIG. 3A lies in the fact that the respective gate signal lines GL which assume a floating state are connected to the floating potential line FG with a high resistance and are electrically connected to the other gate signal lines GL which are arranged close to the respective gate signal lines GL and assume a floating state.

That is, to take the gate signal line GLn as an example, a signal which is supplied from the signal line VgON via the switching element SW1 is inputted to a parallel connection body formed of a switching element SW3(*n*) and a switching element SW4(*n*).

Here, the switching element SW3(*n*) is driven in response to a signal Gn from a scanning signal drive circuit V and the switching element SW4(*n*) is driven in response to a signal Gn+1 from a scanning signal drive circuit V.

An output terminal of the parallel connection body formed of the switching element SW3(*n*) and the switching element SW4(*n*) is connected to the above-mentioned gate signal line GLn and also connected to a floating potential line FG via a high resistance R.

The respective other gate signal lines GL except for the above-mentioned gate signal GLn also have substantially the same constitution and use the above-mentioned floating potential line FG in common.

In such a constitution, the respective gate signal lines GL respectively traverse the drain signal line DL in substantially the same manner. Accordingly, the influences which the drain signal line DL receives from the respective gate signal lines GL are considered substantially equal for respective gate signal lines GL during the floating state.

Subsequently, by electrically connecting the gate signal lines GL with each other with high resistance during the floating state, an advantageous effect obtained by floating can be maintained and also the resistance against the disturbance such as external noises or the like can be improved.

FIG. 5B is a timing diagram showing an operation of the above-mentioned switching circuit SW1, and it corresponds to FIG. 3B.

FIG. 3B indicates, from above, the scanning signals Gn, Gn+1, Gn+2, Gn+3 which are transmitted from the scanning signal drive circuit V, the scanning signals which are supplied to the scanning signal lines GLn, GLn+1, GLn+2, GLn+3 in such a case, and ON/OFF states of the switch SW1(*n*) to the switch SW4(*n*), the switch SW1(*n*+1) to the switch SW4(*n*+1) and the switch SW1 (n+2) to the switch SW4(*n*+2) in such a case.

In FIG. 5B, in response to the supply (ON) of the scanning signal Gn, the switch SW1(*n*) and the switch SW3(*n*) are turned on and an ON voltage is supplied to the gate signal line GLn via the signal line VgON. Then, when the scanning signal Gn is turned off and the scanning signal Gn+1 is supplied (ON), the switch SW1(*n*), the switch SW3(*n*) are turned off and the switch SW2(*n*), the switch SW4(*n*) are turned on, and the OFF voltage is supplied to the gate signal line GLn via the signal line VgOFF.

Further, when the scanning signals Gn, Gn+1 are turned off and the scanning signal and the scanning signals after Gn+2 are turned on, all of the switch SW1(*n*) to the switch SW4(*n*) are turned off and the gate signal line GL(n) is connected to the floating potential line FG via the high resistance R. Accordingly, during most of the time, the gate signal line GL(n) assumes a floating state.

Here, the connection between the scanning signal line GL(n) and the floating potential line FG may be performed using a transistor before the scanning signal line G(n+1) and after the scanning signal line G(n+2). Here, the high resistance R may be or not be inserted between the scanning signal line GL(n) and floating potential line FG. This is because, although when a transistor is not mounted, the high resistance R is indispensable to avoid an inverse flow of voltage during the ON time, when the ON/OFF control is performed by a transistor circuit, the voltage can be controlled by the transistor.

Embodiment 4

Figure 6:
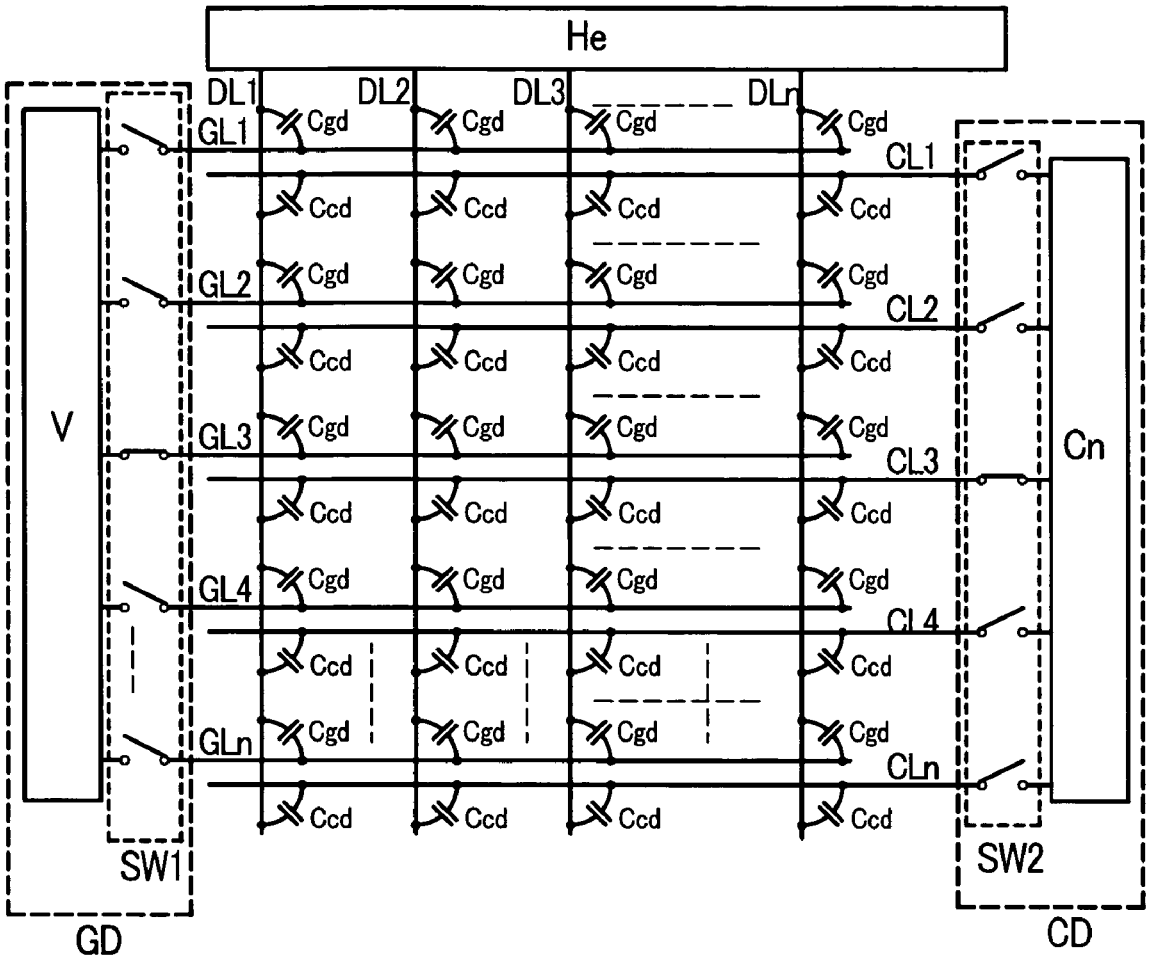
FIG. 6 is a schematic diagram showing another embodiment of the liquid crystal display device according to the present invention, also showing a driver which incorporates the above-mentioned switching circuits in a drive circuit.

FIG. 6 is a plan view showing another embodiment of the liquid crystal display device according to the present invention, and it corresponds to FIG. 2.

In this embodiment, a switching circuit SW1 which is formed in the vicinity of the scanning signal drive circuit V is configured as a gate driver GD together with the scanning signal drive circuit V and a switching circuit SW2 which is formed in the vicinity of the common electrode drive circuit Cm is constituted as a common driver CD together with the common electrode drive circuit Cm.

Figure 7A:
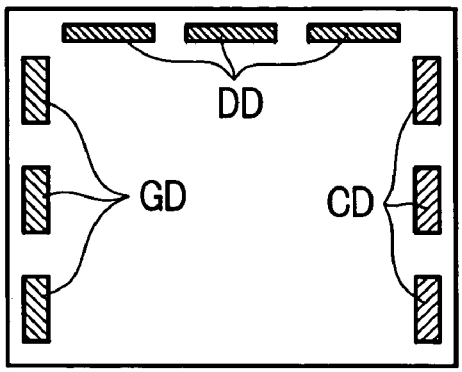
FIGS. 7A and 7B are diagrams showing various arrangements drivers.

In such a constitution, not to mention the fact that the video signal drive circuit (drain driver DD) is formed usually with a plurality of semiconductor devices, the gate driver GD and the common driver CD are also formed with a plurality of semiconductor devices and the gate driver GD and the common driver CD are arranged with respect to a transparent substrate SUB1, as shown in FIG. 7A.

Figure 7B:
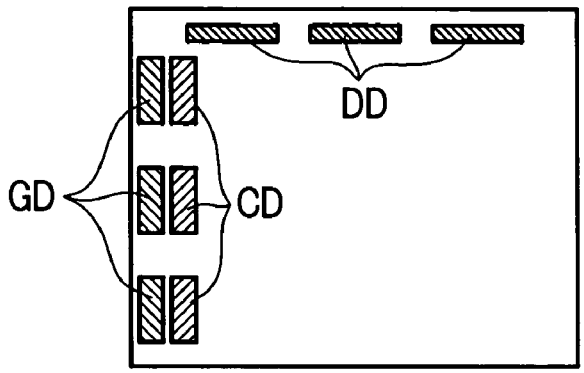
Figure 7C:
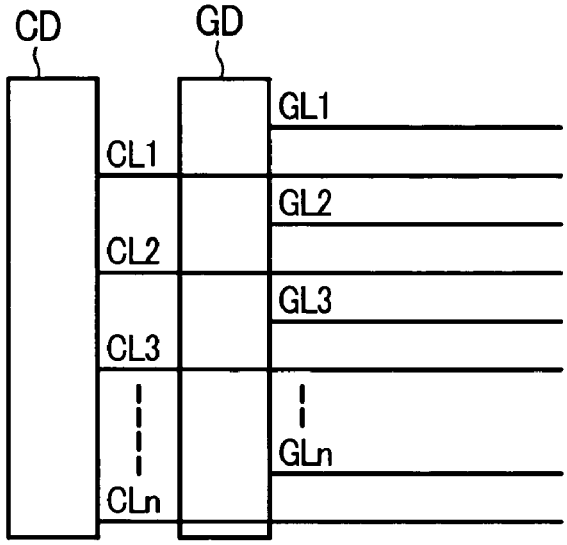
FIG. 7C is a circuit diagram showing the arrangement of the two drivers.

However, the arrangement is not limited to such an arrangement. For example, as shown in FIG. 7B, the gate driver GD and the common driver CD may be arranged in the vicinity of one end side of the transparent substrate SUB1. For example, the common driver CD may be arranged at the outer side of the gate driver GD.

Then, when the gate driver GD and the common driver CD are arranged as shown in FIG. 7B, the gate driver GD may be arranged such that the gate driver GD bridges over the respective counter voltage signal lines CL which are extended from the common-driver-CD side. In other words, the respective counter voltage signal lines CL may be constituted such that the respective counter voltage signal lines CL run below the gate driver GD.

This is because, even when the counter voltage signal line CL and the gate signal line GL are formed on the same layer, these counter voltage signal line CL and the gate signal line GL can be formed so as not to cause short-circuiting therebetween. In this case, it is needless to say that the counter voltage signal line CL and the gate signal line GL are formed on different layers while an insulation film is inserted therebetween.

Embodiment 5

Figure 8A:
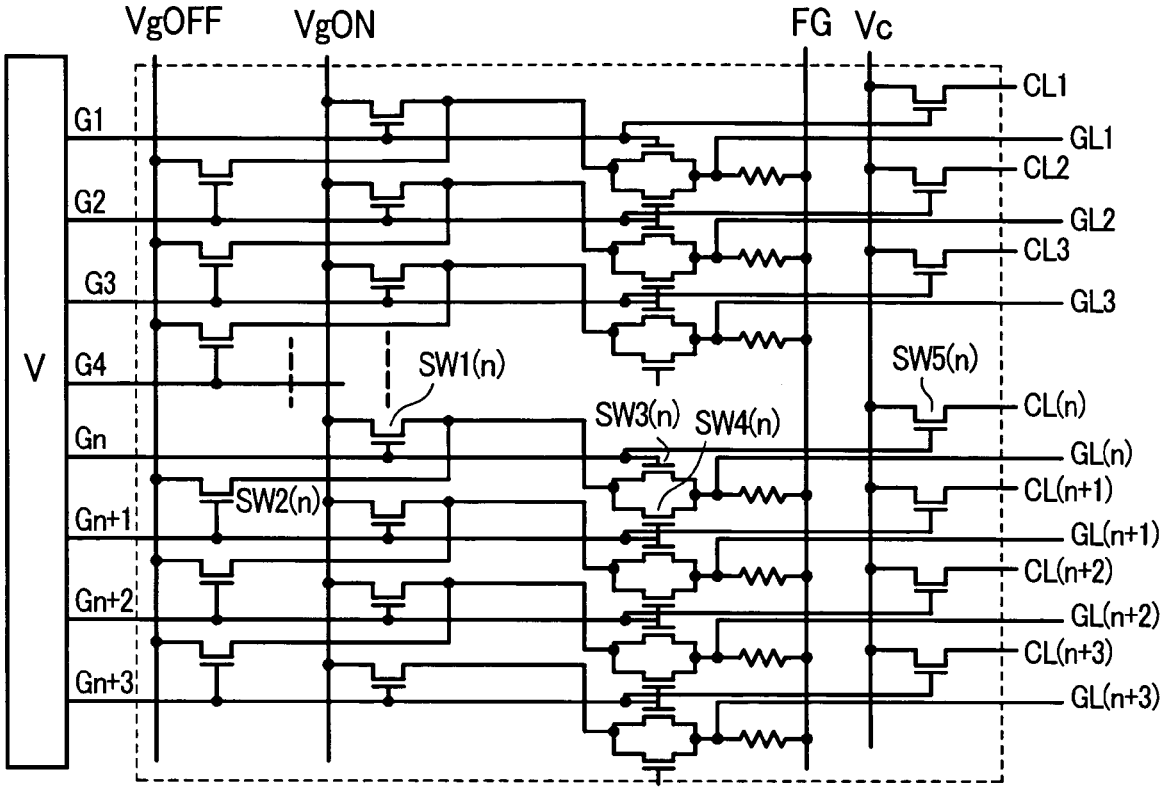
FIG. 8A is a schematic diagram showing another embodiment of the liquid crystal display device according to the present invention in the form of a circuit diagram in which a switching circuit SW2 for changing over counter voltage signal lines is incorporated into a switching circuit SW1 at a scanning signal drive circuit side.

FIG. 8A is a circuit showing another embodiment of the above-mentioned switching circuit SW1 and corresponds to FIG. 5A. The constitution which makes this embodiment different from the embodiment shown in FIG. 5A lies in the fact that a circuit which supplies the counter voltage signals to the respective counter voltage signal lines CL is incorporated into the circuit shown in FIG. 5A.

As shown in FIG. 8A, a circuit which resembles the circuit shown in FIG. 4 is incorporated into a rear stage and the scanning signal Gn supplied from the scanning signal drive circuit V is used as a signal (gate signal) for driving respective switches SW5(*n*) of the circuit.

That is, this embodiment is configured such that the counter voltage signal is supplied to the counter voltage signal line CL(n) through the signal line Vc by means of the switch SW5 which is turned on in response to the supply of the scanning signal Gn. The other counter voltage signal lines CL except for the above-mentioned counter voltage signal line CL(n) also have substantially the same constitution and, further, the signal line Vc is used in common.

The circuit having such a constitution can have a reduced number of parts and a reduced mounting space for parts.

Figure 8B:
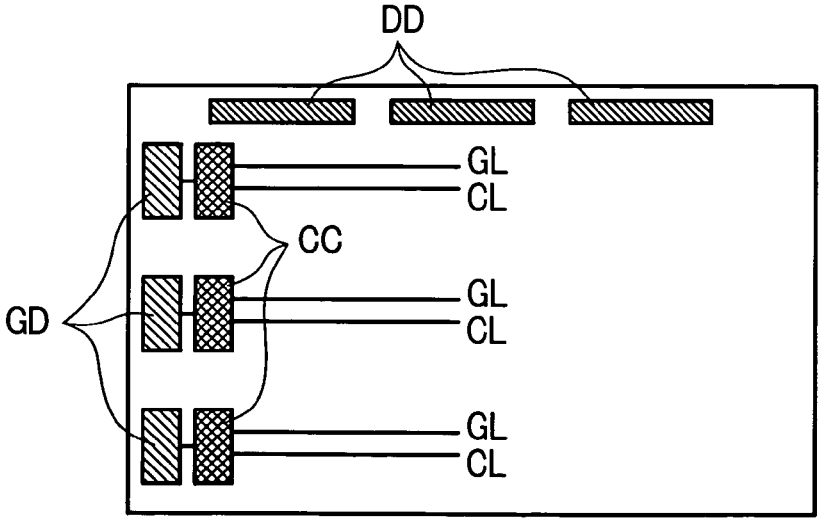
FIG. 8B is a diagram showing the arrangement of drivers.

The circuit shown in FIG. 8A may be configured in the semiconductor device together with the scanning signal drive circuit V, or as shown in FIG. 8B, the circuit may be formed on the surface of the transparent substrate SUB1. In this case, the transistor which is provided in the above-mentioned circuit is usually formed of polysilicon, for example.

Here, in FIG. 8B, the other circuits except for the scanning signal drive circuit V out of the circuit shown in FIG. 8A are shown as the control circuits CC.

Figure 9:
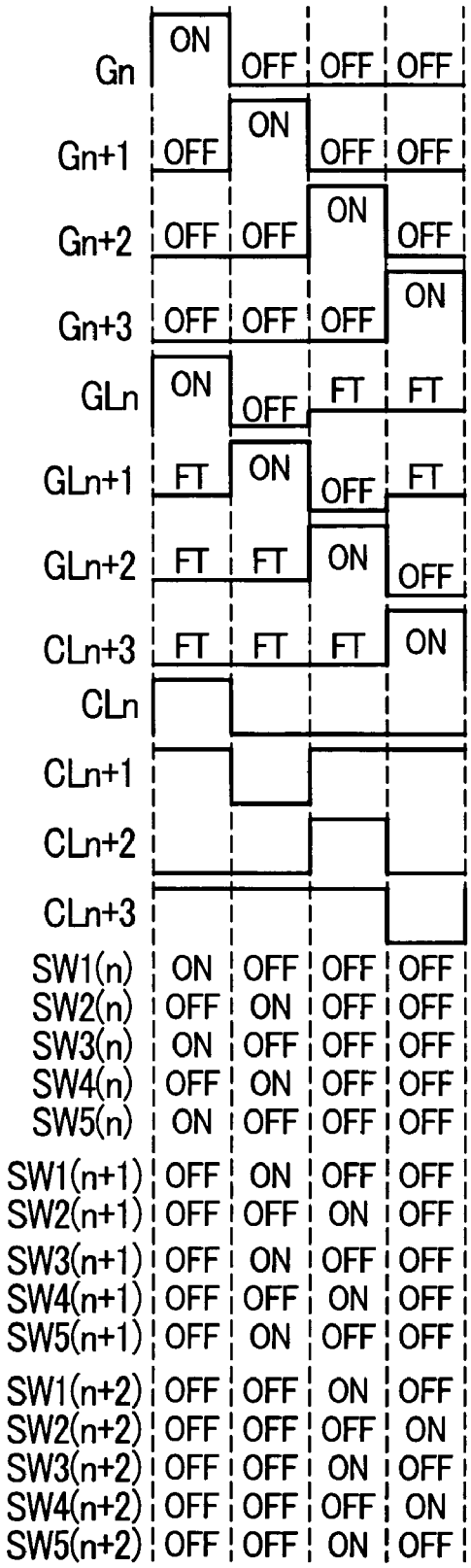
FIG. 9 is a timing diagram for the operation of the circuit shown in FIG. 8A.

FIG. 9 is a timing diagram showing an operation of the above-mentioned switching circuit SW1 and corresponds to FIG. 5B.

The timing diagram in FIG. 9 differs from the timing diagram in FIG. 5B in that, with respect to the counter voltage signal which is respectively supplied to the counter voltage signal lines CLn to CLn+3, the ON/OFF states of the switch SW5(*n*) to SW5(*n*+2) are newly added.

Embodiment 6

Figure 10A:
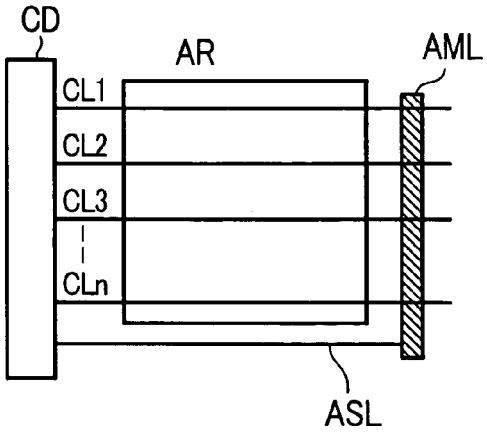
FIGS. 10A to 10C are diagrams showing another embodiment of the liquid crystal display device according to the present invention in which it is possible to repair a disconnection of a counter voltage signal line.

FIG. 10A is a plan view showing another embodiment of the liquid crystal display device according to the present invention. This embodiment is configured on the premise that, as mentioned above, the counter voltage signal is scanned and supplied to the respective counter voltage signal lines CL1, CL2, . . . , CLn, . . . from the common electrode drive circuit Cm (in which the switching circuit SW2 is formed).

In the region outside the liquid crystal display part AR, a correction wiring AML is formed such that the correction wiring AML respectively crosses the other end portions of the respective counter voltage signal line CL (common electrode drive circuit Cm and the other end portion of the opposite side) and via the counter voltage signal line CL and the insulation film. To the correction wiring AML, for example, the counter voltage signal is regularly supplied via an assisting wiring ALS (mounted in the region outside the liquid crystal display part AR) from the common electrode drive circuit Cm, for example.

Figure 10B:
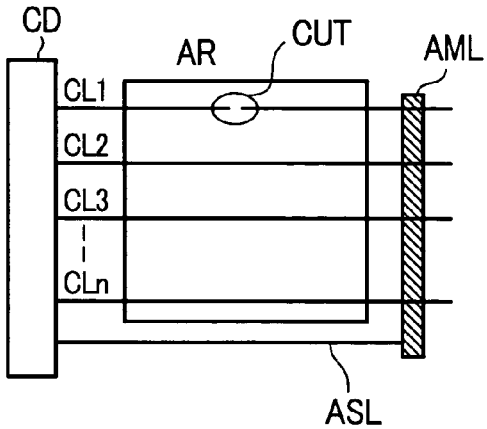

With respect to the liquid crystal display device having such a constitution, for example, as shown in FIG. 10B, when a disconnection CUT is generated in the counter voltage signal lines CL1, a defective display is generated at the pixel row of the portion which is separated from the common electrode drive circuit Cm out of the counter voltage signal line CL1.

Figure 10C:
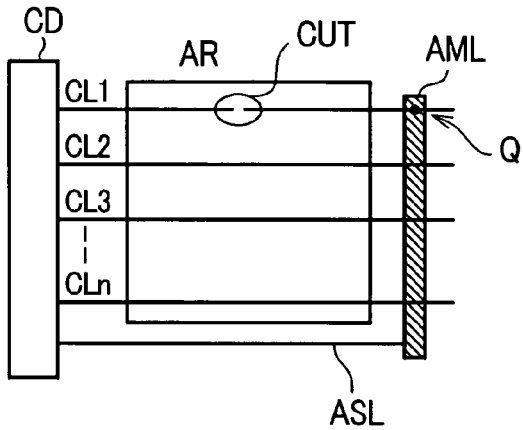

In such a case, as shown in FIG. 10C, for example, by irradiating laser beams to the crossing portion of the counter voltage signal line CL1 which is separated from the common electrode drive circuit Cm and the correction wiring AML, the counter voltage signal line CL1 and the correction wiring AML are electrically connected to each other (shown as an arrow Q in the drawing). By this means, the counter voltage signal is always supplied to the counter voltage signal line CL1 which is separated from the common electrode drive circuit Cm via the above-mentioned assisting wiring ASL and the correction wiring AML.

The portion of the common voltage signal line CL1 on which the connection is recovered does not assume a floating state and hence, the parasitic capacitance between the common voltage signal line CL1 and the drain signal line DL increases. However, even when a few lines of disconnections are corrected, the effect in which one several hundredth parasitic capacitance can be reduced can be maintained.

Embodiment 7

The aspect of this embodiment lies in the fact that, based on a constitution in which, as mentioned above, the gate signal line GL assumes a floating state during the most of other period except for the writing period, the polarity of the video signal to the respective drain signal lines DL is made to have the same phase with the polarity of the video signal which is supplied to the drain signal lines arranged close to each other for every line, for example.

Figure 11:
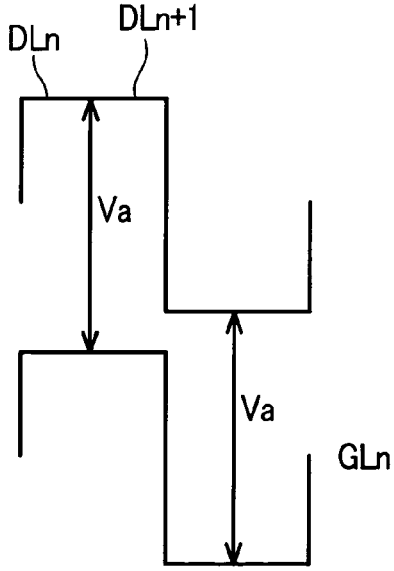
FIG. 11 is a diagram of another embodiment of the liquid crystal display device according to the present invention showing a state in which video signals having the same polarity are supplied to neighboring drain signal lines.

FIG. 11 is a view showing fluctuations of the potential at a point between the drain signal line DLn and the drain signal line DLn+1 in a certain line (gate signal line Gn) when the respective polarities of the drain signal line DLn and the drain signal line DLn+1 are assumed as +, for example, and the polarities of the drain signal lines DL1 to DLn at a next stage are assumed as −.

In this case, when the above-mentioned gate signal line GLn is made to assume a floating state, the potential at the point fluctuates corresponding to the polarity of the signal supplied to the drain signal lines DLn and DLn+1.

That is, the respective potential differences of the drain signal lines DLn, DLn+1 with respect to the above-mentioned point of the gate signal line Gn firstly assume Va, for example, and the respective potential differences of the drain signal lines DLn, DLn+1 in the next stage assume also Va.

This implies that no parasitic capacitance is generated between the respective gate signal lines GL which are made to assume a floating state and the drain signal line DL to which video signals are supplied and hence, it is possible to obtain an advantageous effect that the power consumption can be reduced.

Figure 12:
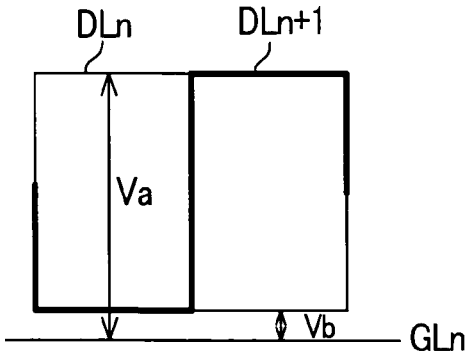
FIG. 12 is a diagram illustrating drawbacks which occur when video signals having different polarities are supplied to neighboring drain signal lines.

For a comparison purposes, FIG. 12 shows fluctuations of the potential at the point between the drain signal line DLn and the drain signal line DLn+1 in a certain line (gate signal line Gn) when video signals are supplied so that the drain signal line DLn assumes + polarity, the drain signal line DLn+1 assumes − polarity and, at a next stage, the drains signal line DLn assumes − polarity and the drain signal line DLn+1 assume + polarity.

In this case, when the gate signal line GLn is made to assume a floating state, the voltage between the drain signal line DLn and the DLn+1 varies alternately in such a manner that the voltage assumes Va in one side and assumes Vb in another side.

Accordingly, it is necessary to perform charging and discharging of the drain signal lines DLn and the drain signal line DLn+1 with respect to the gate signal line GL and this interferes with a reduction of the power consumption.

Although the above-mentioned embodiment shows an example in which the polarities of the neighboring drain signal lines DL have the same phase for every one line, it is needless to say that the polarities of the neighboring drain signal lines DL have the same phase for every plurality of lines such as for every two lines or for every three lines or for every frame. Also in these cases, no parasitic capacitance is generated between the gate signal lines GL and the drain signal lines DL and hence, the power consumption can be reduced.

Embodiment 8

This embodiment is characterized in that, along with the constitution shown in the embodiment 7, that is, along with the constitution in which the polarities of the video signals to the respective drain signal lines DL are made to have the same phase with the polarities of the video signals supplied to the drain signal lines which are arranged close to each other for every one or several lines, for example, the counter voltage signal lines CL are inversely driven at the time of scanning.

Due to such a constitution, the amplitude per se of the signal at the drain signal line DL can be halved and hence, a reduction of the power consumption can be realized.

Then, by reducing the amplitude of the signal at the drain signal line DL, the fluctuation width of the scanning signal G is reduced whereby the reduction effect of the power consumption by floating can be further enhanced.

Further, a so-called common inversion which is performed conventionally always drives the potential of the counter electrodes CT on the whole screen and hence, there arises a drawback in that the load is extremely heavy and the power consumption at the drive circuit for counter electrodes CT is large.

However, according to the above-mentioned embodiment, the counter voltage signal lines CL are also made to assume a floating state after the supply of the voltage. That is, the number of the driving counter voltage signal lines CL can be largely reduced to a several hundredth or less, the power consumption at the above-mentioned common electrode drive circuit Cm can be minimized and hence, the effect of the reduction of the power consumption of the video signal drive circuit He substantially leads to a reduction of the power consumption of the whole liquid crystal display device.

Further, it is no longer necessary to supply a large current to the respective counter electrodes CT and hence, the reliability of the liquid crystal display device can be enhanced and the cost of parts can be reduced.

As mentioned above, the counter voltage signal lines CL assume the floating state after writing of signals and the potential thereof follows the potential of the video signals D in the same manner as the gate signal lines GL and hence, provided that the polarity of the neighboring video signal lines DL has the same phase as the polarity of the counter voltage signal line CL, the floating effect can be sufficiently achieved.

That is, due to the combination of the respective constitutions constituted of the combination (1) that the gate assumes a floating state at most of the other period except for the writing period, the constitution (2) that the common assumes a floating state at the most period other than the writing period, the constitution (3) that the neighboring video signal lines are driven at the same phase, and the constitution (4) that the common is inversely driven, the maximum power consumption reduction effect can be realized.

Embodiment 9

Figure 13A:
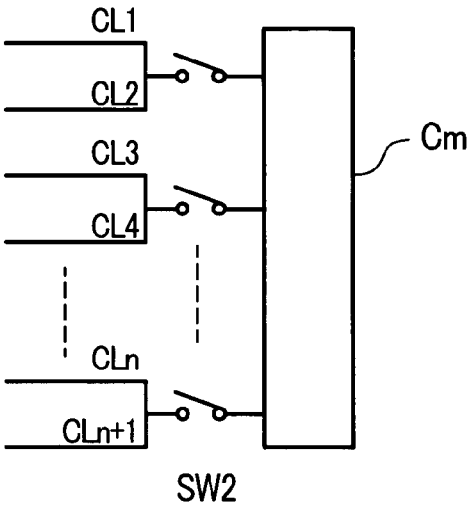
FIGS. 13A and 13B are schematic diagrams of another embodiment of the liquid crystal display device according to the present invention showing a constitution which simultaneously supplies a counter voltage signal to a plurality of counter voltage signal lines.
Figure 13B:
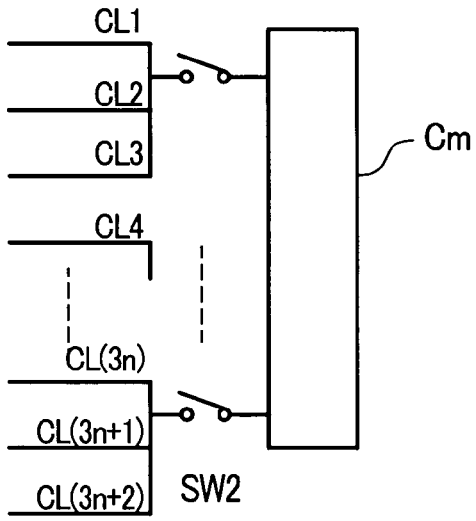
Figure 13C:
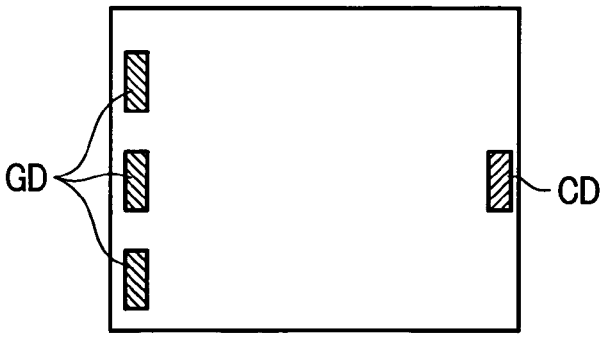
FIG. 13C is a diagram showing an arrangement of drivers.

FIGS. 13A to 13C are directed to another embodiment of the liquid crystal display device according to the present invention, showing the connection between the common electrode drive circuit Cm and the respective counter voltage signal lines CL via the switching circuit SW2.

FIG. 13A shows that the respective counter voltage signal lines CL are connected such that, for example, each two lines are connected to each other at a connecting portion sequentially from above and, the counter voltage signal is sequentially supplied to the counter voltage signal lines CL through these connecting portions. FIG. 13B shows that the respective counter voltage signal lines CL are connected such that, for example, each three lines are connected to each other at a connecting portion sequentially from above and, the counter voltage signal is sequentially supplied to the counter voltage signal lines CL through these connecting portions. Although not shown in the drawing, the counter voltage signal lines CL may be connected by each of four or more lines.

In such a constitution, as shown in FIG. 13C, the number of the common drivers CD of the common electrode drive circuit Cm can be made smaller than the number of the gate drivers GD of the scanning signal drive circuit V.

Figure 14A:
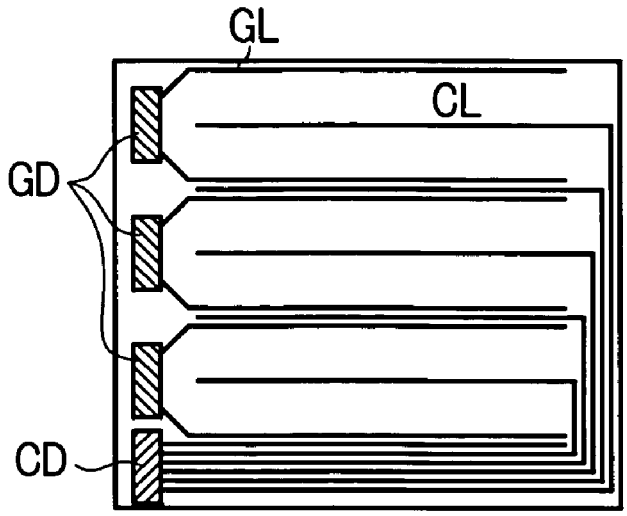
FIGS. 14A and 14B are diagrams of another embodiment of the liquid crystal display device according to the present invention showing the arrangement of drivers on a surface of a transparent substrate.
Figure 14B:
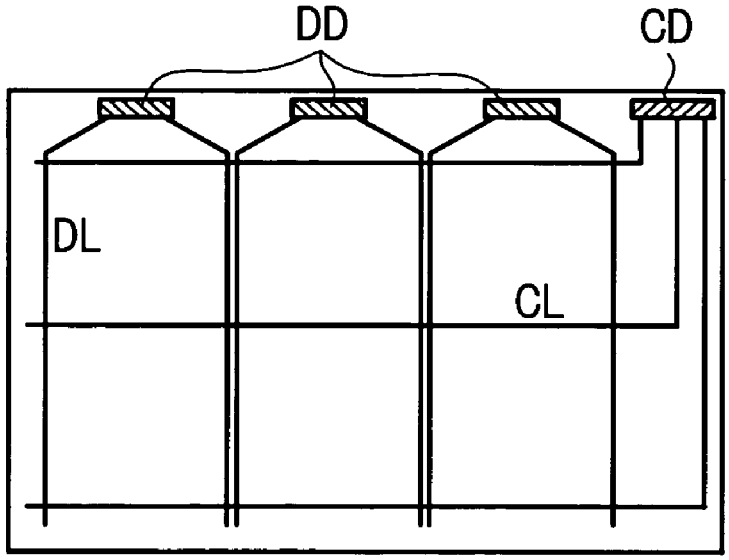

Subsequently, as shown in FIG. 14, for example, the common driver CD of the common electrode drive circuit Cm can be arranged next to the gate driver GD of the scanning signal drive circuit V (FIG. 14A) or it can be arranged next to the drain driver DD of the video signal drive circuit He (FIG. 14B). Due to such an arrangement, the space which the liquid crystal display panel requires can be reduced.

Embodiment 10

Figure 15A:
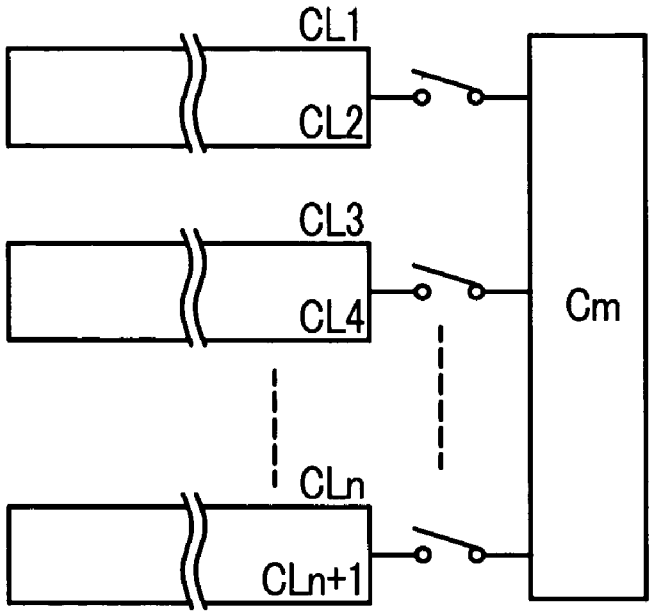
FIGS. 15A and 15B are diagrams of another embodiment of the liquid crystal display device according to the present invention showing a state in which a plurality of counter voltage signal lines are constituted in a loop shape when a counter voltage signal is simultaneously supplied to the plurality of counter voltage signal lines.
Figure 15B:
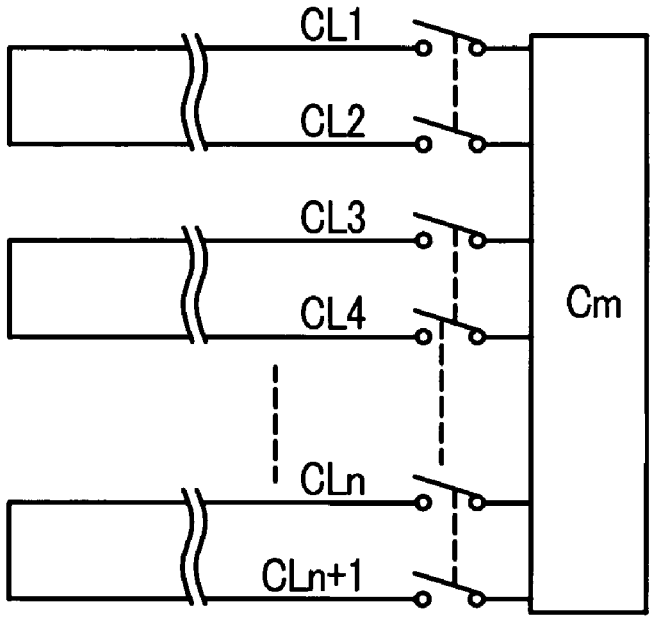

FIGS. 15A and 15B are directed to another embodiment of the liquid crystal display device according to the present invention. In FIG. 15A, a plurality of counter voltage signal lines CL to which one scanning signal to be scanned and supplied is supplied from the common electrode drive circuit Cm are formed in a loop shape.

That is, this embodiment provides a redundant structure to cope with the disconnection of the counter voltage signal lines CL. That is, even when the gate signal line GL and the counter voltage signal line CL are short-circuited, for example, by cutting the line at both sides of a short-circuited portion, a drawback attributed to the short-circuit can be eliminated and a normal state can be restored.

Further, although a plurality of counter voltage signals CL are not formed in a loop shape in FIG. 15B, by simultaneously supplying the counter voltage signals from other end sides of a plurality of counter voltage signals CL which are connected to each other at one end sides, the plurality of counter voltage signals CL are substantially configured in a loop shape in the same manner as the constitution shown in FIG. 15A and hence, the counter voltage signals CL can have substantially the same functions.

Figure 16A:
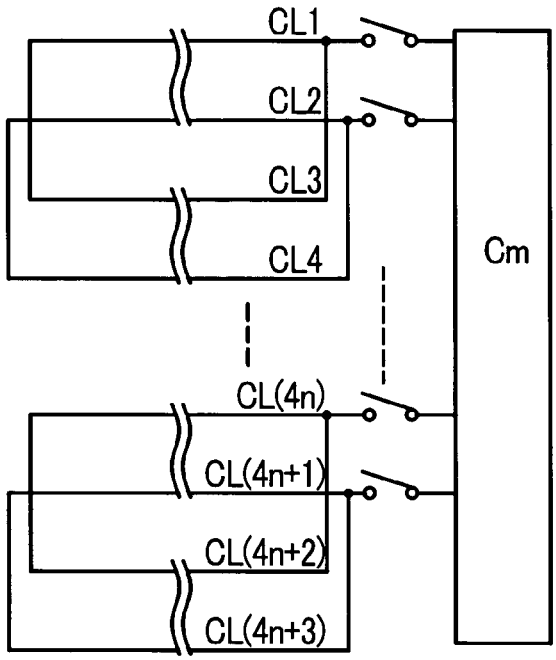
FIGS. 16A and 16B are diagrams of another embodiment of the liquid crystal display device according to the present invention showing an arrangement in which a plurality of counter voltage signal lines to which a counter voltage signal is simultaneously supplied are arranged in a telescopic manner.
Figure 16B:
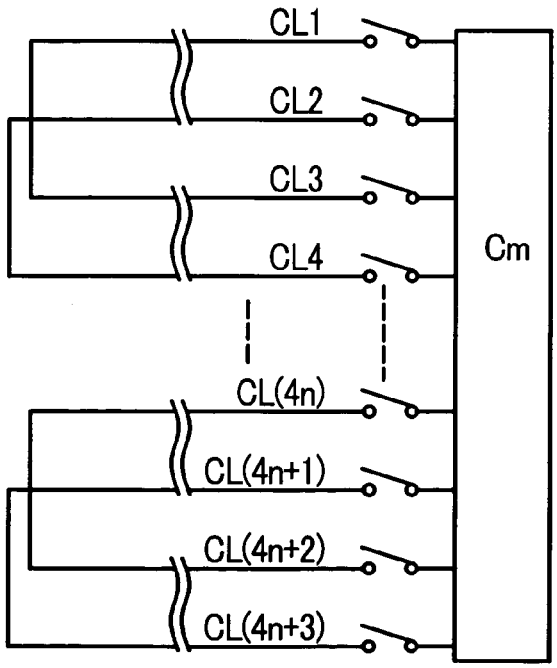

Here, in the constitution shown in FIGS. 15A and 15B, a pair of neighboring counter voltage signal lines CL is formed into a redundant structure. However, it is needless to say that, as shown in FIG. 16A and FIG. 16B, a loop shape may be formed by, for example, connecting one counter voltage signal line CL with another counter voltage signal line CL which is counted as a third counter voltage signal line from the above-mentioned one counter voltage signal line CL. That is, respective loops may be formed in a telescopic manner.

Here, FIG. 16A corresponds to FIG. 15A and FIG. 16B corresponds to FIG. 15B.

Embodiment 11

Figure 17A:
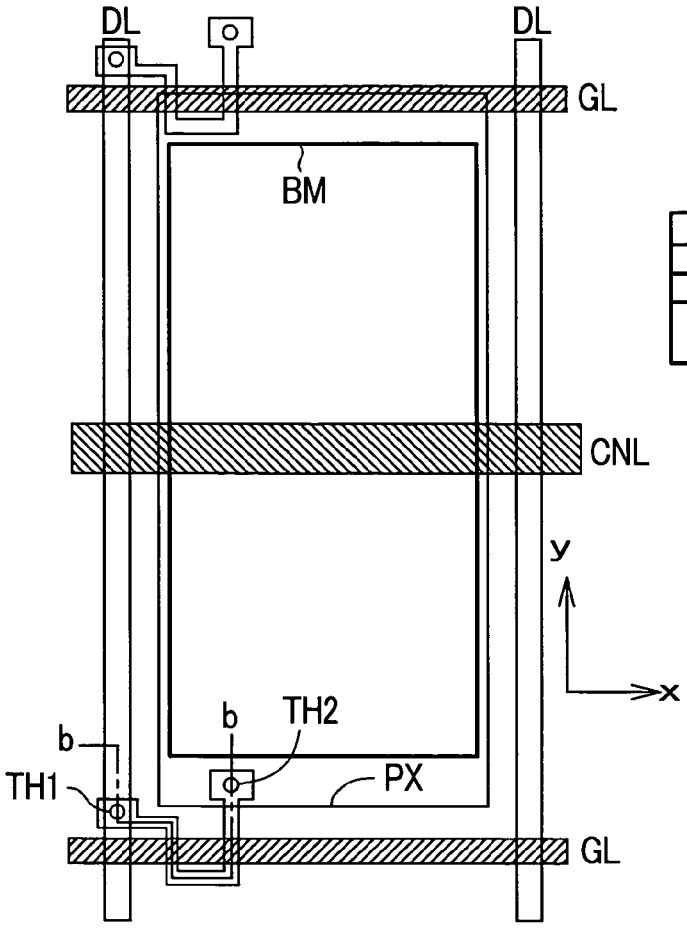
FIG. 17A is a plan view and FIG. 17B is a cross-sectional view taken alone line b-b in FIG. 17A, showing one embodiment of a pixel of the liquid crystal display device according to the present invention.
Figure 17B:
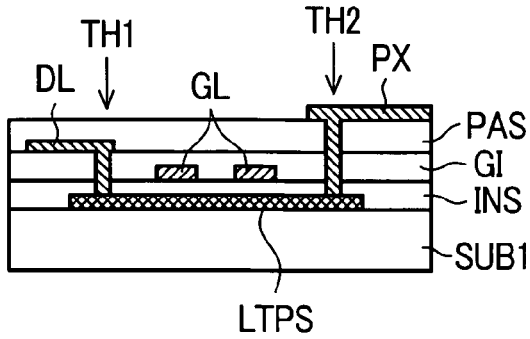

FIG. 17A is a plan view showing one embodiment of a pixel of the liquid crystal display device according to the present invention, and FIG. 17B is a cross-sectional view taken along a line b-b in FIG. 17A.

First of all, on a liquid-crystal-side surface of a transparent substrate SUB1, a semiconductor layer LTPS is formed of, for example, a polysilicon layer. This semiconductor layer LTPS is formed, for example, by polycrystallizing an amorphous Si film which is formed by a plasma CVD device using an excimer laser.

The semiconductor layer LTPS is a semiconductor layer LTPS of a thin film transistor TFT and is formed in a pattern such that the semiconductor layer LTPS runs about a gate signal line GL which will be explained later while traversing the gate signal line GL twice, for example.

Then, over the surface of the transparent substrate SUB1 on which the semiconductor layer LTPS is formed in this manner, a first insulation film INS which is formed of $SiO_2$ or SiN, for example, is formed in such a manner that the first insulation film INS also covers the semiconductor layer PS.

This first insulation film INS functions as a gate insulation film of the above-mentioned thin film transistor TFT and also functions as one of dielectric films of the capacitive element Cstg which will be explained later.

Then, on the upper surface of the first insulation film INS, the gate signal lines GL are formed, which extend in the x direction and are arranged in parallel in the y direction in the drawing. These gate signal lines GL are arranged such that the gate signal lines GL define rectangular pixel regions together with the drain signal lines DL to be described later.

The gate signal line GL runs in such a manner that the gate signal line GL traverses the above-mentioned semiconductor layer LTPS twice and the portion thereof which traverses the semiconductor layer LTPS functions as a gate electrode of the thin film transistor TFT.

Further, between the respective gate signal lines GL, a capacitive signal line CLN is formed in the same manufacturing process as the gate signal line GL, for example, in parallel with the gate signal line GL. This capacitive signal line CNL constitutes a electrode of the above-mentioned capacitive element Cstg in the pixel region.

Here, after this gate signal line GL is formed, by ion implantation of impurities via the first insulation film INS and by making the region except for the region directly below the above-mentioned gate signal line GL conductive in the above-mentioned semiconductor layer LTPS, the source region and the drain region of the thin film transistor TFT are formed.

A second insulation film GI which is formed of, for example, $SiO_2$ or SiN is formed over the above-mentioned first insulation film INS covering both of the gate signal line GL and the capacitive signal line CNL.

On the surface of this second insulation film GI, the drain signal lines DL are formed, which extend in the y direction and are arranged in parallel in the x direction. Then, a portion of this drain signal line DL is connected to the above-mentioned semiconductor layer LTPS via a through hole TH1 which passes through the second insulation film GI and the first insulation film INS below the portion. The portion of the semiconductor layer LTPS which is connected to the drain signal line DL constitutes one region of the thin film transistor TFT which becomes a drain region, for example.

Further, over the surface of the second insulation film GI covering the drain signal line DL, a third insulation film PAS is formed. This third insulation film PAS is formed of, for example, an organic material such as resin or the like, and constitutes a protective film for preventing a direct contact of liquid crystal with the thin film transistor TFT together with the second insulation film GI. The reason why the third insulation film PAS is formed of an organic material is for reducing the dielectric constant as a protective film and for flattening the surface.

Over the third insulation film PAS, pixel electrodes PX are formed. The pixel electrode is formed of a light transmitting conductive layer made of ITO (Indium Tin Oxide), ITZO (Indium Tin Zinc Oxide), IZO (Indium Zinc Oxide), $SnO_2$ (Tin Oxide), $In_2O_3$ (Indium Oxide) or the like and extends to cover the most area of the pixel region. The pixel electrode PX is configured such that an electric field is generated between the pixel electrode PX and the counter electrode (light transmitting conductive layer) which is formed in common in the pixel regions on a liquid-crystal side surface of another transparent substrate which is arranged to face one substrate with liquid crystal disposed therebetween, thus controlling the optical transmissivity of the liquid crystal. Further, the pixel electrode PX is configured such that a portion thereof is connected to another region of the thin film transistor TFT, for example, a source region via a through hole TH2 formed in a penetrating manner in the third insulation film PAS, the second insulation film GI and the first insulation film INS disposed below the portion.

This pixel electrode PX functions also as the other electrode of the capacitive element Cstg which is formed over a region which is overlapped to the capacitive signal line CNL. Here, dielectric films of the capacitive element Cstg are formed of a second insulation film GI and a third insulation film PAS.

Here, the capacitive signal line CNL replaces the counter voltage signal line CL which is shown in the above-mentioned FIG. 2. As explained in conjunction with FIG. 2, for example, a voltage signal is scanned and supplied for every line and other capacitive signal lines CNL except for the scanned line that assumes a floating state.

Due to such a constitution, the parasitic capacitances at the crossing points of the drain signal lines DL and the capacitive signal lines CNL can be drastically reduced.

Embodiment 12

Figure 18A:
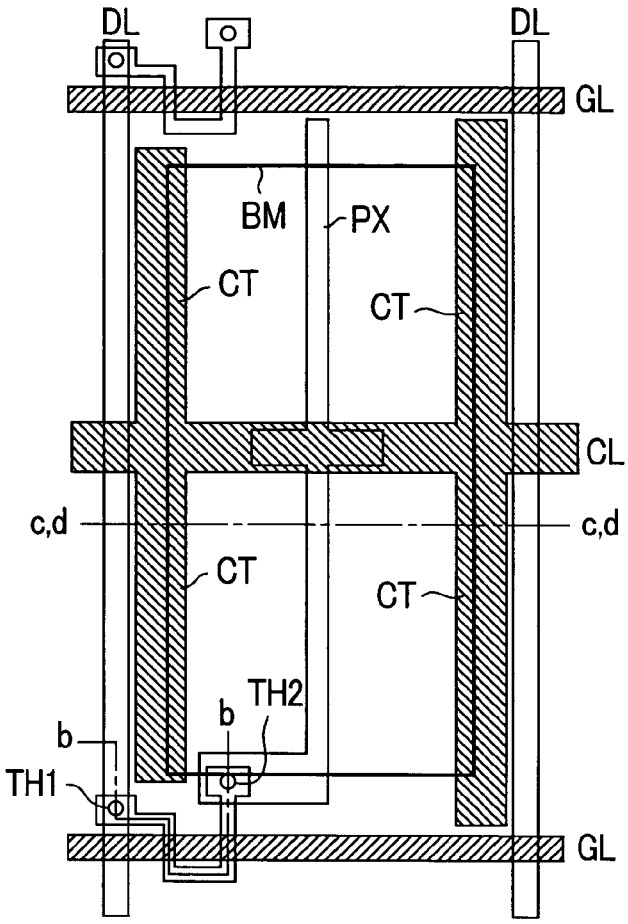
FIG. 18A is a plan view showing another embodiment of a pixel of the liquid crystal display device according to the present invention.
Figure 18B:
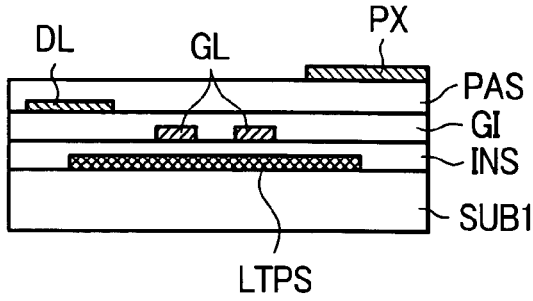
FIG. 18B is a cross-sectional view taken along line b-b and FIGS. 18C and 18D are cross-sectional views taken along lines c-c and d-d, respectively, in FIG. 18A.
Figure 18C:
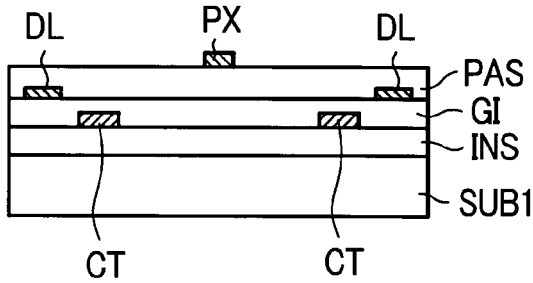

FIG. 18A is a plan view showing one embodiment of the pixel of the liquid crystal display device according to the present invention, FIG. 18B is a cross-sectional view taken along a line b-b in FIG. 18A and FIG. 18C is a cross-sectional view taken along a line c-c in FIG. 18A.

Although the constitution of this embodiment is substantially the same as the constitution of the embodiment shown in FIG. 17, the counter electrodes CT are formed on the surface side of the substrate SUB1 on which the thin film transistor TFT is formed. Further, the counter electrodes CT and the pixel electrode PX are respectively arranged in a strip pattern from one drain signal line DL side to the other drain signal line DL within the pixel region in order of the counter electrode CT, the pixel electrode PX and the counter electrode CT, for example. It is needless to say that the number of these electrodes is not specified.

An electric field which has a component substantially parallel to the surface of the transparent substrate SUB1 is generated between the pixel electrode PX and the counter electrode CT and the optical transmissivity of the liquid crystal is controlled by this electric field.

The pixel electrode PX is formed of a light transmitting conductive layer such as ITO, for example, so as to improve the numerical aperture and is arranged on the upper surface of the third insulation film PAS. Further, the pixel electrode PX is configured such that a portion thereof is connected to another region of the thin film transistor TFT, for example, a source region via a through hole TH2 which is formed in a penetrating manner in the third insulation film PAS, the second insulation film GI and the first insulation film INS disposed below the portion.

Further, the counter electrode CT is an electrode which is formed by extending the electrode in the y direction in the drawing from the counter voltage signal line CL which is formed having substantially the same constitution as the capacitive signal line CNL shown in FIG. 17. The counter electrodes CT are formed respectively close to the respective drain signal lines DL.

The counter voltage signal line CL is the counter voltage signal line CL shown in FIG. 2. As explained in conjunction with FIG. 2, for example, the counter voltage signal is scanned and supplied for every line and other counter voltage signal lines CL except for the scanned counter voltage signal line that assumes a floating state.

Due to such a constitution, the parasitic capacitances at the crossing points of the drain signal lines DL and the counter voltage signal line CL can be drastically reduced.

Figure 18D:
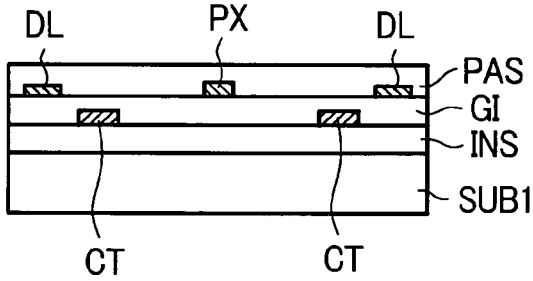

Here, in the above-mentioned embodiment, the pixel electrode PX is formed on the upper surface of the third insulation film PAS. However, it is needless to say that, as shown in FIG. 18D, the pixel electrode PX can be formed such that the pixel electrode PX is formed as a layer below the third insulation film PAS, that is, on the same layer as the drain signal line DL. In this way, substantially the same advantageous effects can be achieved.

Embodiment 13

Figure 19A:
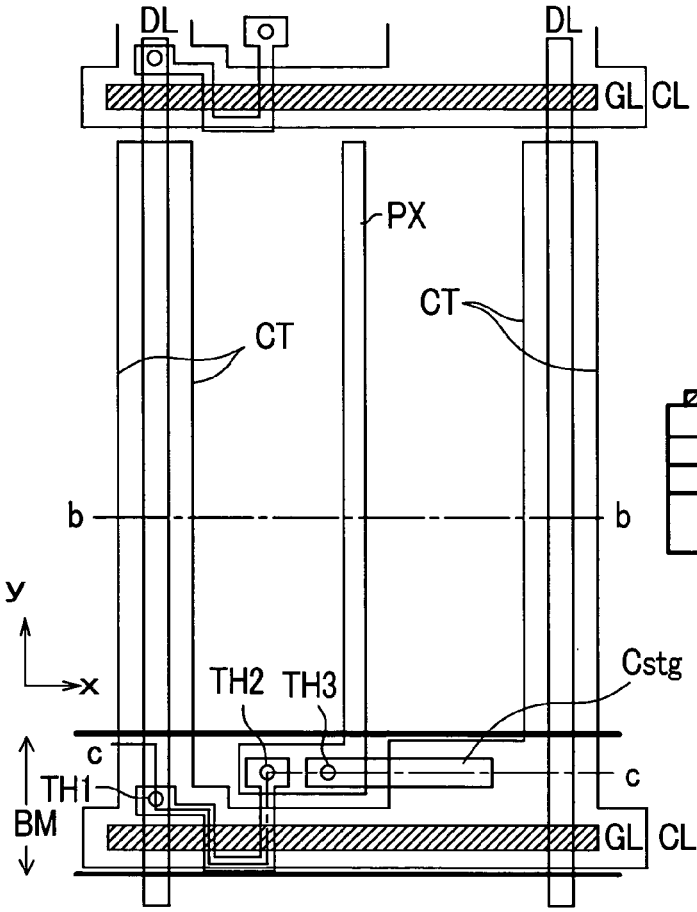
FIG. 19A is a plan view showing another embodiment of a pixel of the liquid crystal display device according to the present invention.
Figure 19B:
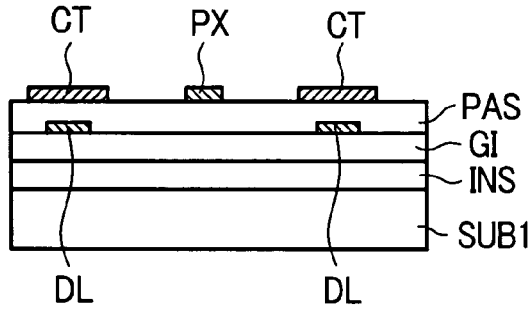
FIG. 19B is a cross-sectional view taken along line b-b and FIG. 19C is a cross-sectional view taken along line c-c in FIG. 19A.
Figure 19C:
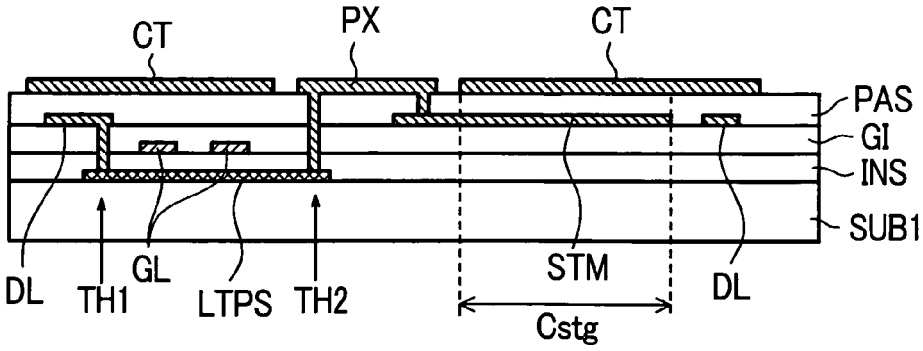

FIG. 19A is a plan view showing another embodiment of the pixel of the liquid crystal display device according to the present invention. Further, FIG. 19B is a cross-sectional view taken along a line b-b in FIG. 19A and FIG. 19C is a cross-sectional view taken along a line c-c in FIG. 19A.

The constitution which makes this embodiment different from the embodiment shown in FIG. 18A lies in the fact that, first of all, the counter electrode CT and the counter voltage signal line CL which is connected to the counter electrode CT are formed in the same layer as the pixel electrode PX which is formed on the upper surface of the third insulation film PAS.

The counter electrode CT and the counter voltage signal line CL are formed of a light transmitting conductive layer made of ITO (Indium Tin Oxide), ITZO (Indium Tin Zinc Oxide), IZO (Indium Zinc Oxide), $SnO_2$ (Tin Oxide), $In_2O_3$ (Indium Oxide) or the like, for example. Due to such a constitution, the numerical aperture of the pixel can be further enhanced.

Here, the counter voltage signal line CL is configured to be overlapped to the gate signal line GL which drives the pixel electrode, wherein a center axis of the counter voltage signal line CL is substantially aligned with a center axis of the gate signal line GL and the width of the counter voltage signal line CL is set larger than the width of the gate signal line GL. Further, the counter electrode CT is configured to be overlapped to the drain signal line DL, wherein a center axis of the counter electrode CT is substantially aligned with a center axis of the drain signal line DL and the width of the counter electrode CT is set larger than the width of the drain signal line DL. This is provided for facilitating the termination of electric lines of force from the drain signal line DL or the gate signal line GL to the counter voltage signal line CL and the counter electrode CT, while preventing the termination of the lines of electric force to the pixel electrode PX. This is due to the fact that the generation of electric line of force which reaches the electrode PX causes noises.

Further, the pixel electrode PX which is formed on the upper layer of the third insulation film PAS is pulled out via a through hole TH3 which is formed in the third insulation film PAS to a position below the third insulation film PAS. This pull-out line STM is formed in an overlapped manner on a portion of the counter voltage signal line CL formed on the upper layer of the third insulation film PAS in the same manner as the pixel electrode PX. This is provided for generating the capacitive element Cstg at the overlapped portion.

Further, in such a constitution, other neighboring counter voltage signal lines CL which are different from the counter voltage signal line CL formed in an overlapped manner on the gate signal line GL which drives the pixel electrode and the counter electrode CT of the pixel are separated from each other, that is, are electrically disconnected. That is, the counter voltage signal line CL which is used in common with the pixel row arranged in parallel in the x direction in the drawing is formed electrically separated from the other counter voltage signal line CL which is in common with the pixel row also arranged in parallel in the x direction in the drawing.

As explained in conjunction with the embodiment shown in FIG. 2, this is provided for scanning and supplying the counter voltage signal to the respective counter voltage signal line CL for every counter voltage signal line CL.

Here, for making the counter electrode CT of the pixel sufficiently perform functions thereof, the separation of the counter voltage signal line CL from the above-mentioned other counter voltage signal line CL is performed in the vicinity of the other counter voltage signal line CL.

In the previously-mentioned embodiments, the third insulation film PAS is formed of an organic material layer such as resin or the like. As mentioned above, this selection is made for reducing the dielectric constant as a protective film. That is, by reducing the dielectric constant of the protective film, it is possible to obtain the advantageous effect that the parasitic capacitance at the crossing portion of the drain signal line DL and the counter voltage signal line CL can be reduced.

However, the counter voltage signal to the counter voltage signal line CL is scanned and supplied for every counter voltage signal line CL and, at the same time, the other counter voltage signal lines CL are made to assume a floating state and hence, the parasitic capacitance of the crossing point of the drain signal line DL and the counter voltage signal line CL can be drastically reduced.

Accordingly, it is possible to achieve the advantageous effect that the protective film can be formed only of the second insulation film GI (inorganic material layer) without forming the third insulation film PAS. Due to such a constitution, it is no longer necessary to form an organic film and hence, it is possible to realize a simplification of the manufacturing process and a reduction of the cost. Further, the yield rate can be enhanced.

Further, the above-mentioned embodiment is directed to a constitution in which the counter voltage signal line CL which is provided in common with the pixel row arranged in parallel in the x direction in the drawing is electrically separated from another neighboring counter voltage signal line CL which is provided in common with the pixel row which is also arranged in parallel in the x direction in the drawing.

However, it is needless to say that, for example, as shown in FIG. 15A to FIG. 16B, when a plurality of counter voltage signal lines CL are connected in a loop shape, or when substantially the same function is provided to the counter voltage signal lines CL, it is unnecessary to electrically separate the plurality of counter voltage signal lines CL at the connecting portions.

Embodiment 14

Figure 20A:
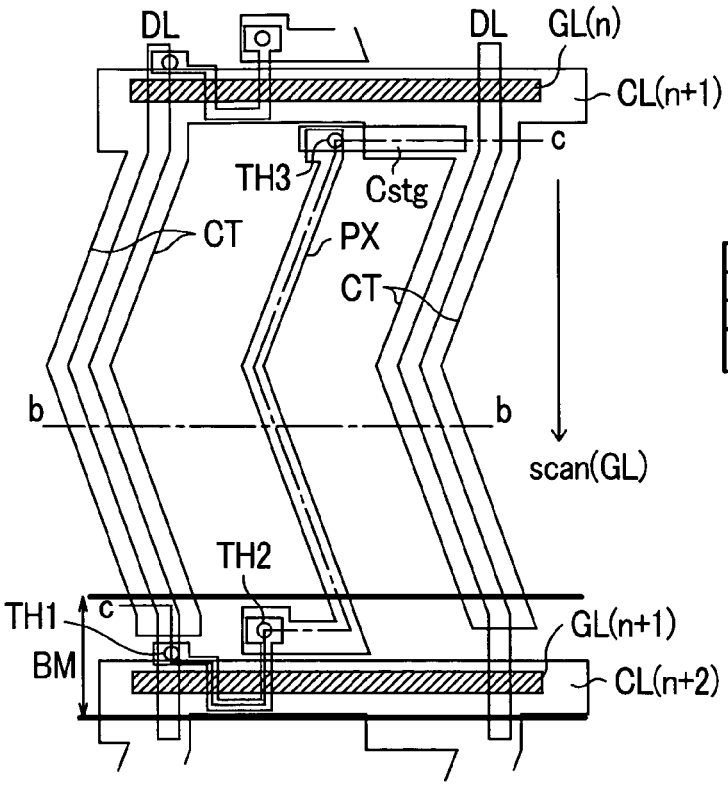
FIG. 20A is a plan view showing another embodiment of a pixel of the liquid crystal display device according to the present invention.
Figure 20B:
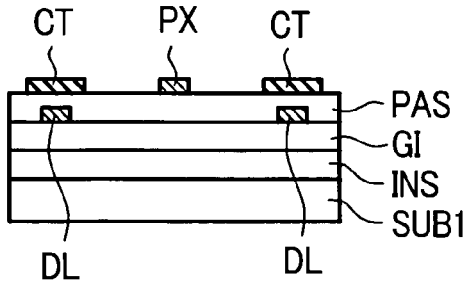
FIG. 20B is a cross-sectional view taken along line b-b and FIG. 20C is a cross-sectional view taken along line c-c in FIG. 20A.

FIG. 20A is a plan view showing another embodiment of the pixel of the liquid crystal display device according to the present invention. Further, FIG. 20B is a cross-sectional view taken along a line b-b in FIG. 20A and FIG. 20C is a cross-sectional view taken along a line c-c in FIG. 20A.

The constitution which makes this embodiment different from the embodiment shown in FIG. 19A lies in the fact that, first of all, a counter voltage signal line CL(n+2) which is formed in an overlapped state over a gate signal line GL(n+1) which drives the pixel is connected with a counter electrode CT in a pixel at a lower side of the drawing and is electrically separated from the counter electrode CT of the pixel. In other words, the counter electrode CT of the pixel is configured such that the counter electrode CT of the pixel is connected to the counter voltage signal line CL(n+1) which is formed in an overlapped state over the gate signal line GL(n) which drives the upper-side pixel in the pixel.

Further, a capacitive element Cstg of the pixel is formed between the pixel electrode PX of the pixel and the counter voltage signal line CL(n+1) which is formed in an overlapped manner over the gate signal line (n) for driving the upper-side pixel of the pixel.

Figure 20D:
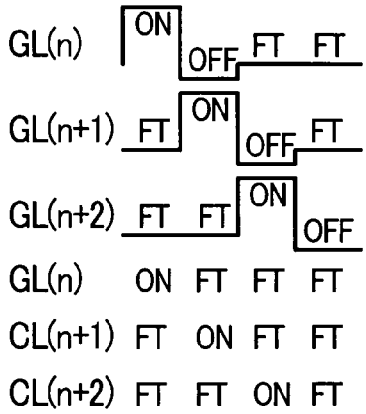
Figure 20C:
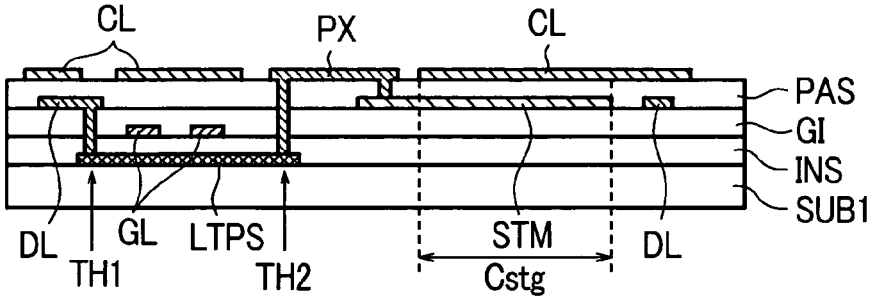

In this case, as shown in FIG. 20C, the capacitive element Cstg is formed between a lead line STM which is pulled out as a layer below a third insulation film PAS via a through hole TH3 formed in the third insulation film PAS and the counter voltage signal line CL(n+1) using the third insulation film PAS as a dielectric film.

Here, the scanning direction in respective gate signal lines GL is from the upper side to the lower side in the drawing, that is, from the gate signal line GL(n) to the gate signal line GL(n+1).

That is, when the scanning signal is supplied to the gate signal line GL(n+1) of the pixel (the gate signal line GL(n+1) being in an ON state), the counter voltage signal line CL(n+1) which is overlapped to the gate signal line GL(n+1) assumes a floating state and hence, to the counter electrode CT of the pixel, the counter voltage signal is supplied from the counter voltage signal line CL(n+1) which is overlapped to the gate signal line GL(n) for driving the upper-side pixel of the pixel.

In the above-mentioned constitution, FIG. 20D is a diagram showing an ON state (ON), an OFF state (OFF) and a floating state (FT) of the neighboring gate signal lines GL(n), GL(n+1), GL(n+2) and the neighboring counter voltage signal lines CL(n), CL(n+1), CL(n+2) along with time. As can be clearly understood from the drawing, when the scanning signal is supplied to the gate signal lines GL (the ON state) covering the whole pixels of the liquid crystal display part AR, the counter voltage signal lines CL which are overlapped to the gate signal lines GL assume the floating state.

Accordingly, the parasitic capacitance between the gate signal line GL and the counter voltage signal line CL can be largely reduced whereby lowering of the writing efficiency can be obviated.

Here, as opposed to the constitution shown in FIG. 19A, the constitution shown in FIG. 20A is configured such that the drain signal lines DL, the counter electrodes CT and the pixel electrode PX are respectively bent at the center of the pixel. The reason for adopting such a constitution is as follows. That is, even when the liquid crystal has the same molecular arrangement, the polarization state of the transmitting light is changed in response to the incident direction of light on the liquid crystal display panel and the optical transmissivity differs corresponding to the incident direction. In view of the above phenomenon, by making the electric field applied between the respective electrodes different from each other in one region and another region which are divided using an imaginary line connecting bent points of respective electrodes, it is possible to compensate for coloring of images attributed to the viewing angle. Such a constitution is applicable to above-mentioned respective pixels or other pixels to be described later.

Embodiment 15

Figure 21A:
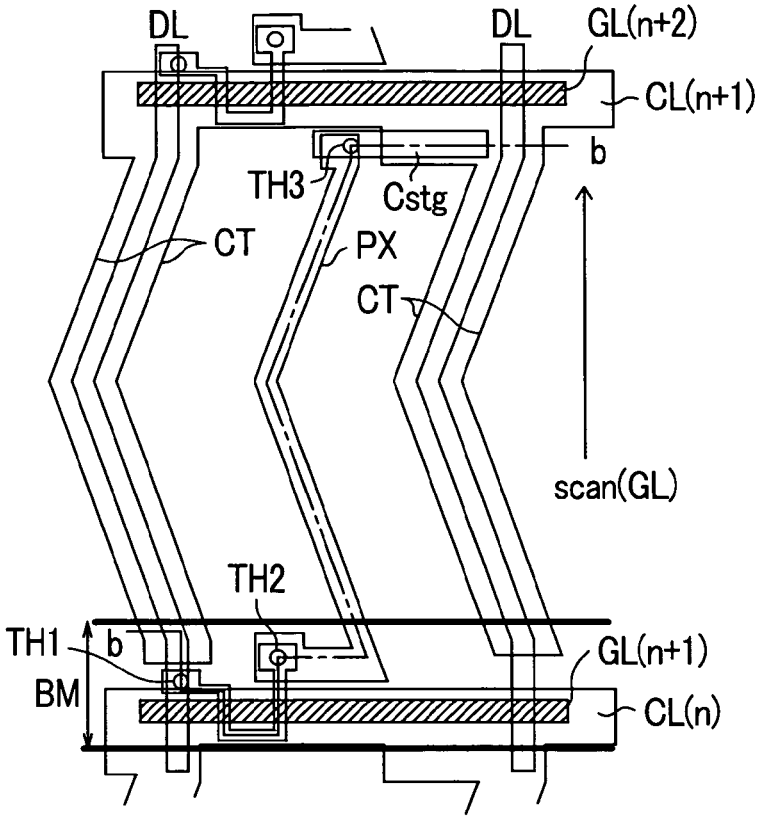
FIG. 21A is a plan view showing another embodiment of a pixel of the liquid crystal display device according to the present invention.

FIG. 21A is a plan view showing another embodiment of the pixel of the liquid crystal display device according to the present invention. Further, FIG. 21B is a cross-sectional views taken along a line b-b in FIG. 21A.

The constitution which makes this embodiment different from the embodiment shown in FIG. 20A only lies in the fact that the scanning direction of the gate signal lines GL is different. That is, the gate signal lines GL are driven from the lower-side pixel to the upper-side pixel in the drawing. Accordingly, in naming the neighboring gate signal lines GL(*) and the neighboring counter voltage signal lines CL(*), they are denoted by replacing the (*) portions.

Figure 21C:
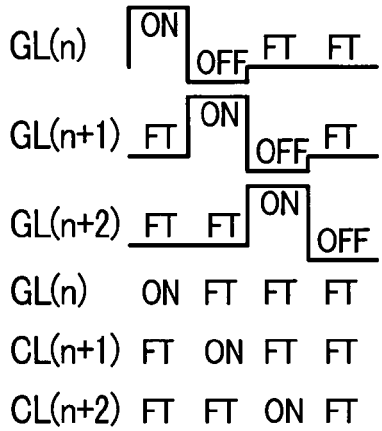
FIG. 21B is a cross-sectional view taken along line b-b and FIG. 21C is a cross-sectional view taken along line c-c in FIG. 21A.
Figure 21B:
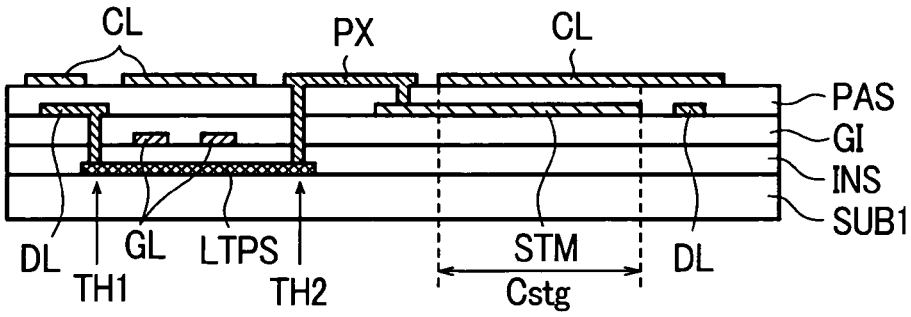

Further, FIG. 21C is a diagram showing an ON state (ON), an OFF state (OFF) and a floating state (FT) of the neighboring gate signal lines GL(n), GL(n+1), GL(n+2) and the neighboring counter voltage signal lines CL(n), CL(n+1), CL(n+2) along with time.

Also in this embodiment, when the scanning signal is supplied to the gate signal line GL (n+1) which drives the pixel (the ON state), the counter voltage signal line CL which is overlapped to the gate signal line GL(n+1) assumes the floating state and hence, the parasitic capacitance between the gate signal line GL (n+1) and the counter voltage signal line CL(n) can be largely reduced.

Further, even in a stage in which the gate signal line GL(n+1) is shifted from the ON state to the OFF state, it is possible to make the counter voltage signal line CL(n) assume the floating state.

Accordingly, it is possible to make the gate signal line GL assume the floating state during a period corresponding to two continuous lines for writing ON and OFF to the thin film transistor TFT and hence, the OFF characteristics of the thin film transistor TFT can be enhanced.

Embodiment 16

Figure 22A:
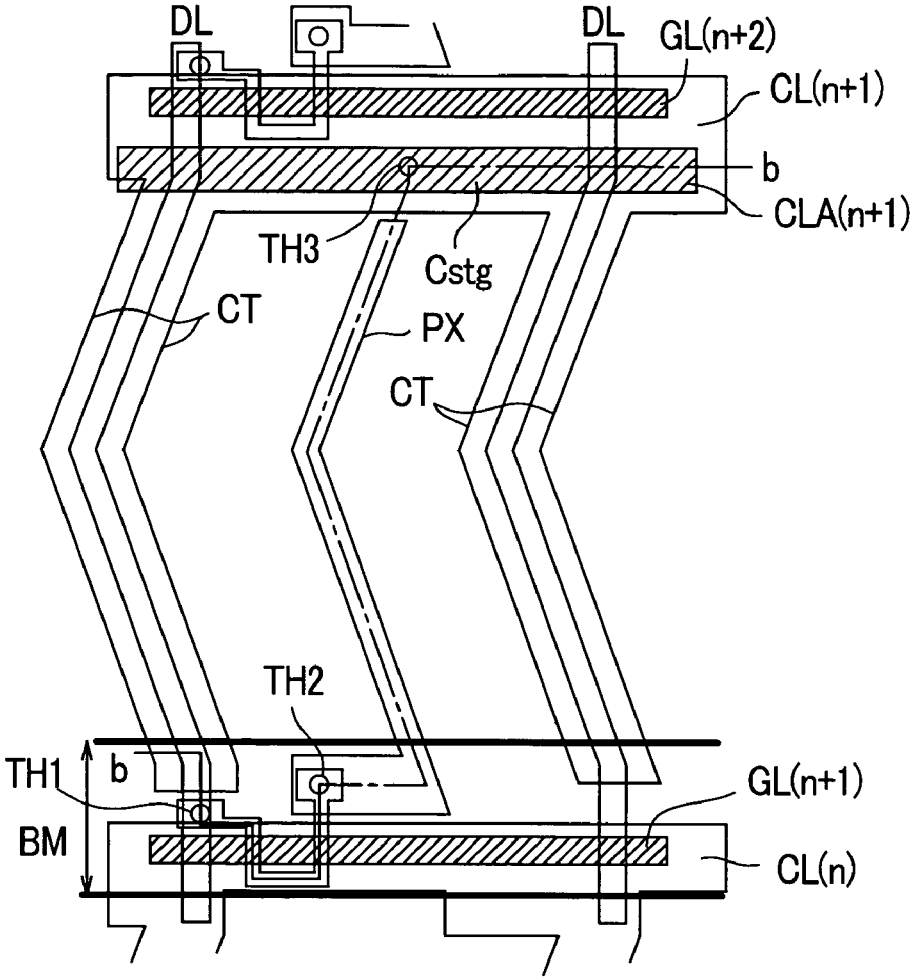
FIG. 22A is a plan view showing another embodiment of a pixel of the liquid crystal display device according to the present invention.
Figure 22B:
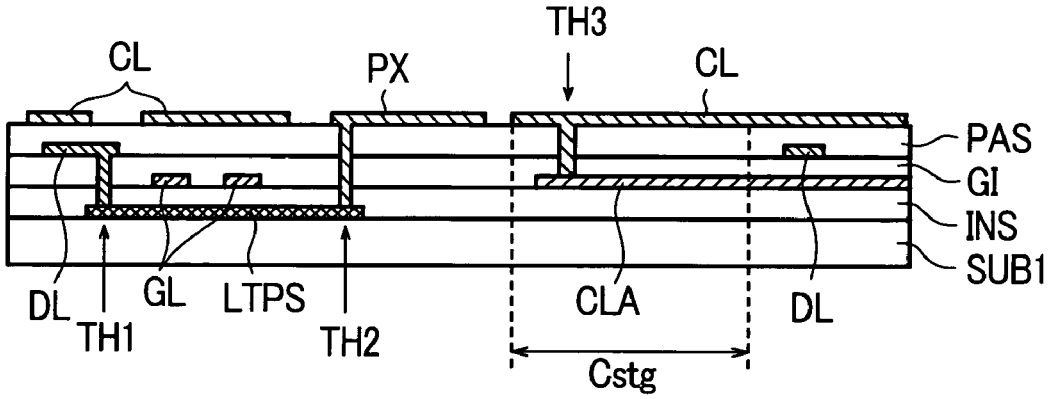
FIG. 22B is a cross-sectional view taken along line b-b in FIG. 22A.

FIG. 22A is a plan view showing another embodiment of the pixel of the liquid crystal display device according to the present invention. Further, FIG. 22B is a cross-sectional views taken along a line b-b in FIG. 22A.

The constitution which makes this embodiment different from the embodiment shown in FIG. 21A lies in the fact that an auxiliary wiring layer CLA(n+1) is formed in the same step for forming the gate signal line GL, for example, such that the auxiliary wiring layer CLA(n+1) is arranged close to another gate signal line GL(n+2) which is adjacent to the gate signal line GL(n+1) for driving the pixel. Due to such a constitution, the auxiliary wiring layer CLA(n+1) can be made of a material equal to a material of the gate signal line GL and hence, the resistance can be set to a low value.

Above the auxiliary wiring layer CLA(n+1), the counter voltage signal line CL(n+1) is formed in an overlapped manner together with the above-mentioned gate signal line GL(n+2). Portions of the auxiliary wiring layers CLA(n+1) are connected to each other via through holes TH3 formed in the third insulation film PAS and the second insulation film GI in a penetrating manner.

The reason why the counter voltage signal line CL(n+1) is formed such that the counter voltage signal line CL(n+1) also covers the auxiliary wiring layers CLA(n+1) is to impart a shielding function to the counter voltage signal line CL(n+1).

The counter voltage signal line CL and the counter electrode CT which is integrally formed with the counter voltage signal line CL are formed of a light transmitting conductive layer made of a material such as ITO (Indium Tin Oxide), ITZO (Indium Tin Zinc Oxide), IZO (Indium Zinc Oxide), $SnO_2$ (tin oxide), $In_2O_3$ (indium oxide), for example.

Such a light transmitting conductive layer can, although the wiring resistance is increased compared to other metal layer or the like, obviate such a drawback with the use of the auxiliary wiring layer CLA. Accordingly, it is possible to reduce the rounding of a waveform of the counter voltage signal supplied to the counter voltage signal line CL whereby the luminance difference which is generated between the counter-voltage-signal supply side and the side opposite to the supply side can be prevented.

This embodiment is not limited to the constitution shown in FIG. 22A and is applicable to all cases in which the counter voltage signal line CL is integrally formed with the counter electrode CT and uses the light transmitting conductive layer is used as the material thereof.

Embodiment 17

Figure 23A:
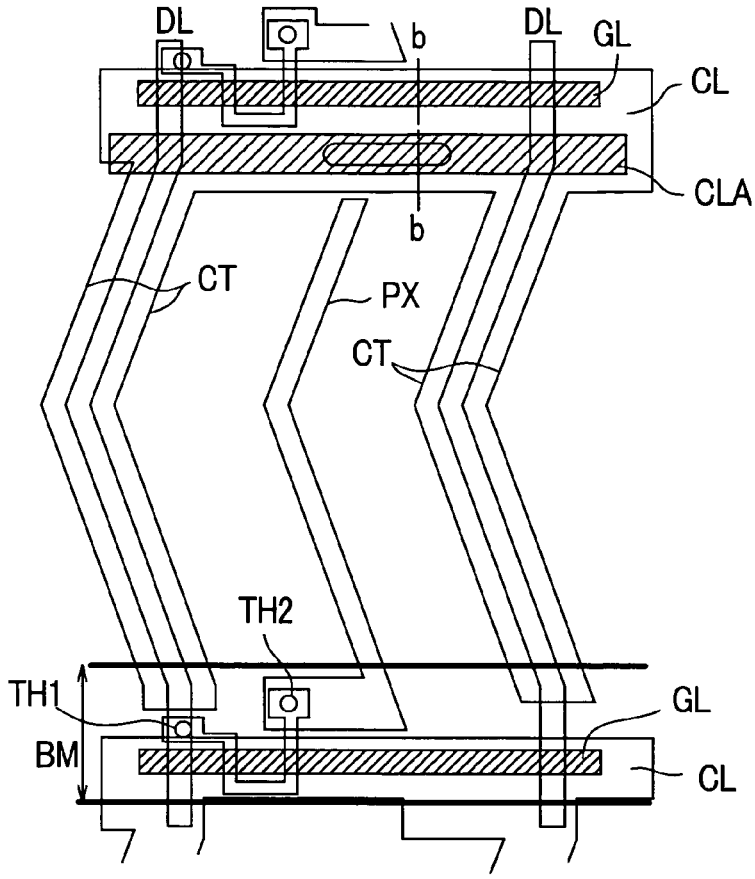
FIG. 23A is a plan view showing another embodiment of a pixel of the liquid crystal display device according to the present invention.

FIG. 23A is a plan view showing another embodiment of the pixel of the liquid crystal display device according to the present invention. Further, FIG. 23B, FIG. 23C are cross-sectional views taken along a line b-b in FIG. 23A.

A portion which makes this embodiment different from the embodiment shown in FIG. 22A lies in the fact that the connection between an auxiliary wiring layer CLA and a counter voltage signal line CL which is arranged to be overlapped with the auxiliary wiring layer CLA is performed by capacitive coupling.

Figure 23B:
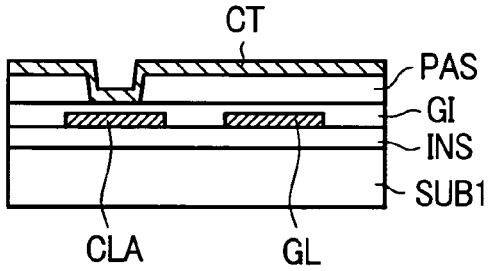
FIG. 23B is a cross-sectional view taken along line b-b and FIG. 23C is a cross-sectional view taken along line c-c in FIG. 23A.

For example, as shown in FIG. 23B, an opening (or a recessed portion) is formed in a third insulation film PAS at a portion where the capacitive coupling is produced with the auxiliary wiring layer CLA and the counter voltage signal line CL is formed in such a manner that the counter voltage signal line CL covers the opening. At the portion where the capacitive coupling is to be produced, a second insulation film GI having a relatively thin film thickness is formed between the auxiliary wiring layer CLA and the counter voltage signal line CL whereby the capacitive coupling is provided between the auxiliary wiring layer and the counter voltage signal line CL.

Figure 23C:
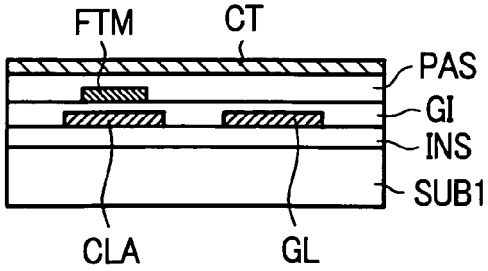

Further, FIG. 23C is a view showing another embodiment of the portion shown in FIG. 23B. As shown in the drawing, at a portion where the capacitive coupling between he auxiliary wiring layer CLA and the counter voltage signal line CL is to be produced, a metal layer FTM in a floating state may be formed between the second insulation film GI and the third insulation film PAS.

Embodiment 18

Figure 24:
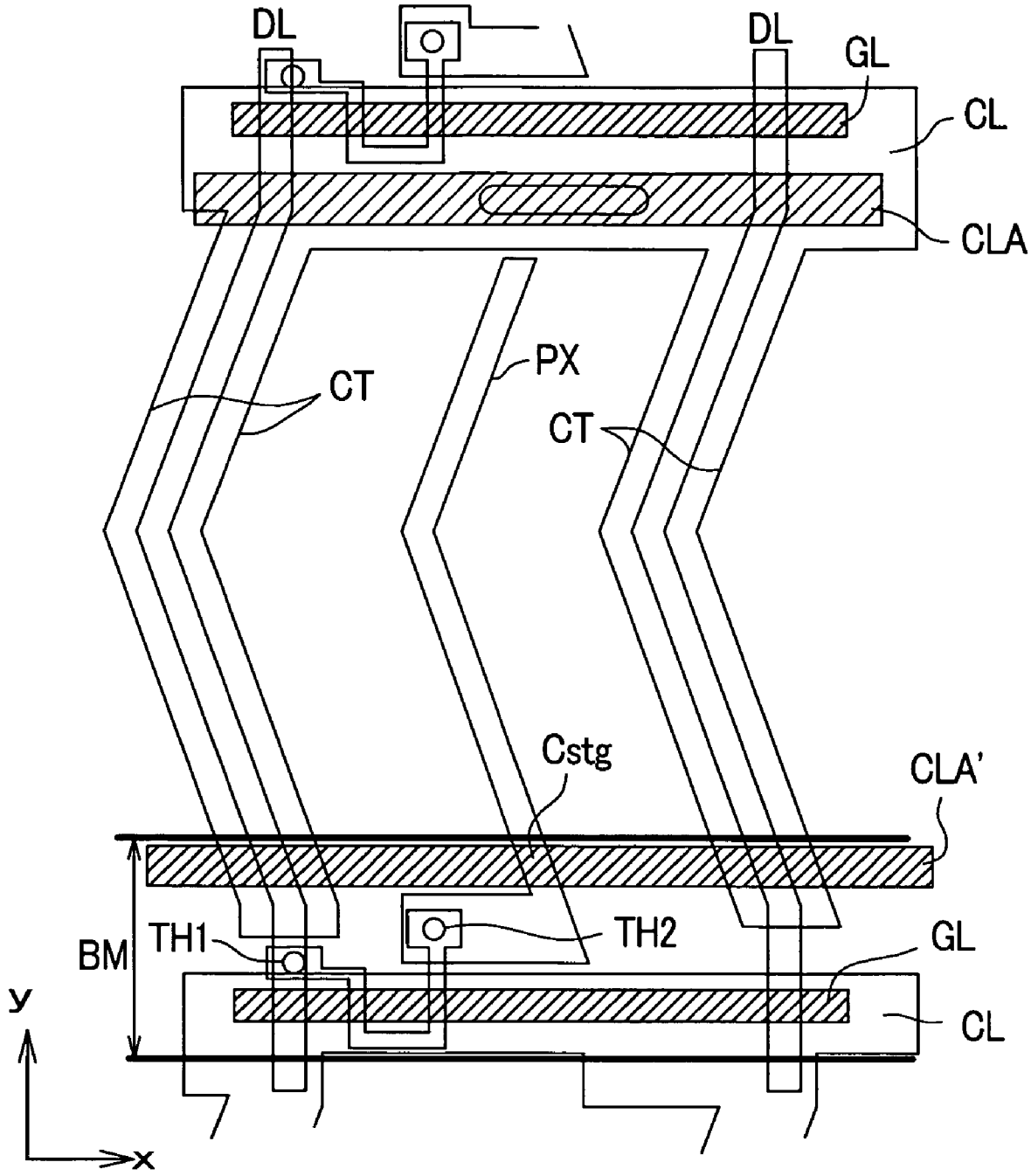
FIG. 24 is a plan view showing another embodiment of a pixel of the liquid crystal display device according to the present invention.

FIG. 24 is a plan view showing another embodiment of the pixel of the liquid crystal display device according to the present invention.

The constitution which makes this embodiment different from the embodiment shown in FIG. 23A lies in the fact that a second auxiliary wiring layer CLA' is formed such that the second auxiliary wiring layer CLA' is arranged close to a gate signal line GL which drives the pixel and crosses a pixel electrode PX and counter electrodes CT, while the second auxiliary wiring layer CLA' is not covered with a counter voltage signal line CL which is arranged to be overlapped to the gate signal line GL.

Here, the second auxiliary wiring layer CLA' is configured to be formed simultaneously with the formation of the above-mentioned gate signal line GL, for example.

Further, the above-mentioned second auxiliary wiring layer CLA' which is provided in common with respect to the pixel row arranged in the x direction in the drawing and the second auxiliary wiring layer CLA' which is provided in common in another similar pixel row in regions outside the liquid crystal display region such that they are configured to perform electrically the same function.

Accordingly, at a region where the second auxiliary wiring layer CLA' and the pixel electrode PX cross each other, a capacitive element Cstg may be formed. Further, by forming crossing portions between the second auxiliary wiring layer CLA' and the counter electrodes CT, it is possible to make respective potentials at the second auxiliary wiring layer CLA' and the counter electrodes CT stable.

Embodiment 19

Figure 25A:
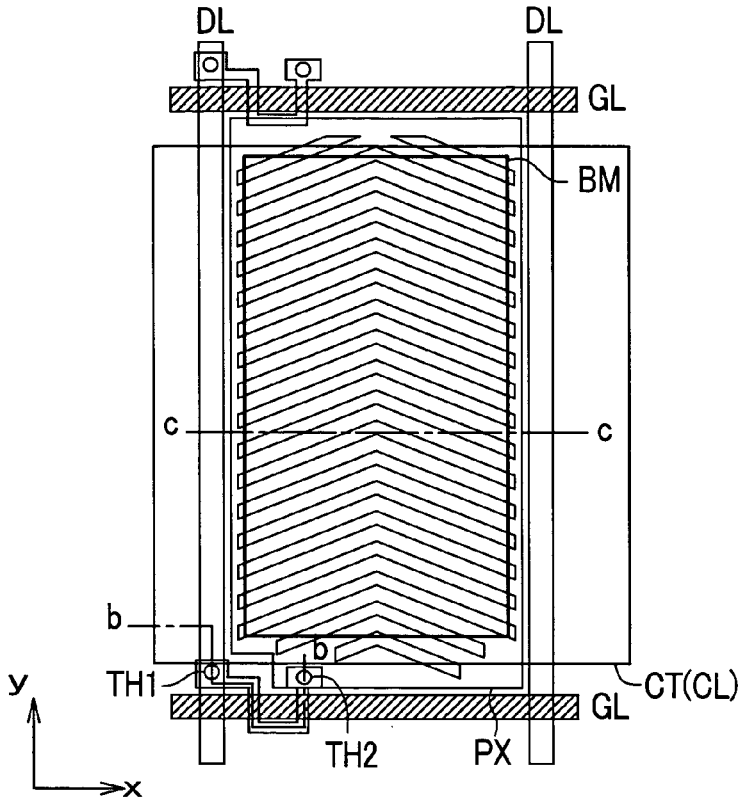
FIG. 25A is a plan view showing another embodiment of a pixel of the liquid crystal display device according to the present invention.
Figure 25B:
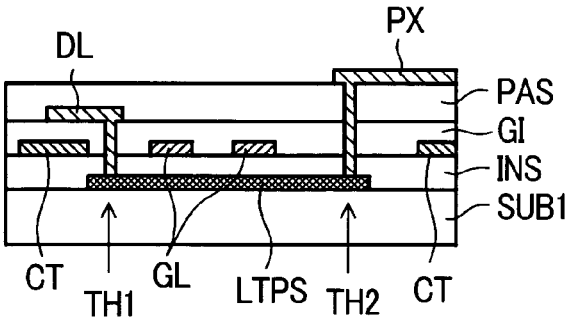
FIG. 25B is a cross-sectional view taken along line b-b and FIGS. 25C and 25D are cross-sectional views taken along line cc in FIG. 25A.
Figure 25D:
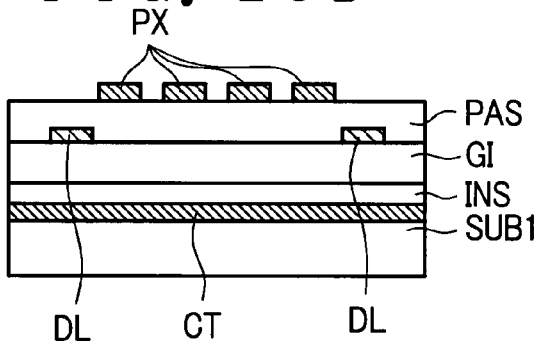
Figure 25C:
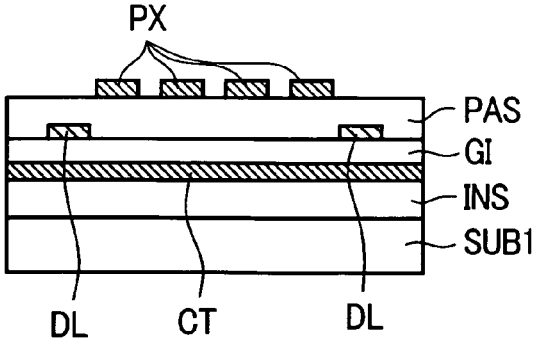

FIG. 25A is a plan view showing one embodiment of the pixel of the liquid crystal display device according to the present invention. Further, FIG. 25B is a cross-sectional view taken along a line b-b in FIG. 25A and FIG. 25C is a cross-sectional view taken along a line c-c in FIG. 25A.

This embodiment differs from the embodiment shown in FIG. 18A in the pattern of pixel electrodes PX and counter electrodes CT, and the other constitutions are substantially the same as the constitutions shown in FIG. 18A.

First of all, the counter electrodes CT are formed over an upper surface of a first insulation film INS, wherein the counter electrode CT is formed substantially over the whole area of the pixel region and is connected to the counter electrode CT in another neighboring pixel region in the x direction. In other words, in respective pixel regions which are arranged in parallel in the x direction, the counter electrodes CT are continuously formed and, at the same time, they are formed so as to be electrically separated from the counter electrode CT of other neighboring pixels in the y direction.

The counter electrode CT also has a function of a counter voltage signal line CL and is formed of a light transmitting conductive layer made of a material such as ITO (Indium Tin Oxide), ITZO (Indium Tin Zinc Oxide), IZO (Indium Zinc Oxide), $SnO_2$ (tin oxide), $In_2O_3$ (indium oxide), for example.

Further, the pixel electrode PX is formed over an upper surface of a third insulation film PAS at a most center region in each pixel region except for a periphery of the pixel region. The pixel electrode PX is also formed of a light transmitting conductive layer made of a material such as ITO (Indium Tin Oxide), ITZO (Indium Tin Zinc Oxide), IZO (Indium Zinc Oxide), $SnO_2$ (tin oxide), $In_2O_3$ (yttrium oxide), for example.

Then, in the pixel electrode PX, openings each having an V-shape with a peak portion at a center portion of the pixel region, for example, are arranged in parallel in the y direction in the drawing.

The pixel having such a constitution can generate an electric field having a component substantially parallel to a surface of the transparent substrate SUB1 between the pixel electrode PX and the counter electrode CT whereby the numerical aperture can be enhanced.

Further, in the above-mentioned explanation, it is indicated that the counter electrode CT is formed over the upper surface of the first insulation film INS. However, it is needless to say that, as shown in FIG. 25C, for example, it is possible to form the counter electrode CT over the surface of the transparent substrate SUB1.

Here, the reason why the above-mentioned pattern of the openings formed in the pixel electrode PX is adopted is that by forming regions which differ in the direction of the electric field between the pixel electrode PX and the counter electrode CT it is possible to compensate the coloring of the images attributed to the viewing angle.

Figure 26A:
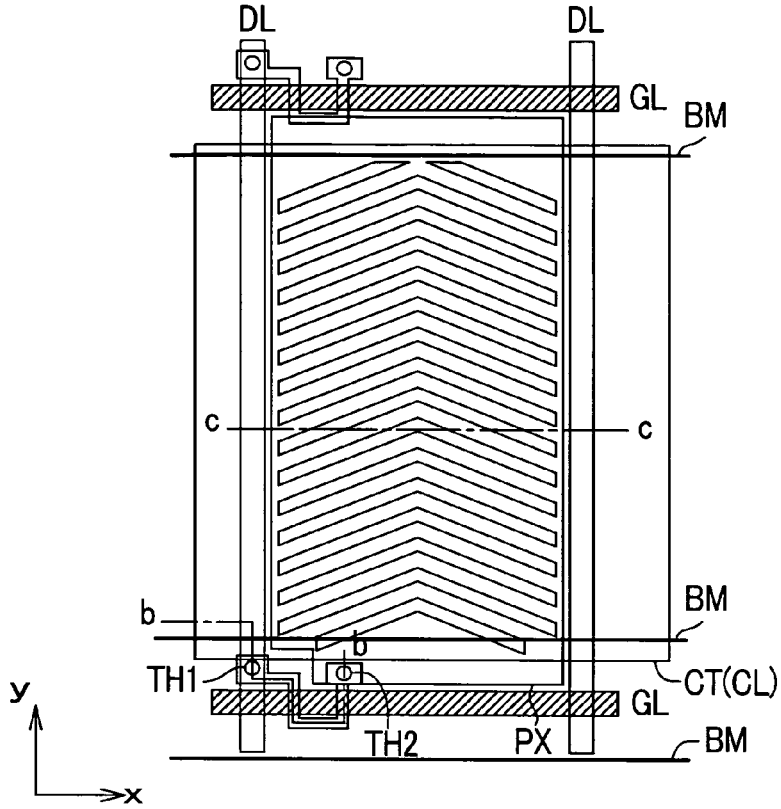
FIG. 26A is a plan view showing another embodiment of a pixel of the liquid crystal display device according to the present invention.
Figure 26B:
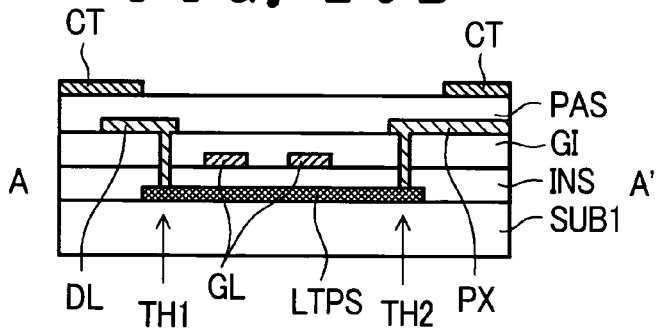
FIG. 26B is a cross-sectional view taken along line b-b and FIG. 26C is a cross-sectional view taken along line c-c in FIG. 26A.
Figure 26C:
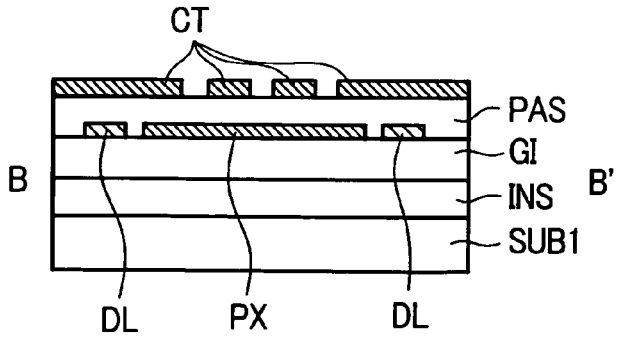

FIG. 26A is a plan view showing another embodiment of the pixel of the liquid crystal display device according to the present invention. Further, FIG. 26B is a cross-sectional view taken along a line b-b in FIG. 26A and FIG. 26C is a cross-sectional view taken along a line c-c in FIG. 26A.

This embodiment is different from the embodiment shown in FIG. 25A with respect to the constitutions of the pixel electrode PX and the counter electrode CT. That is, the pixel electrode PX is formed over a surface of a second insulation film GI and is formed over most of a center area in the pixel region except for the periphery thereof. The pixel electrode PX is formed of a light transmitting conductive layer made of the above-mentioned material.

On the other hand, the counter electrode CT is formed over substantially the whole area of the pixel region and is also connected to the counter electrode CT in another neighboring pixel region in the x direction thus also having a function of a counter voltage signal line CL. In the same manner as the embodiment shown in FIG. 25A, the pixel electrode PX is electrically separated from the counter electrode CT in the neighboring pixel region in the y direction. As the material of the counter electrode CT, in the same manner as the embodiment shown in FIG. 25A, the counter electrode CT is formed of a light transmitting conductive layer.

In each pixel region corresponding to the counter electrode CT, openings in a herringbone pattern each having an V-shape with a peak portion at a center portion of the pixel region, for example, are arranged in parallel in the y direction in the drawing. Also with the provision of the pixels having such a constitution, it is possible to provide functions similar to those obtained by the constitution shown in FIG. 25A.

Embodiment 20

Figure 27A:
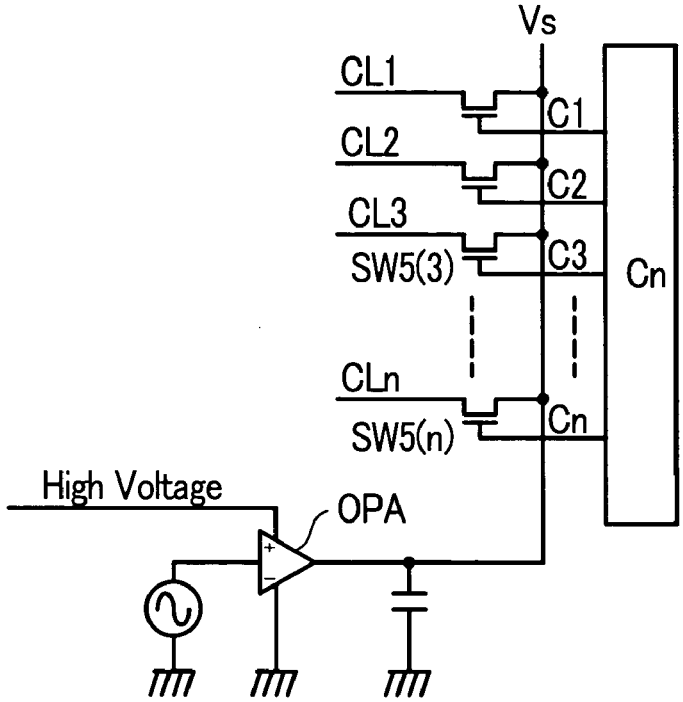
FIG. 27A is a schematic circuit diagram another embodiment of the liquid crystal display device according to the present invention showing a common electrode drive circuit.

FIG. 27A is a circuit diagram showing another embodiment of a connecting portion between the above-mentioned common electrode drive circuit Cm and the above-mentioned respective counter voltage signal lines CL.

The constitution which makes this embodiment different from the embodiment shown in FIG. 4 lies in the fact that the counter voltage signal Vc which is supplied to the counter voltage signal lines CL through switches SW5(*n*) which are turned on in response to a signal from the common electrode drive circuit Cm is supplied from an operational amplifier OPA.

The operational amplifier OPA performs so-called "boosting" of an AC voltage waveform supplied to the operational amplifier OPA and uses this boosted signal as the counter voltage signal Vc. This boosting makes use of, for example, an overshooting phenomenon which occurs with respect to an operational amplifier or a transistor thereof, wherein by properly setting a circuit constant, the counter voltage signal Vc shown in FIG. 27B is obtained.

Figure 27B:
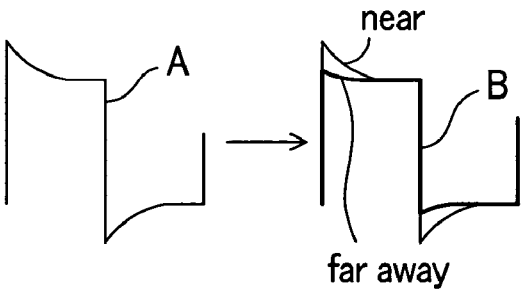
FIGS. 27B and 27C are waveform diagrams.

In FIG. 27B, a waveform A at the left side of the drawing indicates the counter voltage signal obtained through the above-mentioned operational amplifier OPA, while a waveform B at the right side of the drawing indicates the counter voltage signal when the counter voltage signal is supplied to the counter voltage signal lines CL. The drawing shows that waveform distortion is generated from a side near to the supply end to a side far away from the supply side. As can be clearly understood from this drawing, the counter voltage signal which receives the waveform distortion at the side far away from the supply side of the counter voltage signal lines CL can sufficiently maintain a square waveform.

By adopting such a constitution, the signal is selectively supplied to the respective counter voltage signal lines CL, compared to the conventional method which drives all counter voltage signal lines CL simultaneously, a load can be drastically reduced to a several hundredth and hence, it is possible to perform the above-mentioned correction of waveform using only a simple circuit formed of the operational amplifier OPA or the transistors thereof. Further, due to the small load, it is also possible to sufficiently exhibit advantageous effects of correction. Still further, the parts which are used in the correction circuit, since the load is drastically small, can be inexpensive parts which exhibit low current resistance. Still further, since the current which flows in the circuit can be reduced to a several hundredth ideally, the liquid crystal display device can realize the long lifetime through enhancement of the reliability.

Figure 27C:
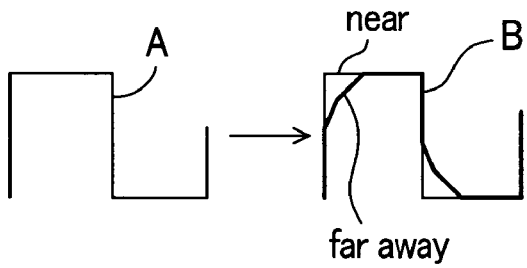

Here, in FIG. 27C, in the conventional method which simultaneously drives all counter voltage signal lines CL, a waveform A at the left side of the drawing indicates the counter voltage signal and a waveform B at the right side of the drawing indicates the counter voltage signal when the counter voltage signal is supplied to the counter voltage signal lines CL. The waveform distortion is generated from a side near to the supply end to a side far away from the supply side as shown in the drawing. As can be understood from this drawing, the counter voltage signal cannot maintain a square waveform at the side far away from the supply side of the counter voltage signal lines CL.

Embodiment 21

Figure 28A:
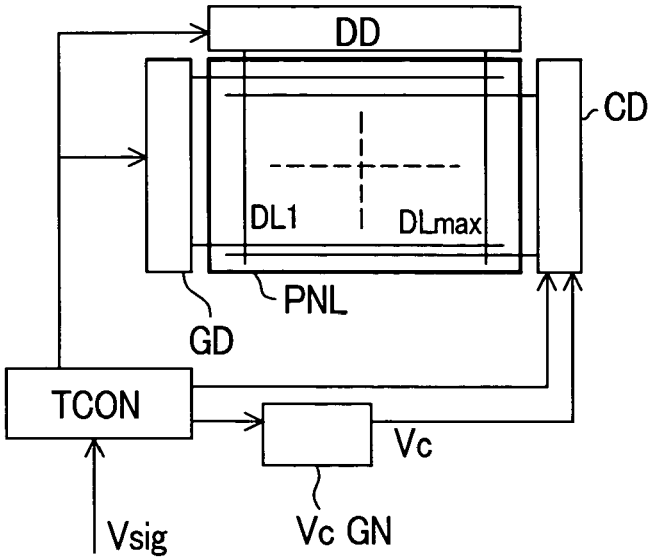
FIG. 28A is a schematic diagram of another embodiment of the liquid crystal display device according to the present invention.
Figure 28C:
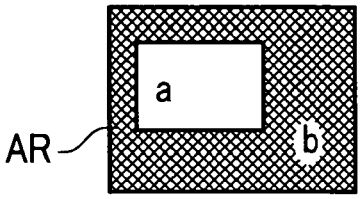
FIG. 28B is a flow chart and FIG. 28C is a diagram showing a control until an image signal from the outside is outputted through respective drivers.
Figure 28B:
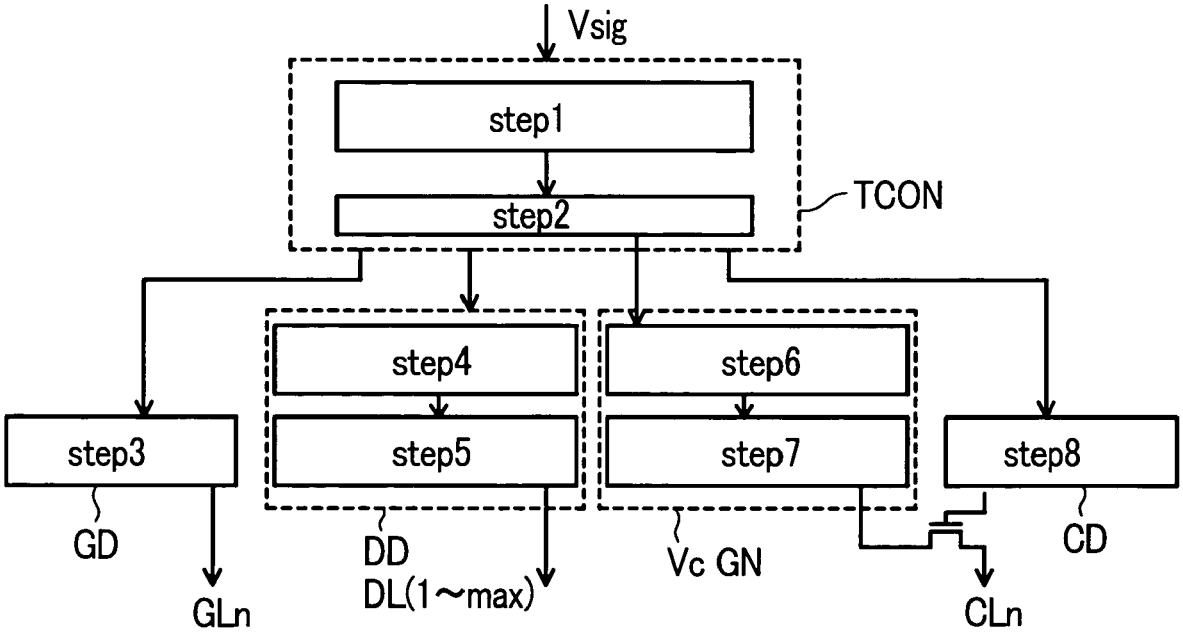

FIGS. 28A to 28C show another embodiment of the liquid crystal display device according to the present invention.

A counter voltage signal line CL which is used in common for a pixel row constituted of respective pixels arranged in parallel in the x direction is formed such that a large number of drain signal lines DL traverse the counter voltage signal line CL. For example, when SXGA is adopted, the counter voltage signal line CL traverses approximately 1280 drain signal lines DL.

Then, when completely the same signal is given to these drain signal lines DL as an ideal state, there is no influence from the drain signal lines DL to the counter voltage signal line CL. However, in an actual state, due to a display pattern displayed by a user, as shown in FIG. 28C, different patterns are displayed for respective regions such as regions "a", "b", for example, in a liquid crystal display part AR.

Accordingly, voltages which differ corresponding to respective regions are supplied to the respective drain signal lines DL. In this case, each counter voltage signal line CL has an optimum voltage for the region "a" and an optimum voltage for the region "b" and these voltages are different from each other.

Accordingly, in writing the counter voltage signal to each counter voltage signal line CL, by supplying the counter voltage signal having a value corresponding to the actual image, it is possible to reduce so-called smear.

FIG. 28A shows the constitution of the liquid crystal display device which displays an image on the liquid crystal display part AR of a liquid crystal display panel PNL by supplying respective signals from a video control circuit TCON to a gate driver GD, a drain driver DD and a common driver CD of the liquid crystal display panel PNL respectively. Further, a counter voltage signal Vc is configured to be supplied from the video control circuit TCON through a Vc generating circuit VcGN. Here, the Vc generating circuit VcGN is configured to convert the optimum data calculated by the video control circuit TCON into a Vc voltage by a DA converter or the like, for example, and to output the Vc voltage.

Here, in FIG. 28A, an image signal Vsig which is inputted to the video control circuit TCON is a video signal which is supplied from the outside of the liquid crystal display panel PNL.

FIG. 28B shows an operational flow of the above-mentioned respective circuits. First of all, the video signal Vsig is inputted to the video control circuit TCON, wherein data of the video signal is firstly measured in the inside of the video control circuit TCON (step 1). Thereafter, the optimum counter voltage signal Vc is calculated based on the measured data (step 2).

In this case, the measurement of the data of the video signal is performed by either an addition method or a differential method.

(1) In an example which uses the addition method, DLbest is calculated as follows.

$$DL\text{total}=\Sigma(DLn):n=1 \text{ to max}$$

$$DL\text{best}=DL\text{total}/DL$$

(2) In an example which uses the differential method, DLbest is calculated as follows.

$$DL\text{best}=VC\text{center}+\Sigma(DLn-VC\text{center}):n=1 \text{ to max}$$

Then, the counter voltage signal Vc is obtained by a formula Vc=DLbest−α

Here, DLbest is a value of DL on calculation for calculating the optimum value of Vc and VCcenter is a value of Vc on calculation which is arbitrarily set. In this case, it is preferable to set the Vc value to a value which is an average value between the maximum DL value and the minimum DL value or a value slightly lower than the average value. Further, α is a correction value which is introduced by taking a jump voltage to the pixel or the like into consideration.

The signal is supplied from the video control circuit TCON to the gate driver GD and the gate driver GD selects the next gate signal line GL in response to a synchronizing signal in the inside of the image signal (step 3).

Here, a signal is supplied from the video control circuit TCON to the drain driver DD and information on the video signal for respective lines transmitted from the video control circuit TCON is stored (step 4). The video signal is outputted in response to the synchronizing signal (step 5).

Further, a signal is supplied to the Vc generating circuit VcGN from the video control circuit TCON and the Vc generating circuit VcGN generates the Vc data based on the signal (step 6) and changes the Vc data to the optimum Vc value (step 7).

Further, in such an operation, a signal is supplied to the common driver CD from the video control circuit TCON and the common driver CD selects the next counter voltage signal line CL in response to the synchronizing signal in the inside of the image signal Vsig (step 8).

Also in this embodiment, other counter voltage signal lines CL to which the counter voltage signal scanned in at least each counter voltage signal line CL is not supplied is made to assume a floating state. However, it is needless to say that this embodiment is applicable to a case in which other counter voltage signal lines CL do not assume the floating state.

Embodiment 22

Figure 29A:
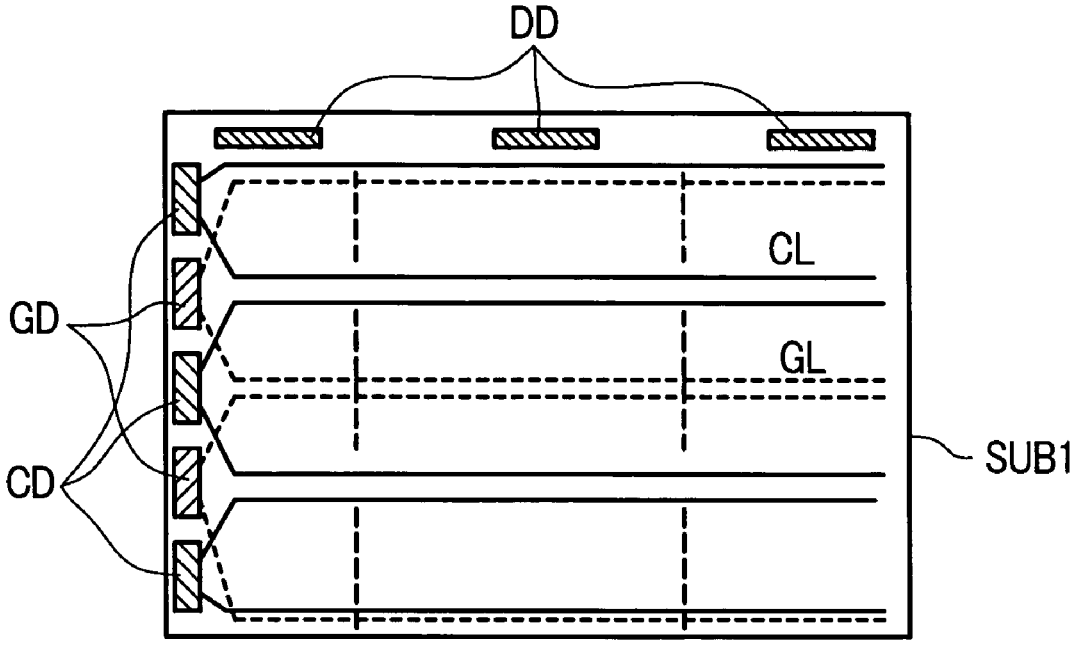

FIG. 29A is a plan view showing another embodiment of the liquid crystal display device according to the present invention. This drawing shows a gate driver GD, a common driver CD and a drain driver DD which are arranged on a transparent substrate SUB1 on which gate signal lines GL, counter voltage signal lines CL and drain signal lines DL (not shown in the drawing) are formed.

Out of these components, the gate driver GD and the common driver CD are respectively arranged in parallel at one side of the transparent substrate SUB1 thus giving rise to an advantageous effect in that the width of a so-called picture frame of a liquid crystal display panel PNL can be narrowed.

The gate drivers GD and the common drivers CD are alternately arranged, wherein the number of common drivers CD exceeds the number of gate drivers GD in this arrangement. The gate driver GD and the common driver CD are respectively operated by different drive voltages, wherein provided that these drivers adopt the separate chip constitutions as shown in the drawing, the drivers differ in the constitution of the inside of the chips. Accordingly, by forming chips with the number of unit terminals suitable for the gate driver GD and the common driver CD, the number of the drivers can be reduced whereby it is possible to realize space saving and reduction of cost.

Figure 29B:
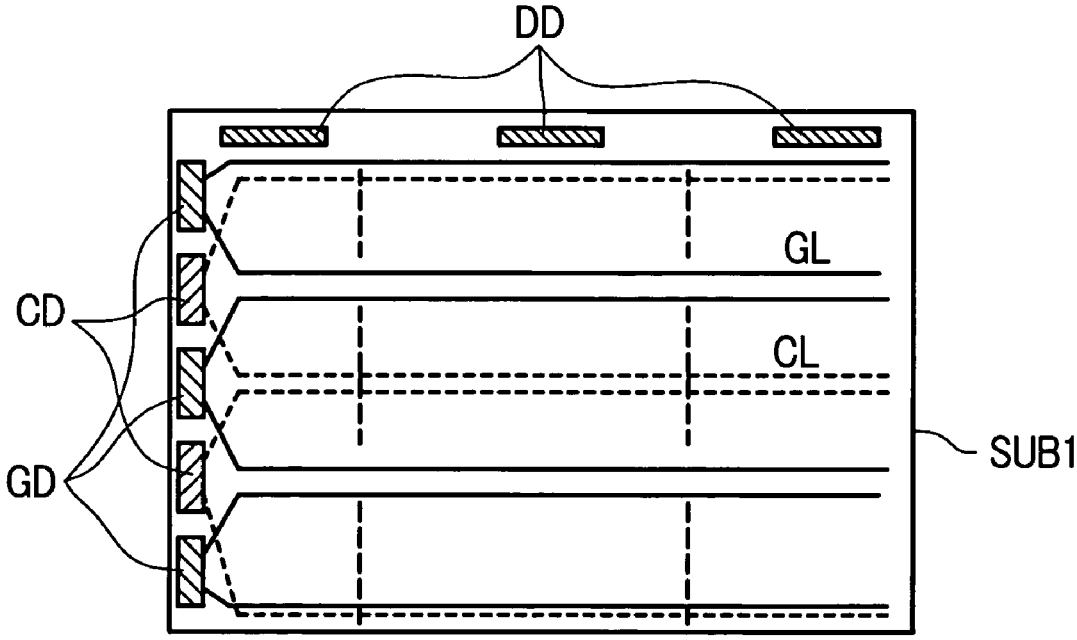

Further, FIG. 29B is a plan view showing another embodiment of the liquid crystal display device according to the present invention. The constitution which makes this embodiment different from the embodiment shown in FIG. 29A lies in the fact that in arranging the gate drivers GD and the common drivers CD, the number of common drivers CD is set smaller than the number of the gate drivers GD. Since the amplitude of the counter voltage signal from the common driver CD is smaller than the amplitude of the scanning signal from the gate driver GD, the common driver CD can reduce the dielectric strength. Due to such a constitution, the common driver CD can have a larger output per one chip. Accordingly, by reducing the number of chips of the common driver CD to less than the number of chips of the gate driver GD, it is possible to obtain the above-mentioned advantageous effect.

In this case, by selecting the counter voltage signal lines CL to which the counter voltage signal C is supplied by scanning every plural lines, the number of chips of the common driver CD can be easily reduced.

Here, in this embodiment, it is unavoidable that portions where the gate signal lines GL and the counter voltage signal lines CL are made to cross each other are formed in the vicinity of the gate driver GD and the common driver CD and hence, it is necessary to make the gate signal line GL and the counter voltage signal line CL have a hetero-layer structure which respectively interposes insulation films. Accordingly, it is desirable to make the gate signal lines GL and the counter voltage signal lines CL have the arrangement shown in FIG. 20A, FIG. 25A or FIG. 26A, for example.

Embodiment 23

Figure 30A:
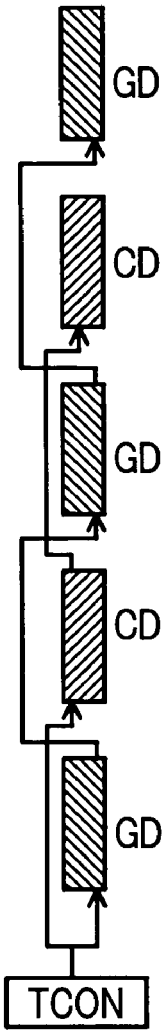
FIGS. 30A to 30D are diagrams showing another embodiment of the liquid crystal display device according to the present invention in which a gate driver and a common driver, which are constituted of semiconductor chips, are connected using data transfer wiring.

FIG. 30A is a plan view showing another embodiment of the case in which gate drivers GD and common drivers CD are alternately arranged at one side of the transparent substrate SUB1 as explained in conjunction with the embodiment 22. In FIG. 30A, in arranging the gate drivers GD and the common drivers CD, the number of gate drivers GD is set to be larger than the number of the common drivers CD.

Due to such a constitution, it is possible to easily realize a data transfer method in which signals are transferred on the transparent substrate SUB1. That is, the same start pulse is outputted from a video control circuit TCON to the gate drivers GD and the common drivers CD which are arranged electrically close to the video control circuit TCON, while a scanning signal is sequentially scanned and outputted from the gate drivers GD to respective gate signal lines GL which the gate drivers GD control respectively. Further, in such an operation, a counter voltage signal is sequentially scanned and outputted from the common drivers CT to respective counter voltage signal lines CL which the common drivers CD are in charge of.

Then, at a stage in which the sequential supply of the scanning signal to respective gate signal lines GL by the gate driver GD and the sequential supply of the counter voltage signal to respective counter voltage signal lines CL by the common driver CD are finished, the same start pulse is outputted to other gate drivers GD which are arranged close to the gate driver GD and other common drivers CD which are arranged close to the common driver CD from the gate driver GD and the common driver CD respectively.

That is, upon completion of outputting of one chip, the transmission of an output signal to the next chip is instructed and outputting of the signal is succeeded to the next line.

In this case, while the scanning signal from each gate driver GD is outputted through every gate signal line GL, the counter voltage signal C from each common driver CD is outputted for every plurality of counter voltage signal lines CL.

Accordingly, as shown in FIG. 30A, it is preferable to adopt wiring such that the start pulse from the video control circuit TCON is individually inputted to the gate driver GD and the common driver CD respectively.

In this manner, outputting of the scanning signal from the common driver CD is performed for every plurality of counter voltage signal lines DL and hence, it is desirable to establish that a fixed time which becomes the changeover timing in the inside of the chip is multiplied by n times to perform the changeover of outputting of the common driver CD for every n-times outputting of the gate driver GD.

Figure 30B:
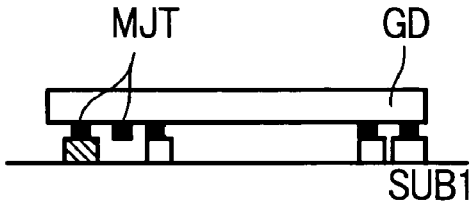
Figure 30C:
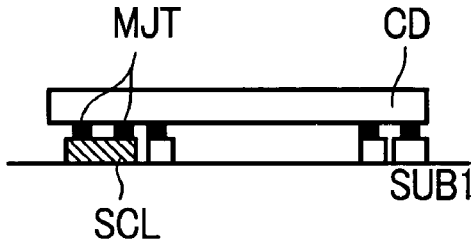

FIG. 30B is a side view of the gate driver GD mounted on the transparent substrate SUB1 and FIG. 30C is a side view of the common driver CD, wherein mode changeover terminals MJT are mounted on these chips, for example and short-circuiting portions of these mode changeover terminals MJT are changed using short-circuiting wiring SCL formed on the surface of the transparent substrate SUB1 so that it is possible to cope with the change of "n" of the n multiplication.

For example, in the gate driver GD shown in FIG. 30B, the mode changeover terminals MJT are not connected and hence, the n-times multiplication is not performed. However, in the common driver CD shown in FIG. 30C, the mode changeover terminals MJT are short-circuited to each other and hence, outputting of the common driver CD is set to be changed to n-times outputting. The value of "n" can be easily set by preliminarily providing a plurality of mode changeover terminals MJT at the short-circuiting portions in conformity with the number of "n".

Figure 30D:
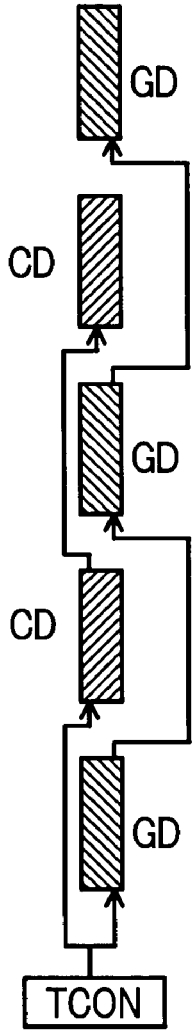

FIG. 30D is a plan view showing another embodiment. As shown in FIG. 30D, by providing respective inter-driver wiring between the gate driver GD and the common driver CD in an opposite manner with respect to the respective drivers, crossing of the wiring can be prevented. With respect to transmission timing of the start pulse between drivers, the supply of the counter voltage signal C of the common driver CD is performed using a plurality of counter voltage signal lines CL as a unit and hence, the supply of the scanning signal G and the supply of the counter voltage signal C are displaced from each other and hence, there arises a fear that an erroneous operation occurs due to the interference of these signals when a crossing portion of lines is present.

Accordingly, by adopting the arrangement in which the lines do not cross each other as in the case of the embodiment shown in FIG. 30D, a stable operation can be realized.

Further, this embodiment is directed to an example in which the respective drivers are formed of chips (semiconductor chips). However, the respective drivers may be formed of a driver TCP which is constituted by a so-called tape carrier method. Also in this case, the above-mentioned judgment of mode can be performed based on the presence or the non-presence of the short-circuiting wiring SCL on the transparent substrate SUB1.

Figure 31A:
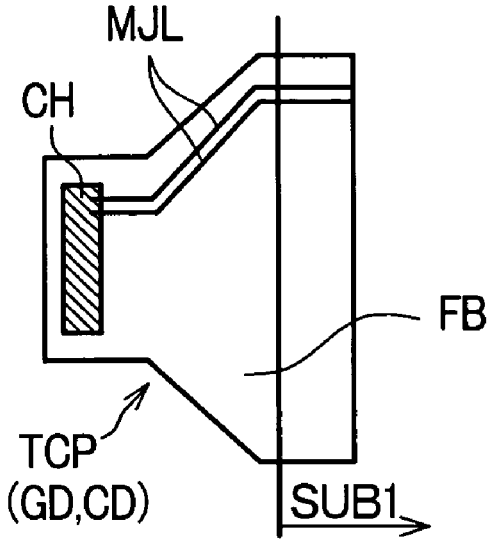
FIGS. 31A to 31D are diagrams showing another embodiment of the liquid crystal display device according to the present invention in which a gate driver and a common driver, which are constituted of TCP method semiconductor devices, are connected using data transfer wiring.

Here, with respect to the driver TCP constituted by the tape carrier method, as shown in FIG. 31A, a semiconductor chip CH is mounted on a flexible printed circuit board FB and respective input terminals and respective output terminals of the semiconductor chip CH are respectively pulled out to respective opposing sides by way of input wiring and output wiring formed on a surface of the flexible printed circuit board FB. Further, in such a constitution, end portions (terminals) of the output wiring are pulled out to end peripheries of the surface of the transparent substrate SUB1 and are electrically connected with the gate signal lines GL or the counter voltage signal lines CL, for example.

Figure 31B:
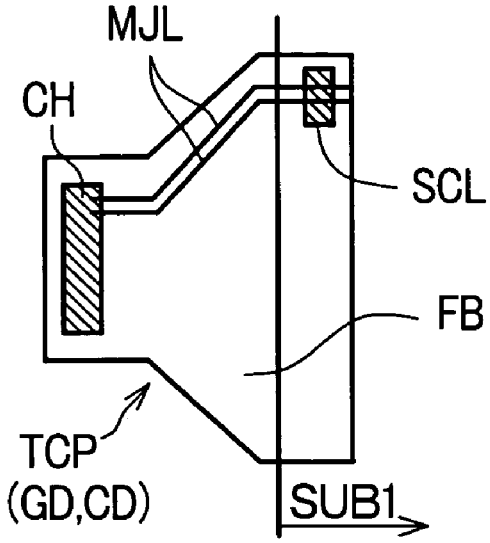

In this case, lines MIL are configured to extend over the flexible printed circuit board FB from respective mode judgment terminals of the semiconductor chip CH and, as shown in FIG. 31B, these lines MIL may be positioned on the short circuiting lines SCL formed on the transparent substrate SUB1.

Figure 31C:
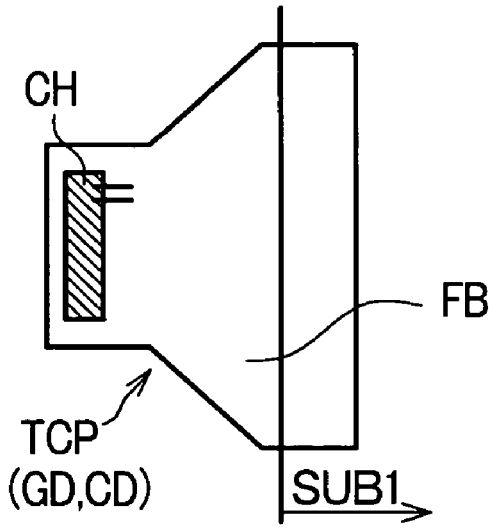
Figure 31D:
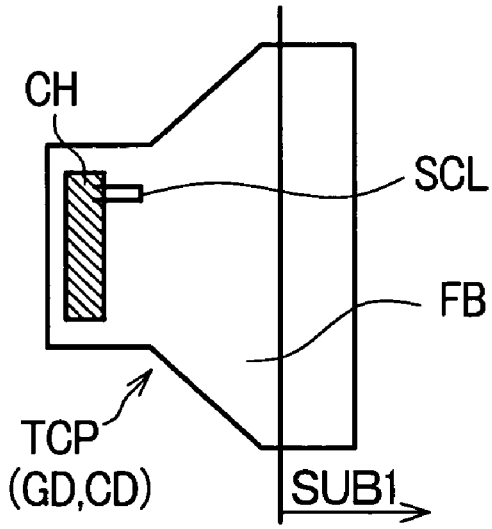

Further, the embodiment is not limited to such a case, that is, it is needless to say that, as shown in FIG. 31C and FIG. 31D, when the drivers TCP are separately constituted for the gate driver GD use and the common driver CD use, short-circuiting lines SCL for judgment may be formed on the drivers TCP. This is because such a constitution can be realized by changing only the driver TCP and the driver chips per se can be used in common.

Embodiment 24

Figure 32A:
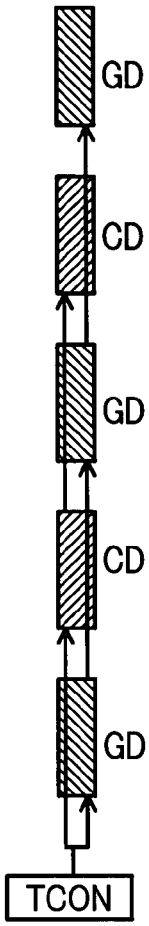
FIGS. 32A to 32E are diagrams showing another embodiment of the liquid crystal display device according to the present invention in which a gate driver and a common driver which are constituted of semiconductor chips are connected using data transfer wiring.

FIG. 32A is a plan view of another embodiment in which in the same manner as the embodiment shown in FIG. 23A, gate drivers GD and common drivers CD are alternately arranged at one side of a transparent substrate SUB1. Also in FIG. 32A, in arranging the gate drivers GD and the common drivers CD, the number of gate drivers GD is set to be larger than the number of common drivers CD.

Further, as shown in FIG. 32A, a signal from a video control circuit TCON is, first of all, supplied to the gate driver GD arranged close to the video control circuit TCON and, thereafter, is supplied to the common driver CD arranged close to the gate driver GD.

In this case, the supply of the signal to the common driver CD is performed using a wiring layer on a transparent substrate SUB1 which runs on a mounting region of the gate driver GD.

Further, the supply of the signal from the gate driver GD to another gate driver GD which is arranged next to the former gate driver GD is performed by a wiring layer on the transparent substrate SUB1 which runs on a mounting region of the common driver CD which is arranged between the gate drivers GD.

By repeating the above arrangement hereinafter, it is possible to realize data transfer without requiring the crossing of respective wiring layers. Further, since it is possible to prevent the wiring layer for data transfer from extending beyond both sides of the respective drivers which are arranged in parallel, an area which the wiring layers occupy in the so-called picture frame of the liquid crystal display panel can be decreased.

Figure 32B:
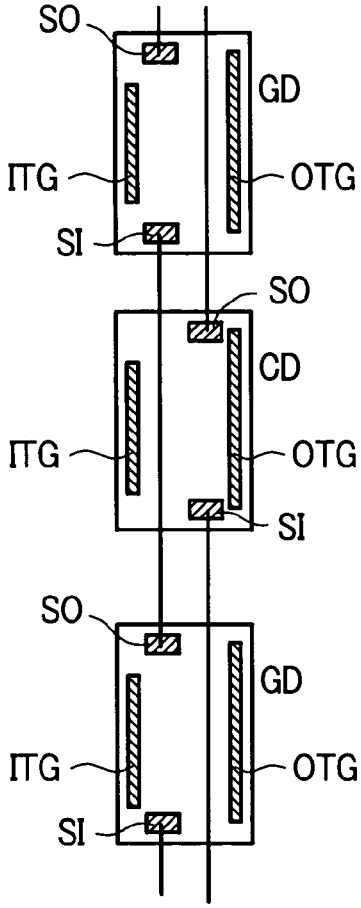

Here, FIG. 32B specifically shows the connection relationship between the wiring layers of the gate drivers GD and the common drivers CD in FIG. 32A. In the drawing, symbol OTG indicates a group of output terminals, symbol ITG indicates a group of input terminals, symbol SI indicates a signal input, and SO indicates a signal output.

Figure 32C:
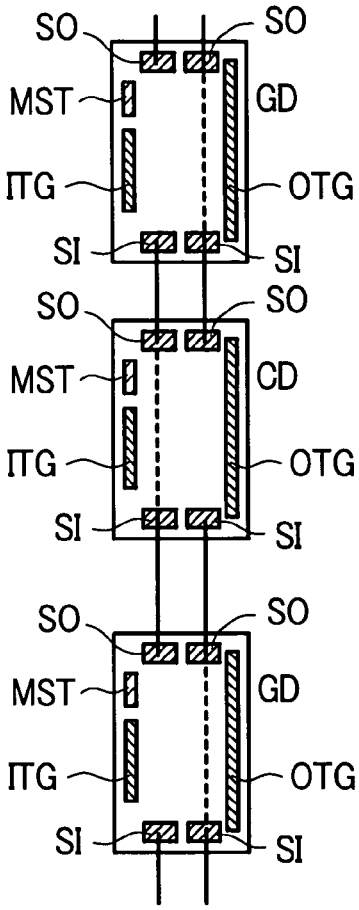

FIG. 32C is a plan view showing another embodiment. The constitution which makes this embodiment different from the embodiment shown in FIG. 32B lies in the fact that wiring layers which, for example, run in the regions of the common driver CD, are arranged at both sides of the common driver CD and connect respective gate drivers GD in the inside of a chip of the common driver CD. That is, the wiring layers (indicated by a dotted line in the drawing) which are formed in the inside of the common driver CD are provided with the signal input terminal SI and the signal output terminal SO at both ends thereof. The gate drivers GD also adopt substantially the same constitution as the common drivers CD.

In this case, as shown in FIG. 32B, a mode selection terminal MST may be formed in each semiconductor chip and the operation of the chip may be changed over due to the connection/non-connection with short-circuiting wiring SCL formed on a surface of the transparent substrate SUB1.

Figure 32D:
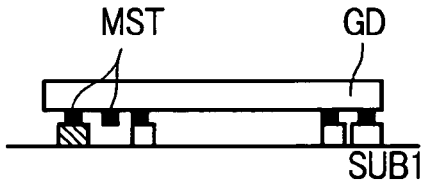
Figure 32E:
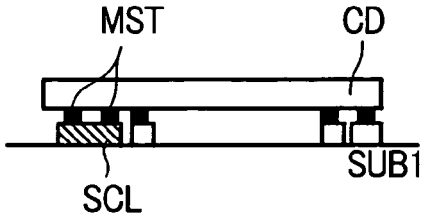

FIG. 32D and FIG. 32E show that the drivers may be used as the gate drivers GD or as the common drivers CD based on the connection/non-connection judgment of the short-circuiting wiring SCL.

Due to such a constitution, the gate driver GD and the common driver CD can have the same constitution and hence, these drivers can be used either as the gate driver GD or the common driver CD. Accordingly, it is possible to realize a reduction of kinds of parts and easy assembling.

Figure 32F:
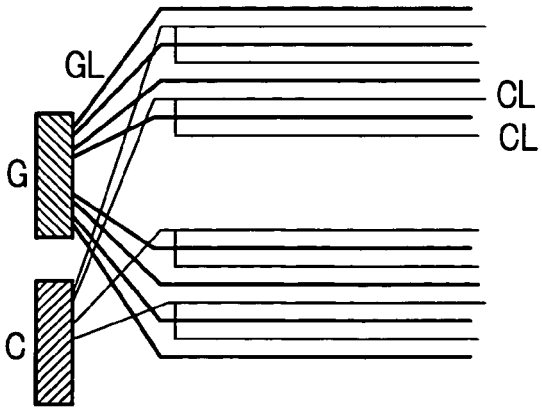

Here, FIG. 32F shows a case in which, for setting the number of common drivers CD to be smaller than the number of the gate drivers GD, counter voltage signal lines CL in a number substantially equal to the number of gate signal lines GL, that is, for example, every two counter voltage signal lines CL are connected from above, and counter voltage signals are sequentially scanned and supplied to these respective counter voltage signal lines CL which are connected to each other.

Embodiment 25

Figure 33A:
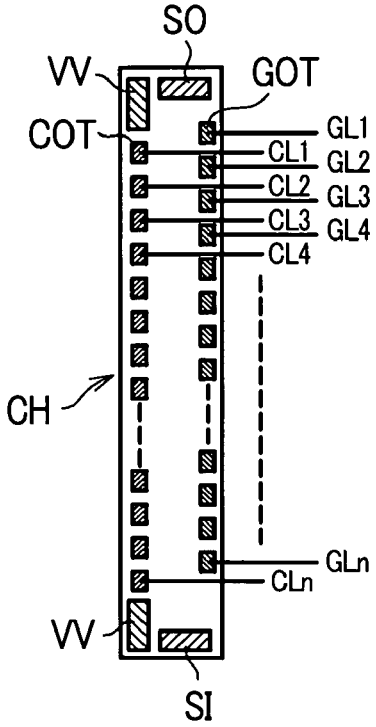
FIGS. 33A to 33F are diagrams showing another embodiment of the liquid crystal display device according to the present invention in which a gate driver and a common driver which are constituted of semiconductor chips are connected using data transfer wiring.

FIG. 33A is a plan view showing a case in which, in the same manner as the embodiment 24, when gate drivers GD and common drivers CD are alternately arranged on one side of a transparent substrate SUB1, at least a pair of gate driver GD and a common driver CD which are arranged close to each other are incorporated into one semiconductor chip.

That is, when a gate signal line GL and a counter voltage signal line CL are arranged in the semiconductor chip CH at a right side of the drawing, gate output terminals GTO are arranged along the right side of the semiconductor chip CH in the drawing, while common output terminals CTO are arranged along the left side of the semiconductor chip CH in the drawing.

Further, each one of respective common output terminals CTO is arranged between the gate output terminals GTO which are arranged close to each other. Due to such a constitution, without being obstructed by the gate output terminals GTO, it is possible to form the counter voltage signal lines CL by extending the counter voltage signal lines CL to the common output terminals CTO.

Further, on respective other sides except for the side on which the gate output terminals GTO and the common output terminals CTO are formed in parallel, a power source terminal VV is formed in the vicinity of the other side, wherein a signal input terminal Si is formed on one side and a signal output terminal SO is formed on another side.

Figure 33B:
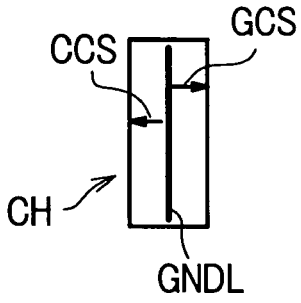

In the semiconductor chip CH having such a constitution, as shown in FIG. 33B, between a group of gate output terminals GTO and a group of common output terminals CTO, a ground line GNDL which runs in parallel with these groups of terminals is formed. Further, substantially using the ground line GNDL as a boundary, a common electrode drive circuit Cm is formed on a C circuit side CCS at the left side of the drawing and a scanning signal drive circuit V is formed on a G circuit side GCS at the right side of the drawing.

Figure 33C:
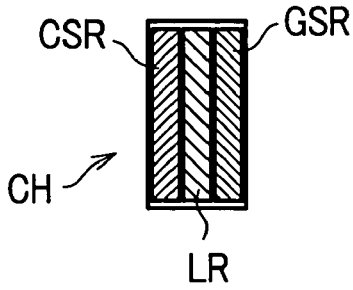

Further, the semiconductor chip CH having such a constitution is, as shown in FIG. 33C, divided into three zones in the direction perpendicular to the direction of the group of gate output terminals GTO and the group of common output terminals CTO, wherein circuits are respectively incorporated into the center region LR, the left-side region CSR and the right-side region GSR thus forming a logic region, a common switch region and a gate switch region respectively.

Here, it is not always necessary for the semiconductor chip CH to include all of the above-mentioned constitutions and it is sufficient that the semiconductor chip CH is provided with at least one of following constitutions.

First of all, the gate output terminals GTO and the common output terminals CTO are respectively formed on opposing sides. Due to such a constitution, the common electrode drive circuit Cm and the scanning signal line drive circuit V can be separately formed in the inside of the chip and hence, interference between these circuits can be prevented.

Next, the power source terminal VV is formed at the common output terminal CTO side. Due to such a constitution, the output voltages of the scanning signal G and the counter voltage signal C are different from each other and the ON-time voltage of the counter voltage signal C is lower than the ON-time voltage of the scanning signal G and hence, the counter voltage signal C receives a smaller amount of influence of power source noises.

Next, the common output terminals CTO are arranged at the side away from a liquid crystal display part AR. This is because, by arranging the common potential at the outside of the liquid crystal display part AR, it is possible to have a shielding effect against external noises.

Next, in the inside of the semiconductor chip CH, the ground line GNDL extends between the common electrode drive circuit Cm and the scanning signal drive circuit V. Due to such a constitution, the mutual interference between the respective circuits can be prevented.

Further, in the inside of the semiconductor chip CH, the logic circuit is arranged at the center thereof, the gate switch circuit is arranged at one side thereof, and the common switch circuit is arranged at another side thereof. Due to such a constitution, the switching parts which use the same drive voltage are collectively arranged at the common logic part of the scanning signal drive circuit V and the common electrode drive circuit Cm, and the switching parts which use different drive voltages are respectively separated into the scanning signal drive circuit V and the common electrode drive circuit Cm. Accordingly, it is possible to realize a downsizing of the circuit, a reduction of power consumption and prevention of the interference. Here, the maximum voltage may be set to satisfy the relationship: gate switch region>common switch region>logic region.

Figure 33D:
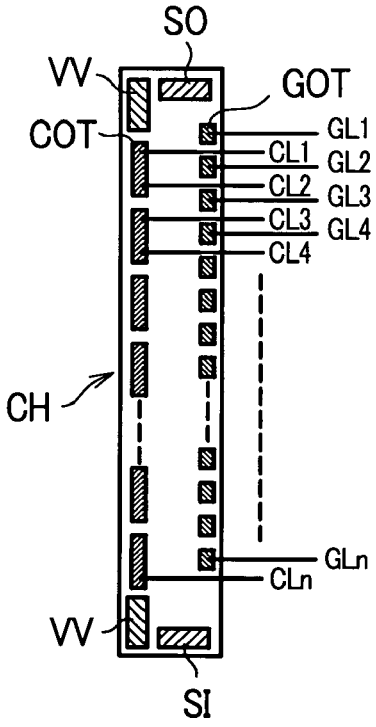

FIG. 33D is a plan view showing another embodiment. The constitution which makes this embodiment different from the constitution shown in FIG. 33A lies in the fact that the common connection of a plurality of counter voltage signal lines CL is constituted by increasing a terminal area of each common output terminal COT of the semiconductor chip CH and by facing down the common output terminals COT. Due to such a constitution, a circuit size of the common electrode drive circuit Cm in the inside of the semiconductor chip CH can be reduced.

Figure 33E:
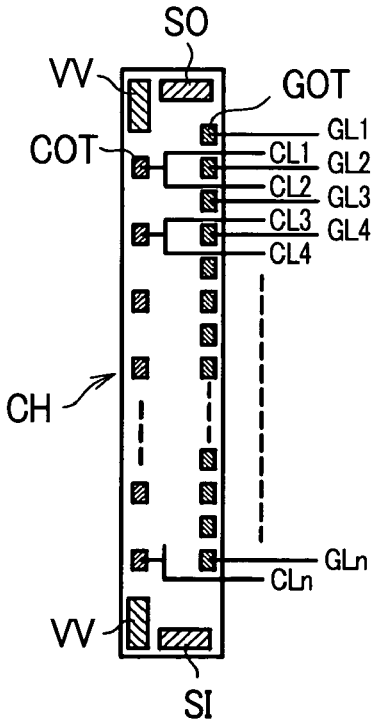

Further, FIG. 33E is a plan view showing another embodiment. The constitution which makes this embodiment different from the constitution shown in FIG. 33A lies in the act that one line pulled out from each common output terminal COT of a semiconductor chip is branched and a plurality of counter voltage signal lines CL are connected to the branched lines.

Due to such a constitution, it is possible to increase the connection area of each common output terminal COT and hence, the connection resistance can be reduced. Further, compared to a case in which sizes of respective common output terminals are continuously formed, the size of the common output terminals can be made miniaturized. Accordingly, it is possible to obtain an advantageous effect in that the manufacture of the connection portions of the semiconductor chip CH is facilitated.

Figure 33F:
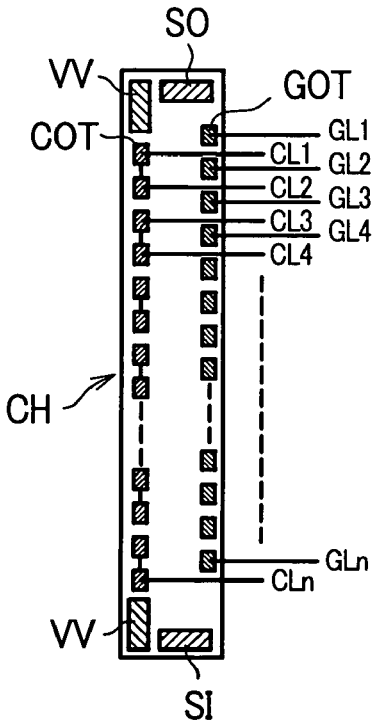

Further, FIG. 33F is a plan view showing another embodiment. The constitution which makes this embodiment different from the constitution shown in FIG. 33A lies in the fact that respective common output terminals COT of a semiconductor chip CH are respectively connected to counter voltage signal lines CL and a plurality of neighboring common output terminals COT are connected to each other in the inside of the chip.

Due to such a constitution, the size of a common electrode drive circuit Cm can be reduced. Further, the common output terminals COT can be constituted at the pitch substantially equal to a pitch of gate output terminals GOT and hence, it is possible to prevent the non-uniformity of height among terminals which may occur at the time of connecting terminals of the semiconductor chip CH and terminals on a transparent substrate SUB1 through an anisotropic conductive film, for example. Accordingly, the connection stability is enhanced whereby it is possible to realize a reduction of the connection resistance and enhancement of the reliability. Further, a nonstop rate (the rate at which the terminals are connected a single time without performing a regeneration operation which becomes necessary when a connection failure occurs) can be enhanced thus realizing a reduction of the cost.

Embodiment 26

In the liquid crystal display device according to the present invention, as has been explained in conjunction with the above-mentioned respective embodiments, both of the gate signal lines GL and the counter voltage signal lines CL are made to assume the floating state most of the time. This implies that the semiconductor chips CH corresponding to such gate signal lines GL and counter voltage signal lines CL are in an idling state during the period and hence, the utilization efficiency of the semiconductor chips per unit time is low.

Accordingly, in this embodiment, both a scanning signal G and a counter voltage signal C are outputted from one output terminal of the semiconductor chip CH with a time difference so as to change the output destinations of the signals, thus reducing the number of semiconductor chips.

Due to such a constitution, by outputting the scanning signal G and the counter voltage signal C from one terminal of the semiconductor chip CH, for example, the number of semiconductor chips can be reduced. Further, by constituting a common electrode drive circuit Cm and a scanning signal drive circuit V such that these circuits can be used in common, compared to a case that a dedicated common electrode drive circuit Cm and a dedicated scanning signal drive circuit V are separately provided, the area that the semiconductor chips occupy can be reduced whereby the further reduction of cost can be realized.

When both of the scanning signal G and the counter voltage signal C are outputted and supplied to the gate signal line GL and the counter voltage signal line CL from the same output terminal of the semiconductor chip CH with a time difference, at the time of writing signals into respective pixels, it becomes necessary to simultaneously supply the signals to the gate signal lines GL and the counter voltage signal lines CL, respectively.

Since it is impossible to simultaneously output different values to the same output terminal, it is necessary to supply the scanning signal G and the counter voltage signal C to the original gate signal lines GL and the counter voltage signal lines CL by adopting a design which makes terminals which differ as seen in plan view output the scanning signal G and the counter voltage signal C having different potentials and lines for respective signal intersect each other.

Figure 34A:
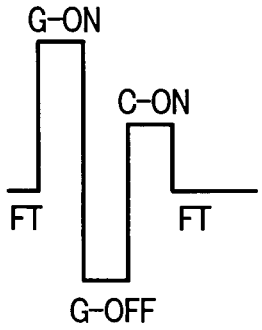
FIGS. 34A to 34C are diagrams of another embodiment of the liquid crystal display device according to the present invention showing signal waveforms when a scanning signal and a counter voltage signal are transmitted from one circuit.

Here, as shown in FIG. 34A, when the gate signal G-ON is first outputted from the same output terminal, the counter voltage signal C-ON is supplied from the output by two or more lines away from the first output. This is because it is necessary to supply the signal G-OFF next to the scanning signal G-ON and the supply of the counter voltage signal C-ON comes thereafter.

Figure 34B:
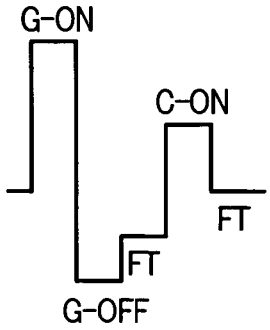

In this case, as shown in FIG. 34B, three lines or more may be provided until the counter voltage signal C-ON is supplied after outputting of the gate signal G-ON thus providing a period in a floating state between the gate signal G-OFF and the counter voltage signal C-ON. In this case, the time necessary for performing the changeover from the gate signal G to the counter voltage signal C can be sufficiently ensured.

Figure 34C:
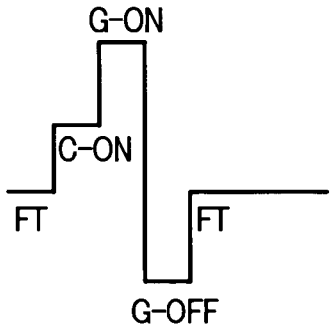

Further, as shown in FIG. 34C, the counter voltage signal C-ON is first supplied and, thereafter, the gate signal G-ON and the gate signal G-OFF may be sequentially outputted. In this case, it is sufficient to ensure one line or more as a period from the supply of the counter voltage signal C to the supply of the gate signal G. In this case, the counter voltage signal C-ON is first lifted to the potential state from the floating state and, thereafter, the gate signal G-ON is supplied and hence, a gate signal G-ON is precharged in appearance. Accordingly, the rise of the gate signal G-ON becomes steep and hence, the further enhancement of the writing characteristics is achieved. Further, since the number of wiring crossings is reduced, an enhancement of the yield rate can be realized. Here, the floating state may be set by supplying the floating potential from the outside via a high resistance.

FIGS. 35A to 35D are directed to one embodiment of a circuit which has the common electrode drive circuit Cm and the scanning signal drive circuit V in common and is configured to output the signal shown in FIG. 34A.

Figure 35A:
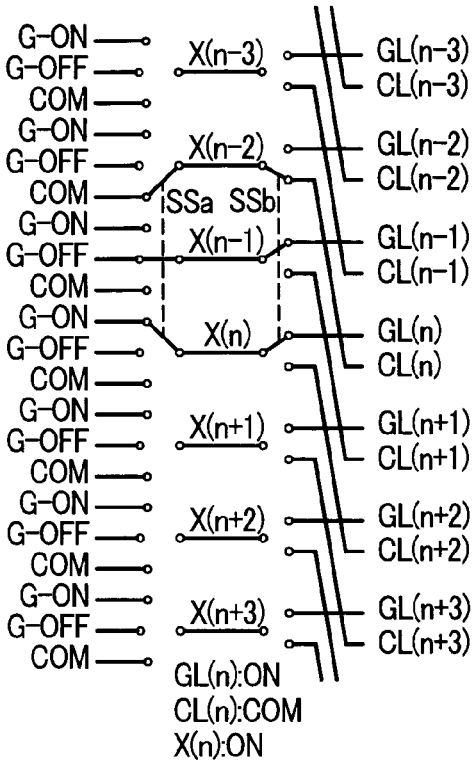
FIGS. 35A to 35D are diagrams showing a changeover operation of a switch when a scanning signal and a counter voltage signal are transmitted from one circuit in the liquid crystal display device according to the present invention.

First of all, as shown in FIG. 35A, signal supply terminals are provided at the right side in the drawing and the G-ON signal, the G-OFF signal, the COM (counter voltage) signal, the G-ON signal, the G-OFF signal, the COM signal, the G-ON signal, the G-OFF signal, the COM signal, . . . , the COM signal are sequentially inputted to these signal supply terminals from above as seen in the drawing. The respective signals are always supplied. Further, with respect to another terminal to which the G-ON signal is supplied, for example, a similar signal is supplied to another terminal to which the same G-ON signal is supplied. The same goes for other signals such as the G-OFF signal.

Further, the respective terminals to which the G-ON signal, the G-OFF signal, the COM signal are sequentially supplied and which are arranged close to each other are connected to respective terminals X by way of, for example, scanning switches which reject the reception of all of the above-mentioned signals or receive any one of the respective signals. For example, with respect to the case shown in FIG. 35A, the terminal X(n−2) is connected to the terminal to which the COM signal is supplied through the scanning switch SSa, the terminal X(n−1) is connected to the terminal to which the G-OFF signal is supplied through the scanning switch SSa, and the terminal X(n) is connected to the terminal to which the G-ON signal is supplied through the scanning switch SSa. Further, none of the G-ON signal, the G-OFF signal and the COM signal is supplied to other terminals X except for these terminals.

Further, the above-mentioned respective terminals X are configured such that out of the gate signal lines GL and the counter voltage signal lines CL, some of them receive no signals from the terminals X or receive only one specified signal lines by way of the scanning switch SSb, for example. For example, in the case shown in FIG. 35A, the COM signal from the terminal X(n−2) is supplied to the counter voltage signal line CL(n) by way of the scanning switch SSb, the G-OFF signal from the terminal X(n−1) is supplied to the gate signal line GL(n−1) by way of the scanning switch SSb, and the G-ON signal from the terminal X(n) is supplied to the gate signal line GL(n) by way of the scanning switch SSb.

From the above, to the nth gate signal line GL(n) and the nth counter voltage signal line CL(n), the G-ON signal and the COM signal are respectively supplied, while to the (n−1)th gate signal line GL(n−1) which is one preceding line, the G-OFF signal is supplied.

Figure 35B:
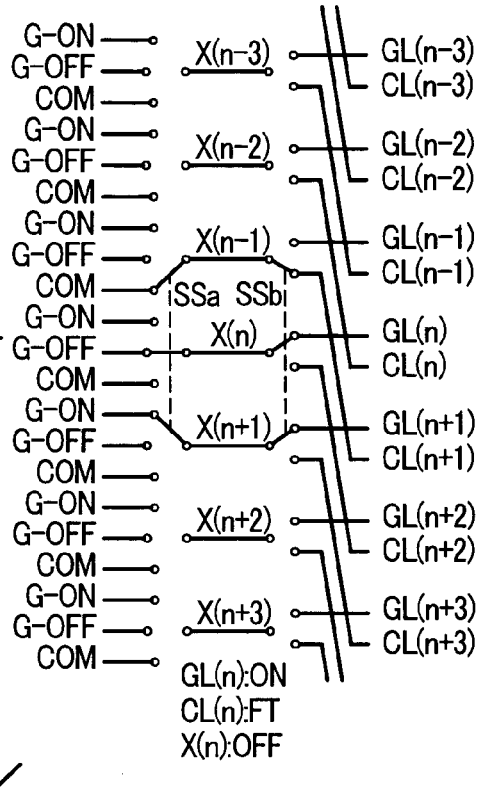

In the next stage, as shown in FIG. 35B, in a state in which the respective connection relationships of the input side and output side of the scanning switches SSa, SSb with the terminals X are maintained, the scanning switches SSa, SSb are shifted to the next lines as is. In the drawing, the terminal X(n−1) is connected to the terminal to which the COM signal is supplied by way of the scanning switch SSa and the terminal X(n) is connected to the terminal to which the G-OFF signal is supplied by way of the scanning switch SSa. Further, the terminal X(n+1) is connected to the terminal to which the G-ON signal is supplied by way of the scanning switch SSa. Here, to other terminals X except for the above-mentioned terminals, none of the G-ON signal, the G-OFF signal and the COM signal is supplied.

Further, with respect to a case shown in FIG. 35B, in the drawing, the COM signal from the terminal X(n−1) is supplied to the counter voltage signal line CL(n+1) by way of the scanning switch SSb, the G-OFF signal from the terminal X(n) is supplied to the gate signal line GL(n) by way of the scanning switch SSb, and the G-ON signal from the terminal X(n+1) is supplied to the gate signal line GL(n+1) by way of the scanning switch SSb.

From the above, to the nth gate signal line GL(n), the G-OFF signal is supplied and the counter voltage signal line CL(n) assumes a floating state. On the other hand, to the (n+1)th gate signal line GL(n+1) and the (n+1)th counter voltage signal line CL(n+1) which come next, the G-ON signal and the COM signal are respectively supplied.

Figure 35C:
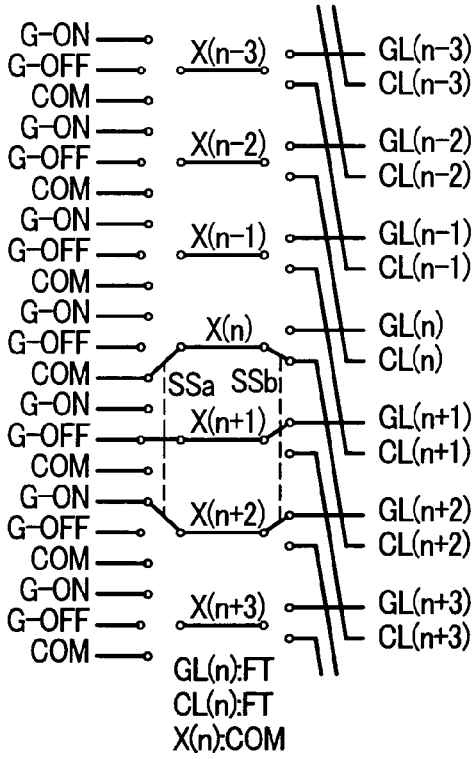

Also in the next stage, as shown in FIG. 35C, in a state in which the respective connection relationships of the input sides and output sides of the scanning switches SSa, SSb with the terminals X are maintained, the scanning switches SSa, SSb are shifted to the next lines as is. In the drawing, the terminal X(n) is connected to the terminal to which the COM signal is supplied by way of the scanning switch SSa and the terminal X(n+1) is connected to the terminal to which the G-OFF signal is supplied by way of the scanning switch SSa. Further, the terminal X(n+2) is connected to the terminal to which the G-ON signal is supplied by way of the scanning switch SSa. Here, to other terminals X except for the above-mentioned terminals, none of the G-ON signal, the G-OFF signal and the COM signal is supplied.

Further, with respect to a case shown in FIG. 35C, in the drawing, the COM signal from the terminal X(n) is supplied to the counter voltage signal line CL(n+2) by way of the scanning switch SSb, the G-OFF signal from the terminal X(n+1) is supplied to the gate signal line GL(n+1) by way of the scanning switch SSb, and the G-ON signal from the terminal X(n+2) is supplied to the gate signal line GL(n+2) by way of the scanning switch SSb.

From the above, to the (n+1)th gate signal line GL(n+1), the G-OFF signal is supplied and the counter voltage signal line CL(n+1) assumes a floating state. On the other hand, to the (n+2)th gate signal line GL(n+2) and the (n+2)th counter voltage signal line CL(n+2) which come next, the G-ON signal and the COM signal are respectively supplied.

Figure 35D:
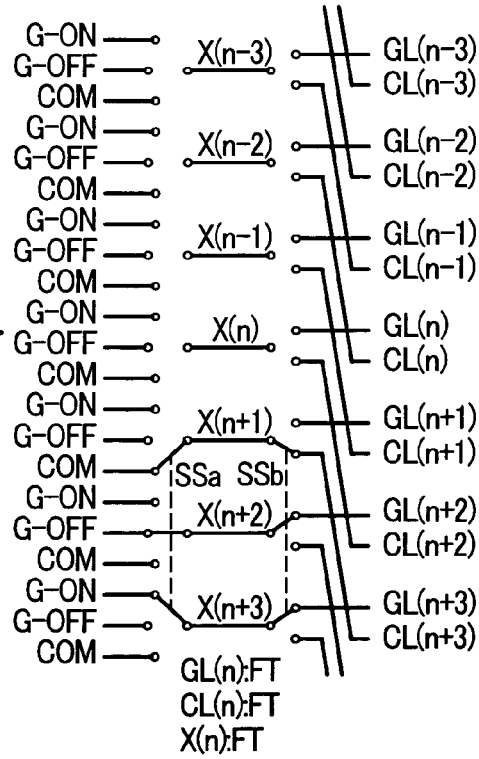

Also in the next stage, as shown in FIG. 35D, in a state in which the respective connection relationships of the input side and output sides of the scanning switches SSa, SSb with the terminals X are maintained, the scanning switches SSa, SSb are shifted to the next lines as is. In the drawing, the terminal X(n+1) is connected to the terminal to which the COM signal is supplied by way of the scanning switch SSa, the terminal X(n+2) is connected to the terminal to which the G-OFF signal is supplied by way of the scanning switch SSa, and the terminal X(n+3) is connected to the terminal to which the G-ON signal is supplied by way of the scanning switch SSa. Here, to other terminals X except for the above-mentioned terminals, none of the G-ON signal, the G-OFF signal and the COM signal is supplied.

Further, with respect to a case shown in FIG. 35D, in the drawing, the COM signal from the terminal X(n+1) is supplied to the counter voltage signal line CL(n+3) by way of the scanning switch SSb, the G-OFF signal from the terminal X(n+2) is supplied to the gate signal line GL(n+2) by way of the scanning switch SSb, and the G-ON signal from the terminal X(n+3) is supplied to the gate signal line GL(n+3) by way of the scanning switch SSb.

From the above, to the (n+2)th gate signal line GL(n+2), the G-OFF signal is supplied and the counter voltage signal line CL(n+2) assumes a floating state. On the other hand, to the (n+3)th gate signal line GL(n+3) and the (n+3)th counter voltage signal line CL(n+3) which come next, the G-ON signal and the COM signal are respectively supplied.

Then, the above-mentioned operation is repeated, wherein the scanning switches SSa, SSb are shifted while maintaining the above-mentioned relationship even when the operation advances from the lowermost line to the uppermost line.

FIGS. 36A to 36D are directed to another embodiment of a circuit which has the common electrode drive circuit Cm and the scanning signal drive circuit V in common as described above and is configured to output the signal shown in FIG. 34C.

The constitution which makes this embodiment different from the constitution shown in FIGS. 35A to 35D only lies in the fact that the connection relationship between the input side and the output side of the scanning switches SSa, SSb with respect to the terminals X is different.

Figure 36A:
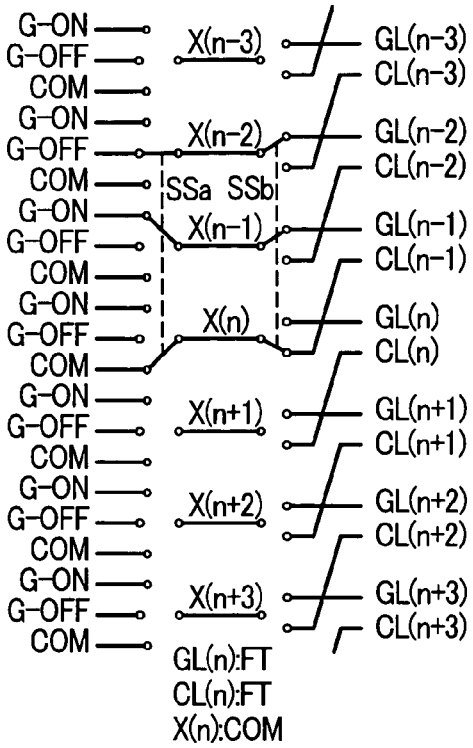
FIGS. 36A to 36D are diagrams showing another changeover operation of a switch when a scanning signal and a counter voltage signal are transmitted from one circuit in the liquid crystal display device according to the present invention.

As shown in FIG. 36A, in the drawing, the terminal X(n−2) is connected to the terminal to which the G-OFF signal is supplied through the scanning switch SSa, the terminal X(n−1) is connected to the terminal to which the G-ON signal is supplied through the scanning switch SSa, and the terminal X(n) is connected to the terminal to which the COM signal is supplied through the scanning switch SSa. Further, none of the G-ON signal, the G-OFF signal and the COM signal is supplied to other terminals X except for these terminals.

Further, in the case shown in FIG. 36A, the G-OFF signal from the terminal X(n−2) is supplied to the gate signal line GL(n−2) by way of the scanning switch SSb, the G-ON signal from the terminal X(n−1) is supplied to the gate signal line GL(n−1) by way of the scanning switch SSb, and the COM signal from the terminal X(n) is supplied to the counter voltage signal line C(n−1) by way of the scanning switch SSb.

In this stage, the nth gate signal line GL(n) and the counter voltage signal line CL(n) are each made to assume a floating state, the G-ON signal is supplied to the (n−1)th gate signal line GL(n−1) which is the one-line preceding line, and the COM signal is supplied to the counter voltage signal line CL(n−1).

Figure 36B:
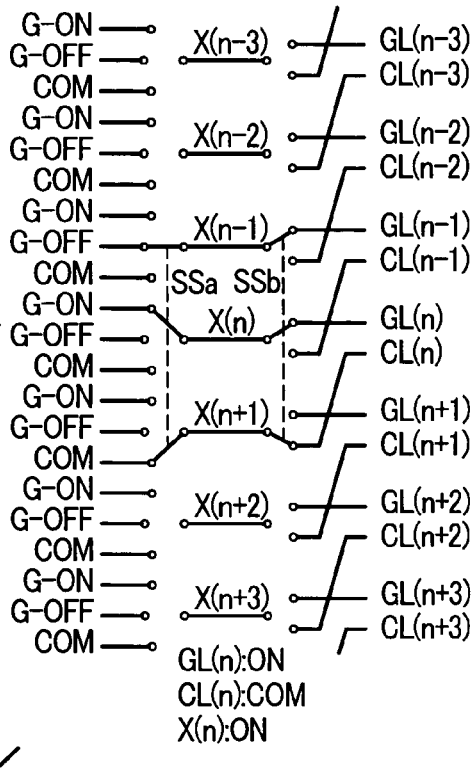

In the next stage, as shown in FIG. 36B, in a state in which the respective connection relationships of the input side and output side of the scanning switches SSa, SSb with the terminals X are maintained, the scanning switches SSa, SSb are shifted to the next lines as is. In the drawing, the terminal X(n−1) is connected to the terminal to which the G-OFF signal is supplied by way of the scanning switch SSa, the terminal X(n) is connected to the terminal to which the G-ON signal is supplied by way of the scanning switch SSa, and the terminal X(n+1) is connected to the terminal to which the COM signal is supplied by way of the scanning switch SSa. Here, to other terminals X except for the above-mentioned terminals, none of the G-ON signal, the G-OFF signal and the COM signal is supplied.

Further, with respect to the case shown in FIG. 36B, the G-OFF signal from the terminal X(n−1) is supplied to the gate signal line GL(n−1) by way of the scanning switch SSb, the G-ON signal from the terminal X(n) is supplied to the gate signal line GL(n) by way of the scanning switch SSb, and the COM signal from the terminal X(n+1) is supplied to the counter voltage signal line CL(n) by way of the scanning switch SSb.

From the above, to the nth gate signal line GL(n), the G-ON signal is supplied, while to the counter voltage signal line CL(n), the COM signal is supplied.

Figure 36C:
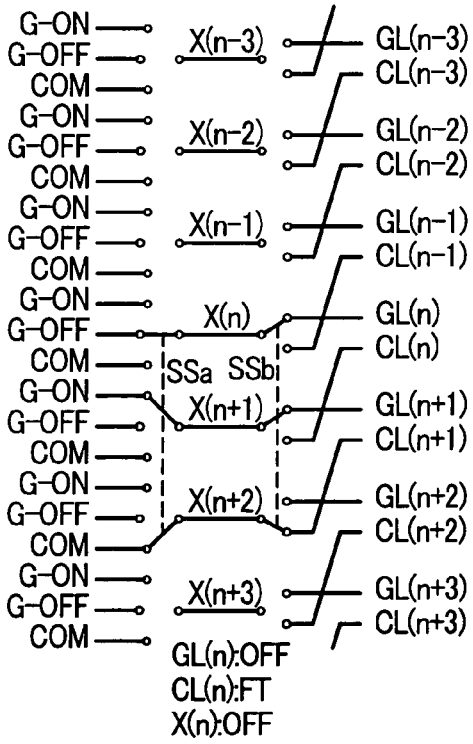

Also in the next stage, as shown in FIG. 36C, in a state in which the respective connection relationships of the input side and output side of the scanning switches SSa, SSb with the terminals X are maintained, the scanning switches SSa, SSb are shifted to the next lines as is. In the drawing, the terminal X(n) is connected to the terminal to which the G-OFF signal is supplied by way of the scanning switch SSa, the terminal X(n+1) is connected to the terminal to which the G-ON signal is supplied by way of the scanning switch SSa, and the terminal X(n+2) is connected to the terminal to which the COM signal is supplied by way of the scanning switch SSa. Here, to other terminals X except for the above-mentioned terminals, none of the G-ON signal, the G-OFF signal and the COM signal is supplied.

Further, with respect to the case shown in FIG. 36C, the G-OFF signal from the terminal X(n) is supplied to the gate signal line G(n) by way of the scanning switch SSb, the G-ON signal from the terminal X(n+1) is supplied to the gate signal line GL(n+1) by way of the scanning switch SSb, and the COM signal from the terminal X(n+2) is supplied to the counter voltage signal line CL(n+1) by way of the scanning switch SSb.

From the above, the (n+2)th gate signal line GL(n+2) and the counter voltage signal line CL(n+2) which come next assume a floating state.

Figure 36D:
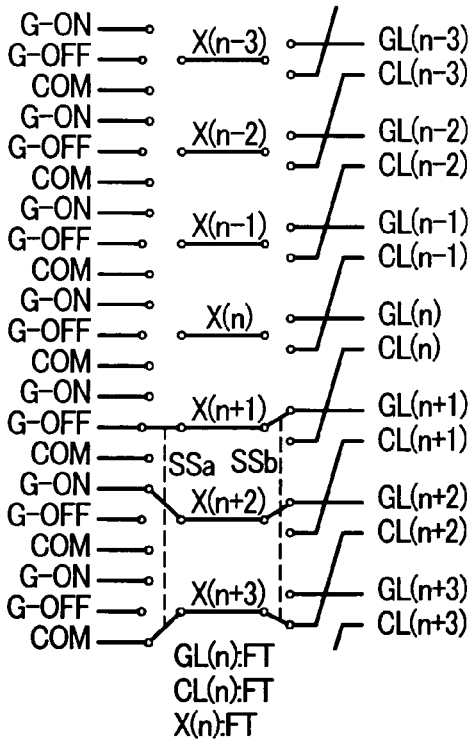

Also in the next stage, as shown in FIG. 36D, in a state in which the respective connection relationships of the input side and output side of the scanning switches SSa, SSb with the terminals X are maintained, the scanning switches SSa, SSb are shifted to the next lines as is. In the drawing, the terminal X(n+1) is connected to the terminal to which the G-OFF signal is supplied by way of the scanning switch SSa, the terminal X(n+2) is connected to the terminal to which the G-ON signal is supplied by way of the scanning switch SSa, and the terminal X(n+3) is connected to the terminal to which the COM signal is supplied by way of the scanning switch SSa. Here, to other terminals X except for the above-mentioned terminals, none of the G-ON signal, the G-OFF signal and the COM signal is supplied.

Further, with respect to the case shown in FIG. 36D, the G-OFF signal from the terminal X(n+1) is supplied to the gate signal line GL(n+1) by way of the scanning switch SSb, the G-ON signal from the terminal X(n+2) is supplied to the gate signal line GL(n+2) by way of the scanning switch SSb, and the COM signal from the terminal X(n+3) is supplied to the counter voltage signal line CL(n+2) by way of the scanning switch SSb.

From the above, the (n+3)th gate signal line GL(n+3) which comes next assumes a floating state and the G-ON signal and the COM signal are respectively supplied to the counter voltage signal line CL(n+3).

Then, the above-mentioned operation is repeated, wherein the scanning switches SSa, SSb are shifted while maintaining the above-mentioned relationships even when the operation advances from the lowermost line to the uppermost line.

Here, in FIGS. 35A to 35D and FIGS. 36A to 36D, the timing at which the G-ON signal, the G-OFF signal and the COM (counter voltage) signal are respectively supplied to the respective gate signal lines GL and the respective counter voltage signal lines CL from the terminals is indicated by the operation of the scanning switches SSa, SSb to facilitate an understanding of the signal supply timing. However, it is needless to say that any constitution is applicable including a constitution which uses a transistor circuit or the like, for example.

Embodiment 27

Figure 37A:
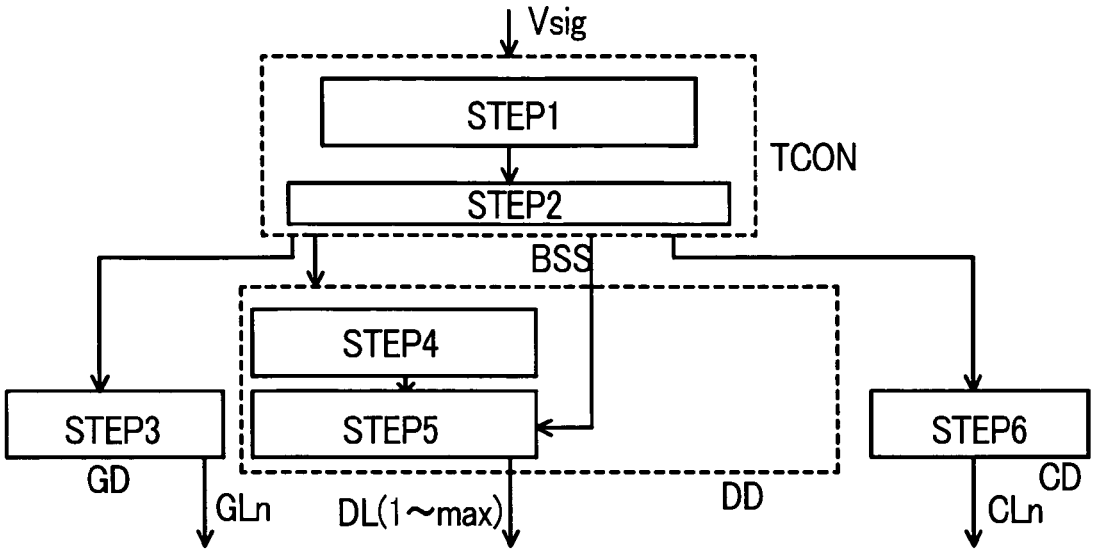
FIG. 37A is a flow chart of another embodiment of the liquid crystal display device according to the present invention and FIGS. 37B to 37D are diagrams showing a control until an image signal from the outside is outputted through respective drivers.

FIG. 37A is a flow chart showing control signals supplied to a gate driver GD, a drain driver DL and a common driver of the liquid crystal display device according to another embodiment of the present invention.

For example, as explained in conjunction with the embodiment (embodiment 21) shown in FIGS. 28A to 28C, when a region having bright luminance and a region having dark luminance are present in a liquid crystal display part AR, signals which differ corresponding to respective regions are outputted to the respective drain signal lines DL. That is, voltages of video signals D differ corresponding to respective regions and hence, loads applied to the drain signal lines DL differ corresponding to the regions. Here, the difference in load means a difference in the required electric current.

In the related art, a maximum load is estimated in advance and a circuit is driven with an equal bias electric current. However, in this case, the electric current which exceeds a necessary amount is also supplied to a region which can be driven with a low electric current and hence, an electric current is wastefully consumed, thus increasing the power consumption.

In view of the above, according to this embodiment, a bias current is controlled in response to the apparent load capacities for respective regions of the liquid crystal display part AR so as to realize a reduction of the power consumption.

In this case, although the constitution explained in this embodiment may be used in a single form, as explained in conjunction with the above-mentioned embodiments, the constitution exhibits a particularly remarkable advantageous effect when the constitution is used in combination with the technique to make the gate signal lines GL and the counter voltage signal lines CL assume a floating state simultaneously.

This is because, while the load of video signals D is in a heavy state in the related art, by making the gate signal lines GL and the counter voltage signal lines CL assume a floating state respectively during most of the OFF period of these signals, the load of the video signals can be drastically reduced to one several hundredth ideally. Accordingly, it is possible to control the bias current for every region with high accuracy, thus realizing a further reduction of the power consumption of the video signal drive circuit He.

Figure 37B:
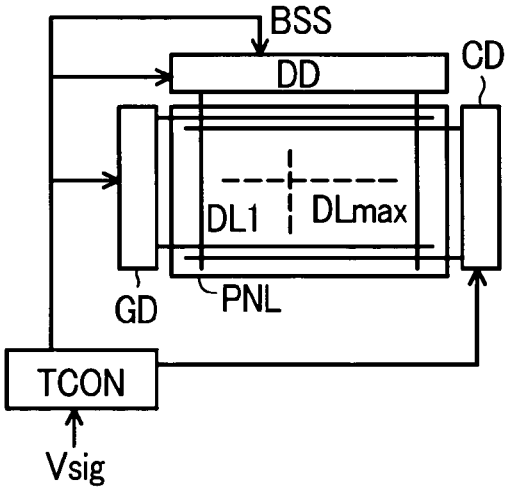

In FIG. 37A, first of all, a video signal Vsig is inputted to a video control circuit TCON from the outside. As shown in FIG. 37B, the video control circuit TCON is configured to supply signals to the gate driver GD, the drain driver DD and the common driver CD of a liquid crystal display panel PNL respectively. Here, in this embodiment, as shown in the drawing, a bias amount instruction signal BSS is configured to be inputted to the drain driver DD.

The video control circuit TCON to which the video signal Vsig is inputted, first of all, measures the data of the video signal Vsig in step 1. Then, in step 2, a necessary bias current is calculated based on the measured data.

Here, the calculation of the necessary bias current may set the necessary bias current based on a value of the video signal D. For example, it is possible to adopt a current which is proportional to a voltage value determined by the video signal D as a value of the bias current.

In transmitting the signal from the video control circuit TCON to the gate driver GD, in step 3, a next gate signal line GL is selected in response to a synchronizing signal contained in the video signal Vsig.

Then, in transmitting the signal from the video control circuit TCON to the drain driver DD, in step 4, first of all, the video signals D for respective lines transferred from the video control circuit TCON are stored.

Next, in step 5, the bias current for output amplifiers corresponding to respective video signal lines DL is set and the respective video signals D are outputted in response to the synchronizing signal.

Further, in step 6, in transmitting the signal from the video control circuit TCON to the gate driver GD, a next counter voltage signal line CL is selected in response to a synchronizing signal contained in the video signal Vsig.

As another embodiment, when the embodiment is applied to the constitution which makes the counter voltage signal line CL assume a floating state, it is needless to say that, as explained in conjunction with the above-mentioned embodiments, the amount of change of the counter voltage signal in the counter voltage signal lines corresponding to the sum of respective drain signal lines DL is calculated and a value of the above-mentioned bias amount instruction signal BSS may be determined by taking the influence of the change quantity of the counter voltage signals into consideration.

Further, it is needless to say that the constitution of this embodiment may be used in combination with the constitution shown in the embodiment 21 which controls the potentials of the counter voltage signals in the respective counter voltage signal lines CL in response to the data of the drain signal line DL.

Figure 37C:
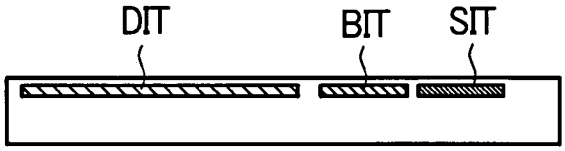
Figure 37D:
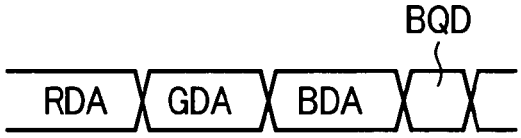

Here, in this embodiment, it is needless to say that the above-mentioned bias amount instruction signal from the video control circuit TCON to the drain driver DD may be configured to be inputted to a bias amount input terminal BIT which is additionally provided to the drain driver DD as shown in FIG. 37C, or a transfer period for bias amount data BQD may be contained in data which is transmitted to the drain driver DD from the video control circuit TCON as shown in FIG. 37D.

In FIG. 37C, symbol DIT indicates a video data input terminal and symbol SIT indicates a synchronizing signal input terminal, while in FIG. 37D, symbols RDA, GDA and BDA respectively indicate red-color data, green-color data and blue-color data.

Embodiment 28

Figure 38A:
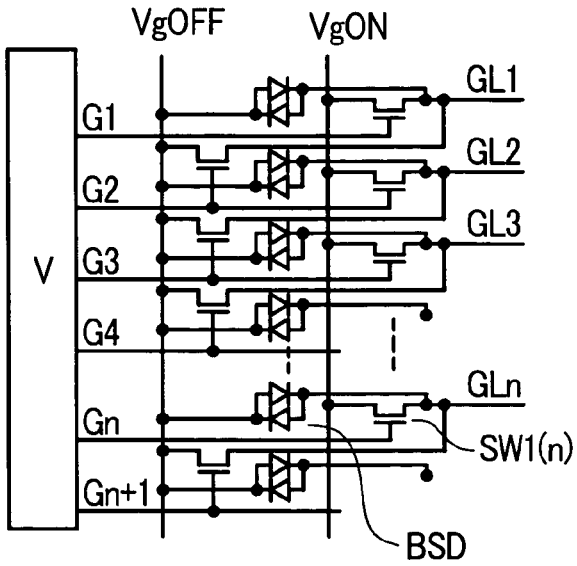
FIGS. 38A and 38B are schematic circuit diagrams of another embodiment of the liquid crystal display device according to the present invention showing a state in which a circuit for coping with static electricity is incorporated in the liquid crystal display device.
Figure 38B:
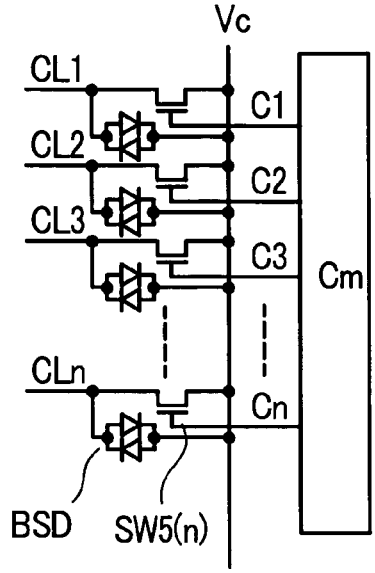

FIG. 38A is a circuit diagram showing another embodiment of the periphery at a gate signal line GL side of a scanning signal drive circuit V and FIG. 38B is a circuit diagram showing another embodiment of the periphery at a counter voltage signal line CL side of a common electrode drive circuit Cm. FIG. 38A and FIG. 38B respectively correspond to FIG. 3A and FIG. 4.

As explained in conjunction with the embodiment shown in FIG. 3A and FIG. 4, in the structure which makes most of the portions of the gate signal lines GL and the counter voltage signal lines CL assume a floating state, when the switches SW1, SW5 are not turned on, the signal lines become independent from each other and hence, the structure is fragile against static electricity from the outside. Accordingly, the disconnection or the fluctuation of a threshold value is liable to easily occur due to the static electricity during the manufacturing process. Accordingly, to realize easy manufacture of the liquid crystal display device, it is necessary to take countermeasures to cope with static electricity.

According to the embodiment shown in FIGS. 38A and 38B, in a liquid crystal display device having the structure in which signal lines in the inside of a liquid crystal display part AR assume a floating state, by connecting respective signal lines to a common line using diodes, when the static electricity infiltrates, a rapid dispersion of the static electricity is realized thus providing the strong countermeasure against the static electricity.

That is, in FIG. 38A, to take a gate signal line GLn as an example among respective gate signal lines GL, a connecting portion of a switch SW1(*n*) of the gate signal line GLn and a signal line VgOFF are connected by a double-way diode BSD. Further, in FIG. 38B, to take a counter voltage signal line CLn as an example among respective counter voltage signal lines CL, a connecting portion of a switch SW5(*n*) of the counter voltage signal line CLn and a signal line Vc are connected by a double-way diode BSD.

Due to such a constitution, as shown in FIG. 38A, when a high voltage is applied to the gate signal line GL, it is possible to rapidly release the high voltage from the gate signal line GL to the signal line VgOFF. Further, by adopting the double-way diode BSD as an element which connects the gate signal line GL and the signal line VgOFF, it is possible to cope with static electricity irrespective of the polarity of the static electricity. However, it is needless to say that in place of the double-way diode BSD, diodes having polarities opposite to each other or a one-way diode may be used.

In this embodiment, as the signal line for releasing the high voltage, the signal line VgOFF is used to enhance the stability of the operation. However, it is needless to say that a data bus line dedicated to the static electricity is provided and wiring layers formed of a signal line VgON and the dedicated bus line may be used.

Further, as shown in FIG. 38B, also when a high voltage is applied to the counter voltage signal line CL, it is possible to rapidly release the high voltage from the counter voltage signal line CL to the signal line Vc. Also in this case, it is needless to say that a bus line dedicated to static electricity is provided and the bus line is used in place of the signal line Vc.

Figure 39A:
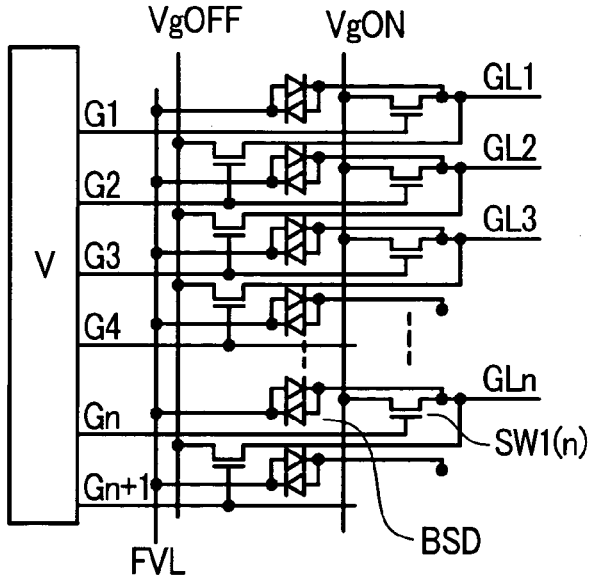
FIGS. 39A and 39B are schematic circuit diagrams of another embodiment of the liquid crystal display device according to the present invention showing a state in which a circuit for coping with static electricity is incorporated in the liquid crystal display device.
Figure 39B:
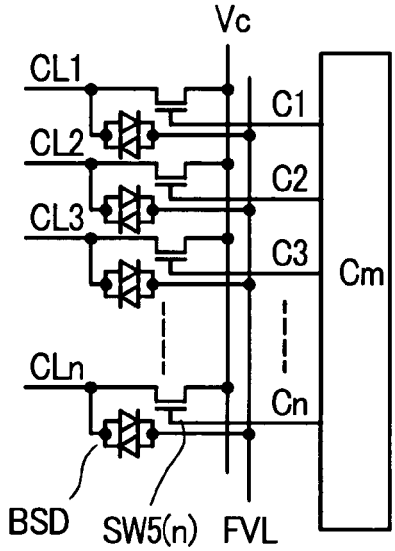

FIG. 39A and FIG. 39B are views showing another embodiment when a floating voltage line FVL is used in place of the above-mentioned dedicated bus line.

Due to such a constitution, while taking a countermeasure against static electricity, it is also possible to simultaneously obtain an advantageous effect in that the fluctuation of the potential of the gate signal line GL or the counter voltage signal line CL in a floating state can be suppressed and hence, the potential can be stabilized.

In this case, to maintain the OFF state of the thin film transistor TFT, it is desirable to set the potential of the floating voltage line FVL at the gate signal line GL side to be smaller than the potential of the floating voltage line FVL at the counter voltage signal line CL side.

Figure 40:
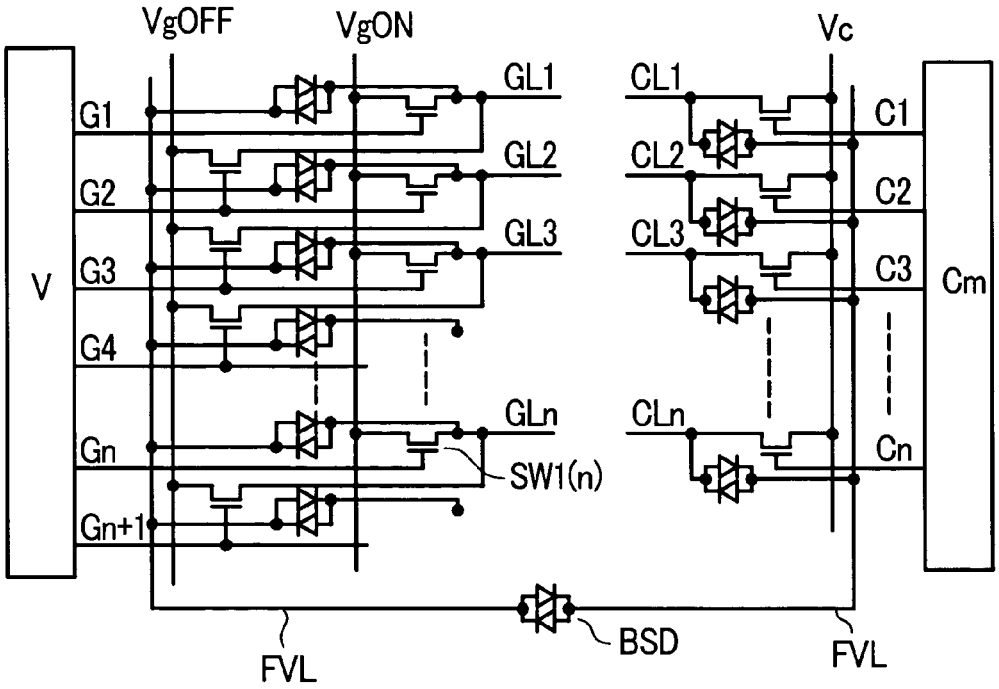
FIG. 40 is a schematic circuit diagram of another embodiment of the liquid crystal display device according to the present invention showing a state in which a circuit for coping with static electricity is incorporated in the liquid crystal display device.

Further, FIG. 40 is a circuit diagram showing another embodiment. Here, when a floating voltage line FVL, for example, is used as another bus line, as shown in FIG. 39A and FIG. 39B, it is needless to say that the floating voltage line FVL at the gate signal line GL side and the floating voltage line FVL at the counter voltage signal line CL side are connected to each other by a double-way diode BSD.

Figure 41:
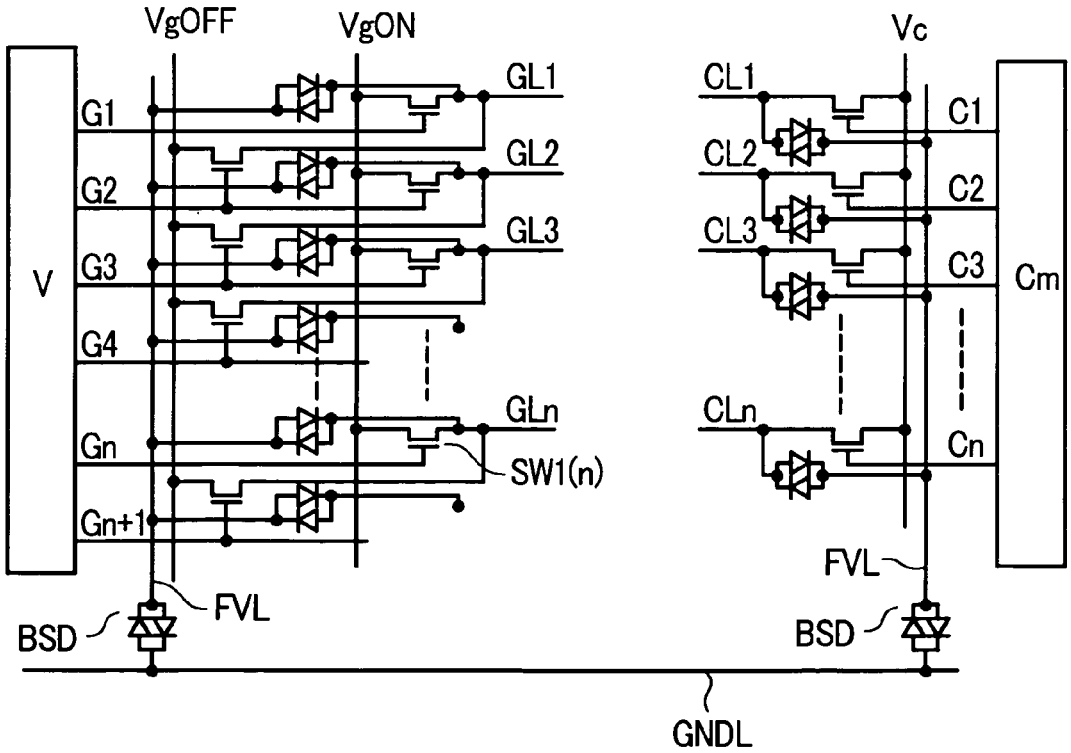
FIG. 41 is a schematic circuit diagram of another embodiment of the liquid crystal display device according to the present invention showing a state in which a circuit for coping with static electricity is incorporated in the liquid crystal display device.

Further, FIG. 41 is also a circuit diagram showing another embodiment. In this embodiment, a floating voltage line FVL at a gate signal line GL side is connected to a GND line GNDL by way of a double-way diode BSD and, at the same time, a floating voltage line FVL at a counter voltage signal line CL side is also connected to the GND line GNDL by way of other double-way diode BSD. Due to such a constitution, a circuit which can more effectively cope with static electricity can be realized.

Figure 42A:
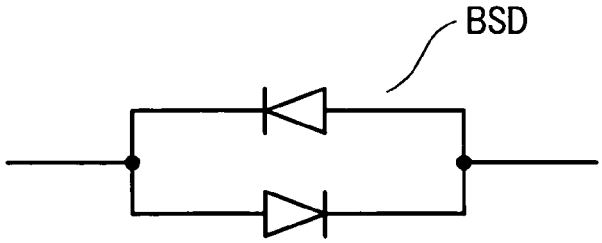
FIG. 42A is a schematic circuit diagram of another embodiment of the liquid crystal display device according to the present invention.

Here, the double-way diode BSD is constituted of the equivalent circuit shown in FIG. 42A. That is, the double-way diode BSD is constituted by connecting a pair of respective diodes in parallel while changing their polarities. Although such a double-way diode BSD may be constituted by being incorporated into a semiconductor chip which constitutes a driver, the double-way diode may be formed on a surface of a transparent substrate SUB1 separately from the driver.

Figure 42B:
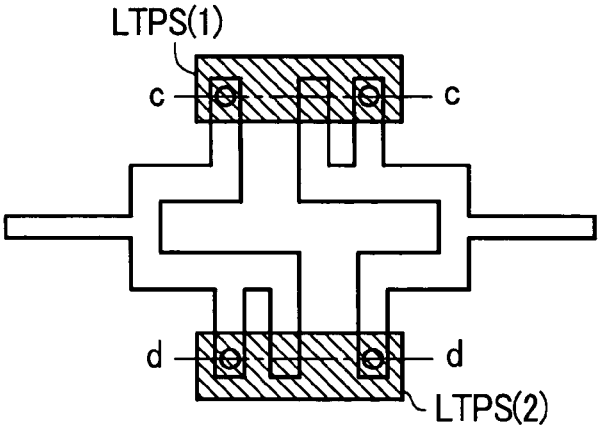
FIG. 42B is a plan view showing the constitution of a double-way diode incorporated into a circuit for coping with static electricity.

In the latter case, the double-way diode may be configured as shown in FIG. 42B, for example. FIG. 42B is a plan view and is depicted by making the view geometrically correspond to the equivalent circuit shown in FIG. 42A.

In FIG. 42A, one diode is formed at the upper side in the drawing and this diode uses one end of a semiconductor layer LTPS(1) at the left side in the drawing as a cathode and another end of the semiconductor layer LTPS(1) at the right side in the drawing as an anode. Here, between the cathode and the anode, a gate electrode is formed on the semiconductor layer LTPS(1) by way of an insulation film and the gate electrode is connected to the anode. Further, another diode is formed at the lower side in the drawing and this diode uses one end of a semiconductor layer LTPS(2) at the left side in the drawing as an anode and another end of the semiconductor layer LTPS(2) at the right side in the drawing as a cathode. Here, between the anode and the cathode, a gate electrode is formed on the semiconductor layer LTPS(2) by way of an insulation film and the gate electrode is connected to the cathode.

Figure 42C:
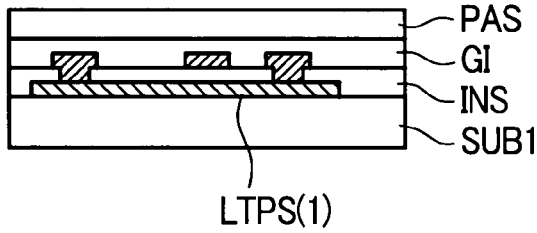
FIG. 42C is a cross-sectional view taken along line c-c and FIG. 42D is a cross-sectional view taken along line d-d in FIG. 42B.
Figure 42D:
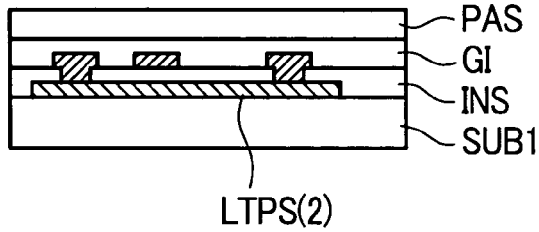

FIG. 42C is a cross-sectional view taken along a line c-c in FIG. 42B and FIG. 42D is a cross-sectional view taken along a line d-d in FIG. 42B. Here, as the insulation films which are interposed between the respective semiconductor layers LTPS(1), LTPS(2) and the respective gate electrodes which are formed over the respective semiconductor layers LTPS(1), LTPS(2), the above-mentioned first insulation film INS is used.

Since the double-way diode BSD is formed in parallel to the thin film transistor TFT in the inside of the pixel of the liquid crystal display device, the double-way diode BSD has substantially the same constitution with the thin film transistor TFT with respect to the laminar structure. The difference merely lies in the fact that the gate electrode is connected to the anode or the cathode of the diode.

The double-way diode BSD having such a constitution can use one potential of the wiring layer as the gate electrode potential at is and hence, the double-way diode BSD can be turned on only when the high voltage is applied. Further, by reversing the wiring layer which is used as the gate electrode, the polarity can be reversed.

Further, to reduce the leakage current during normal operation, it is desirable to form the wiring layer by the gate electrode layer. In performing ion implantation for reducing the resistance of the semiconductor layer, ions are not implanted to a region below the wiring layer and hence, the layer assumes the high resistance state whereby leaking of current from the vicinity of a through hole to a region where the ions are implanted can be reduced. Further, when the semiconductor layer is made of amorphous silicon, by preventing the extension of the distance of the gate electrode to the region below the through hole, a high resistance region can be formed.

Further, various modes are conceivable and it is sufficient when these modes have the structure which can release the high voltage when the high voltage is applied.

Embodiment 29

As a pixel of the liquid crystal display device, there has been known a pixel which forms a pixel electrode and a counter electrode which generates an electric field between the pixel electrode and the counter electrode on a liquid-crystal-side surface of one substrate of a pair of substrates which are arranged to face each other with liquid crystal disposed therebetween.

The pixel is configured to control the optical transmissivity of the liquid crystal in response to the electric field which is generated between the pixel electrode and the counter electrode and has a component parallel to the substrate.

Further, in a so-called multi-domain type liquid crystal display device which forms regions having different directions of electric field within a region of each pixel and which compensates for coloring of an image depending on viewing angles, there has been known a liquid crystal display device which adopts a design for transmitting the behavior of the liquid crystal (rotation of liquid crystal molecules) in respective regions from one end side which has a relatively strong electric field to another side. This is because that there may be a case in which only with the electric field generated between the pixel electrode and the counter electrode which are arranged in parallel, the force which rotates the liquid crystal molecules is weak.

However, with respect to the pixel having such a constitution, since the behavior of the liquid crystal is transmitted from one end side having the relatively strong electric field to the other end, the response speed is slow and hence, it has been found that an enhancement of the response speed is demanded.

Further, with respect to the pixel disclosed in U.S. Pat. No. 6,266,116, one electrode has another end portion which extends while having the same width at the other end. With respect to the pixel disclosed in U.S. Pat. No. 6,266,116, it has been pointed out that the direction of an electric field which is generated between another end portion and another electrode is relatively non-uniform and hence, a so-called domain region is generated in such a portion whereby it is necessary to perform light shielding thus narrowing the so-called numerical aperture of the pixel.

The following embodiments including this embodiment provide a liquid crystal display device having pixels which can enhance the response speed of the liquid crystal.

Further, this embodiment provides a liquid crystal display device which can enhance the numerical aperture of the pixels.

A summary of typical embodiments is as follows.

Example (A)

The liquid crystal display device according to this embodiment includes, for example, a first region and a second region which are formed by dividing a pixel region, wherein each region is formed by being surrounded by first and second electrodes, first and second electrodes have an elongated first electrode portion and a short second electrode portion, the first electrode portion and the second electrode portion are connected to each other with a relationship such that the first electrode portion and the second electrode portion make an obtuse angle therebetween, the respective second electrode portions of the first electrode and the second electrode are arranged at sides which are remotest from each other in the inside of each region, and the obtuse angle is formed at sides different from each other in the first region and the second region.

Example (B)

The liquid crystal display device according to this embodiment is, for example, on the premise of the constitution of the Example (A), characterized in that the respective obtuse angles are positioned at sides different from each other with respect to the initial orientation direction.

Example (C)

The liquid crystal display device according to this embodiment includes, for example, a first region and a second region which are formed by dividing a pixel region, wherein each region includes first and second electrodes, each region includes a main region in which the first electrode and the second electrode extend in parallel and an auxiliary region in which the first and second electrodes gradually approach each other, the auxiliary regions are arranged at both ends of the pixel region and are arranged to gradually approach in the inverse direction, and the first region and the second region are formed in a substantially line symmetry.

Example (D)

The liquid crystal display device according to this embodiment includes, for example, a pixel electrode and a counter electrode which generates an electric field therebetween in each pixel region and each pixel includes at least two sectional regions which are surrounded by the pixel electrode and the counter electrode, wherein the respective sectional regions have a diamond shape and the sectional regions are formed while having a back-to-back relationship and having a line symmetry with respect to the initial orientation direction of the liquid crystal, in each sectional region, a first side which has a back-to-back relationship with another sectional region and a second side which intersects the first side with an opening of an obtuse angle at one-direction-side end portion of the first side are formed by either one of the pixel electrode and the counter electrode by framing, and a third side which is arranged parallel to the first side and a fourth side which intersects the third side with an opening of an obtuse angle at an end portion opposite to the one end direction side of the third side are framed by another one of the pixel electrode and the counter electrode.

Example (E)

The liquid crystal display device according to this embodiment is, for example, on the premise of the constitution of the Example (D), characterized in that respective lengths of the first side and the third side of each sectional region are set larger than a distance between the first side and the third side.

Example (F)

The liquid crystal display device according to this embodiment is, for example, on the premise of the constitution of the Example D, characterized in that a video signal is supplied to the pixel electrode from a drain signal line through a thin film transistor and the drain signal line is formed by being substantially aligned with the initial orientation direction of the liquid crystal.

Example (G)

The liquid crystal display device according to this embodiment is, for example, on the premise of the constitution of the Example (D), characterized in that the electrodes which frame the first sides of the respective sectional regions are constituted as common electrodes in the respective sectional regions.

Example (H)

The liquid crystal display device according to this embodiment is, for example, on the premise of the constitution of the Example (D), characterized in that the respective sectional regions which are formed in the back-to-back relationship and in the line symmetry are formed in a plural number along the initial orientation direction of liquid crystal and electrodes which frame the first side and the second side of each sectional region are integrally constituted and, further, electrodes which frame the third side and the fourth side of each sectional region are integrally constituted.

Example (I)

The liquid crystal display device according to this embodiment is, for example, on the premise of the constitution of the Example (D), characterized in that a video signal is supplied to the pixel electrode from a drain signal line through a thin film transistor, the drain signal line is substantially aligned with the initial orientation direction of liquid crystal, and the second side of each sectional region is positioned at a video-signal-line supply side of the drain signal line.

Example (J)

The liquid crystal display device according to this embodiment is, for example, on the premise of the constitution of the Example (D), characterized in that a video signal is supplied to the pixel electrode from a drain signal line through a thin film transistor, the drain signal line is substantially aligned with the initial orientation direction of liquid crystal, and the fourth side of each sectional region is positioned at a video-signal-line supply side of the drain signal line.

Example (K)

The liquid crystal display device according to this embodiment is, for example, on the premise of the constitution of the Example (D), characterized in that the electrodes which frame the first side and the second side of each sectional region are pixel electrodes and the electrodes which frames the third side and the fourth side of each sectional region are counter electrodes.

Example (L)

The liquid crystal display device according to this embodiment is, for example, on the premise of the constitution of the Example (K), characterized in that a video signal is supplied to the pixel electrode from a drain signal line through a thin film transistor, the drain signal line is substantially aligned with the initial orientation direction of liquid crystal, and the counter electrode is formed such that the counter electrode covers the drain signal line by way of an insulation film.

Example (M)

The liquid crystal display device according to this embodiment is, for example, on the premise of the constitution of the Example (L), characterized in that the counter electrode is constituted of a light transmitting conductive layer.

Hereinafter, this embodiment will be explained in detail in conjunction with the drawings.

Figure 43A:
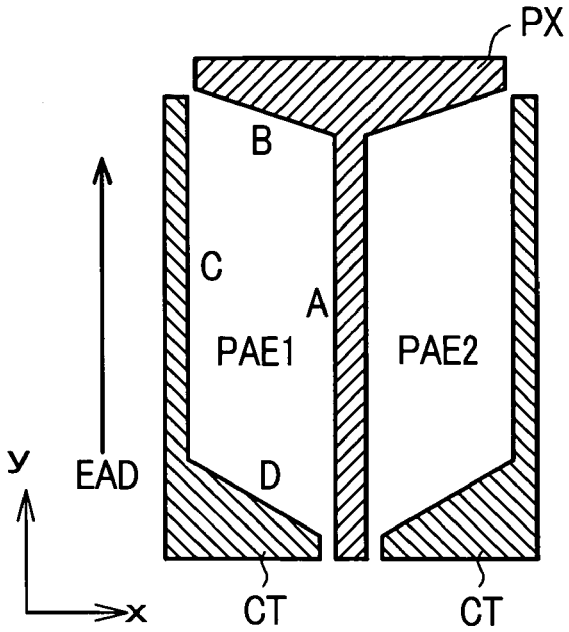
FIGS. 43A to 43C are sectional views showing another embodiment of a pixel of the liquid crystal display device according to the present invention and FIG. 43D is a diagram showing basic conditions thereof.

FIG. 43A is a plan view showing another embodiment of the pixel of the liquid crystal display device according to the present invention and is also a view which schematically shows a pattern and an arrangement state of a pixel electrode PX and counter electrodes CT.

In FIG. 43A, the pixel region is configured to have two-split regions in the x direction in the drawing, that is, a first pixel region PAE1 and a second pixel region PAE2.

Here, a gate signal line GL (not shown in the drawing) runs in the x direction in the drawing and a drain signal line DL (not shown in the drawing) runs in the y direction in the drawing. The first pixel region PAE1 and the second pixel region PAE2 are formed in a region surrounded by these signal lines. Here, the so-called initial orientation direction in the pixel is substantially aligned with the y direction in the drawing.

Further, the first pixel region PAE1 and the second pixel region PAE2 respectively have a diamond shape which is elongated in the y direction. The first pixel region PAE1 has a left side and lower side thereof defined by the counter electrode CT in the drawing and has a right side and an upper side thereof defined by the pixel electrode PX in the drawing. Further, the second pixel region PAE2 has a left side and an upper side thereof defined by the pixel electrode PX in the drawing and has a right side and a lower side thereof defined by the counter electrode CL in the drawing.

In this embodiment, the pixel electrode PX in the first pixel region PAE1 and the pixel electrode PX in the second pixel region PAE2 are formed in common at a portion which partitions the first pixel region PAE1 and the second pixel region PAE2.

Then, as shown in the drawing, in the first pixel region PAE1, assuming the right side thereof which also constitutes the side of the pixel electrode PX as a first side portion A and the upper side thereof which also constitutes the side of the pixel electrode PX as a second side portion B, an angle made by the first side portion A and the second side portion B is set to an obtuse angle (>90°). Further, assuming the left side thereof which also constitutes the side of the counter electrode CT as a third side portion C and the lower side thereof which also constitutes the side of the counter electrode CT as a fourth side portion D, an angle made by the third side portion C and the fourth side portion D is set to an obtuse angle (>90°). That is, the first pixel region PAE1 forms a diamond-shaped pattern, wherein two sides which form an angle having one obtuse angle out of interior angles are formed by the sides of one electrode and two sides which form an angle having another obtuse angle are formed by the sides of another electrode.

Further, the second pixel region PAE2 has a substantially linear symmetrical relationship in a back-to-back relationship with the first pixel region PAE1 using a center axis of the pixel electrode PX which is used in common with the pixel electrode PX of the first pixel region PAE1 and hence, has substantially the same constitution as the first pixel region PAE1.

Figure 43B:
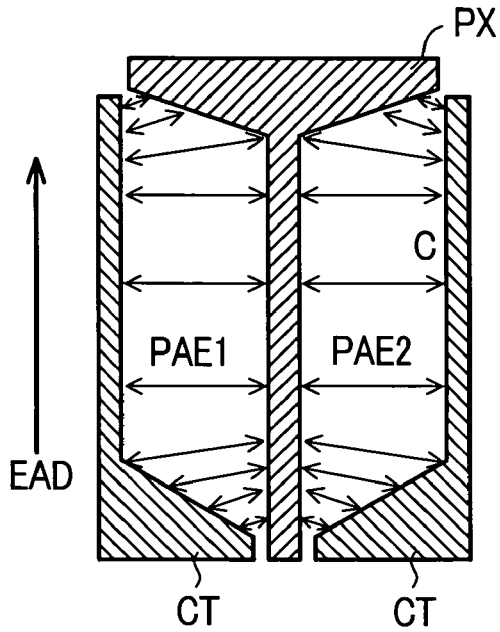
Figure 43D:
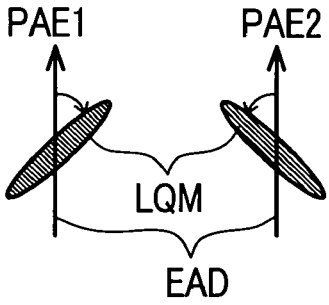

The pixel having the pixel electrode PX and the counter electrode CT having such a pattern exhibits a distribution of an electric field which is generated between the pixel electrode PX and the counter electrode CT as shown in FIG. 43B. In both of the first pixel region PAE1 and the second pixel region PAE2, at respective upper and lower portions thereof, that is, to illustrate with respect to the first pixel region PAE1, at other acute angle portions except for the obtuse angle portion of respective angles of the diamond shape, an electric field is strengthened and, at the same time, the direction of the electric field thereof is also set to facilitate the rotational motion of the liquid crystal molecules LQM due to twisting in one direction as shown in FIG. 43D. Here, in FIG. 43D, symbol EAD indicates the initial orientation direction, a liquid crystal molecule LQM disposed at the left side of the drawing is a liquid crystal molecule in the first pixel region PAE1 and a liquid crystal molecule LQM disposed at the right side of the drawing is a liquid crystal molecule in the second pixel region PAE2.

Figure 43C:
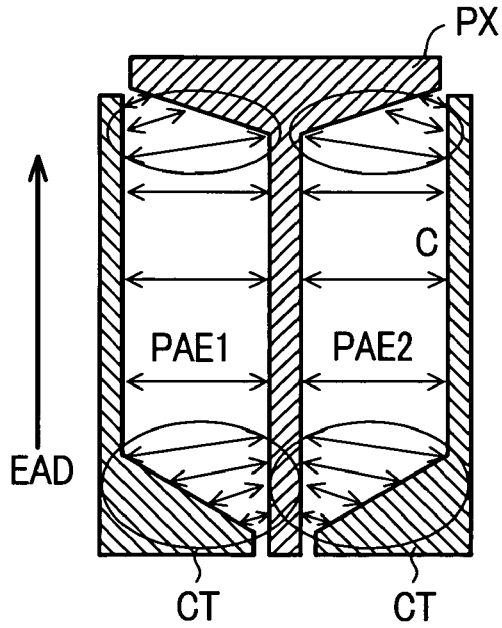

Accordingly, as shown in FIG. 43C, at the above-mentioned upper and lower portions of the first pixel region PAE1 and the second pixel region PAE2, that is, at the respective regions which are surrounded by a circle, the liquid crystal molecules LQM in the inside of the regions are driven in a high electric field and hence, the rotational motion due to twisting in one direction defined in the respective regions is directly succeeded by other regions (regions at the center of the pixels) except for respective regions whereby driving of normal liquid crystal molecules at a high speed can be achieved and the generation of smears can be suppressed.

Further, the lengths of the first side portion A and the second side portion C in the first pixel region PAE1 and the second pixel region PAE2 are set relatively long compared to the distance between the sides and the first side portion A and the second side portion C are arranged in parallel and hence, it is possible to obtain an advantageous effect in that the manufacture is facilitated and the yield rate is enhanced.

Further, at the time of performing the orientation treatment, the extension direction of the electrodes corresponding to the first side portion A and the second side portion C is arranged substantially parallel to the initial orientation direction EAD and hence, the orientation treatment can be performed easily and surely and the initial orientation direction is stabilized whereby it is possible to obtain an advantageous effect in that the contrast ratio can be enhanced.

Further, with respect to the respective pixel regions PAE1, PAE2 having such a constitution, the normal behavior of the liquid crystal molecules is ensured at any portions in the inside of these regions and hence, for example, portions which become the so-called domain regions can be eliminated. Accordingly, in these regions, portions which are blocked from light by other members such as black matrixes BM, for example, or the like can be eliminated.

In the explanation of this embodiment, the liquid crystal display device is configured such that the electrode which runs at the center of the pixel is used as the pixel electrode PX and the electrodes which are arranged at both sides of the pixel electrode PX are used as the counter electrodes CT. However, it is needless to say that the pixel electrode PX and the counter electrode CT may be respectively constituted as the counter electrode CT and the pixel electrode PX.

Embodiment 30

Figure 44A:
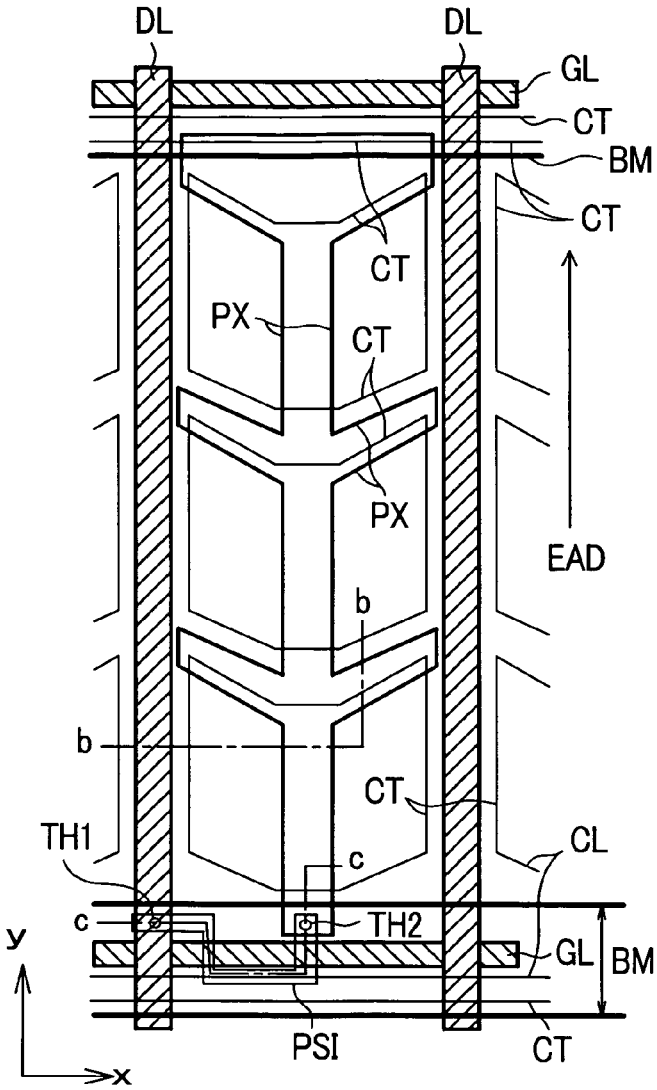
FIG. 44A is a plan view showing another embodiment of a pixel of the liquid crystal display device according to the present invention.
Figure 44B:
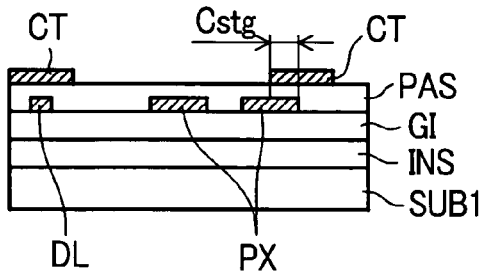
FIG. 44B is a cross-sectional view taken along line b-b and FIG. 44C is a cross-sectional view taken along line c-c in FIG. 44A.
Figure 44C:
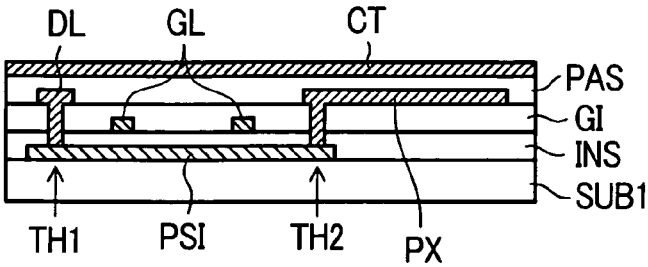

Further, FIG. 44A is a plan view showing one embodiment of a pixel of the liquid crystal display device according to the present invention. FIG. 44B is a cross-sectional view taken along a line b-b in FIG. 44A and FIG. 44C is a cross-sectional view taken along a line c-c in FIG. 44A.

In the drawing, first of all, a semiconductor layer PSI constituted of a polysilicon layer, for example, is formed on a liquid-crystal-side surface of the transparent substrate SUB1. The semiconductor layer PSI is, for example, formed by polycrystallizing an amorphous Si film which is formed by a plasma CVD device using an excimer laser.

The semiconductor layer PSI is a semiconductor layer of a thin film transistor TFT and is formed in a roundabout pattern which traverses a gate signal line GL described later twice, for example.

Then, on a surface of the transparent substrate SUB1 on which the semiconductor layer PSI is formed, a first insulation film INS which is made of $SiO_2$ or SiN, for example, is formed such that the first insulation film INS also covers the semiconductor layer PSI.

The first insulation film INS functions as a gate insulation film of the thin film transistor TFT.

Then, on an upper surface of the first insulation film INS, gate signal lines GL which extend in the x direction and are arranged in parallel in the y direction in the drawing are formed and these gate signal lines GL define rectangular pixel regions together with drain signal lines DL to be described later.

The gate signal lines GL run such that the gate signal line GL traverses the semiconductor layer PSI twice and a portion which traverses the semiconductor layer PSI functions as a gate electrode of the thin film transistor TFT.

Here, after the formation of the gate signal line GL, the ion implantation of impurities is performed by way of the first insulation film INS so as to make a region of the semiconductor layer PSI except for a region right below the gate signal line GL conductive thus forming a source region and a drain region of the thin film transistor TFT.

A second insulation film GI which is made of $SiO_2$ or SiN, for example, is formed on an upper surface of the first insulation film INS such that the second insulation film GI also covers the gate signal line GL.

On a surface of the second insulation film GI, the drain signal lines DL which extend in the y direction and are arranged in parallel in the x direction are formed. A portion of the drain signal line DL is connected to the semiconductor layer PSI via a through hole TH1 which is formed in a penetrating manner in the second insulation film GI and the first insulation film INS disposed below the drain signal line DL. A portion of the semiconductor layer PSI which is connected with the drain signal line DL is a portion which constitutes one of regions of the thin film transistor TFT, for example, the drain region.

Further, on a surface of the second insulation film GI in the inside of a pixel region which is surrounded by the drain signal lines DL and the gate signal lines GL, a pixel electrode PX is formed. The pixel electrode PX is constituted of a strip-like pattern which runs in the approximate center of the pixel region in the y direction and branch-like patterns which respectively extend from left and right sides of the strip-like pattern.

To explain this constitution in more detail, the pixel electrode PX has one end of the strip-like pattern thereof at the thin film transistor TFT side in the pixel region connected to another region of the thin film transistor TFT, that is, the source region via a through hole TH2 which is formed in a penetrating manner in the third insulation film PAS, the second insulation film GI and the first insulation film INS disposed below the pixel electrode PX.

Further, from the portion which is connected with the source region to another end of the strip-like pattern, in this embodiment, three branch-like patterns which extend from the left and right sides of the strip-like pattern are formed substantially at an equal interval and the extending direction of these branch-like patterns makes an obtuse angle (>90°) with respect to the strip-like pattern.

Here, the distal ends of the branch-like patterns of the pixel electrode PX which are formed on the same layer as the drain signal lines DL are configured to be physically separated to avoid the electrical connection with the drain signal lines DL.

Due to such a constitution, the pixel region which is surrounded by the drain signal lines DL and the gate signal lines GL has six regions which are defined by the pixel electrode PX. These six respective regions form the same functionally independent pixel regions with respect to the relationship with counter electrodes CT described later. This constitution will be explained in detail later.

Here, with respect to the pixel electrode PX, the material thereof may be a metal. However, in this embodiment, the pixel electrode is formed of a light transmitting conductive layer made of ITO (Indium Tin Oxide), ITZO (Indium Tin Zinc Oxide), IZO (Indium Zinc Oxide), $SnO_2$ (Tin Oxide), $In_2O_3$ (Indium Oxide) or the like, for example. These materials are preferable for enhancing the so-called numerical aperture as much as possible.

Further, on the surface of the second insulation film GI, a third insulation film PAS is formed such that the third insulation film PAS also covers the drain signal line DL and the pixel electrode PX. The third insulation film PAS is formed of an organic material such as resin or the like, for example, and constitutes a protective film for avoiding a direct contact of liquid crystal with the thin film transistor TFT together with the second insulation film GI. The reason why the third insulation film PAS is formed of the organic material is for reducing a dielectric constant as a protective film and for flattening the surface.

On an upper surface of the third insulation film PAS, a counter electrodes CT is formed. The counter electrode CT is formed integrally with the counter voltage signal line CL. Although the counter voltage signal line CL is formed to cover the gate signal line GL (lower-side gate signal line GL in the drawing) which drives the thin film transistor TFT in the pixel region, the counter voltage signal line CL is formed without covering another gate signal lines GL (gate signal lines GL at an upper side in the drawing) which is formed in a state such that these gate signal lines GL sandwich the pixel region. This is because that liquid crystal display device is configured such that a counter voltage signal is supplied to the counter voltage signal line CL which is used in common with another pixel arranged in parallel in the x direction in the drawing with respect to the pixel shown in the drawing.

The counter electrode CT is formed such that, first of all, the strip-like pattern of the pixel electrode PX is arranged between the respective counter electrodes CT and the counter electrodes CT are overlapped to respective drain signal lines DL. Due to such a constitution, the drain signal line DL and the counter electrode CT which is overlapped to the drain signal line DL are arranged such that their axes are substantially aligned with each other and the width of the counter electrode CT is set larger than the width of the drain signal line DL. This provision is made for terminating the lines of electric force from the drain signal line DL at the counter electrode CT side and for avoiding the termination of the lines of electric force at the pixel electrode PX side.

Here, in this embodiment, the counter electrode CT which is overlapped to the one-side drain signal line DL and the counter electrode CT which is overlapped to another-side drain signal line DL are connected to each other at the portion where the branch-like pattern of the pixel electrode PX is formed.

That is, in the pixel region, the counter electrode CT assumes a so-called ladder-like pattern and, due to the connecting portions over the branch-like pattern of the pixel electrode PX, six independent pixel regions having the same function are formed by the ladder-like pattern of the counter electrodes CT together with the branch-like pattern of the pixel electrode PX.

Further, to explain the constitution in more detail, the above-mentioned connecting portions (connecting pattern) of the counter electrode CT which is overlapped to the one-side drain signal line DL and the counter electrode CT which is overlapped to another-side drain signal line DL form substantially the same pattern as the branch-like pattern of the above-mentioned pixel electrode PX. However, such a connecting pattern is not completely overlapped to the branch-like pattern and is slightly shifted to the upper side in the drawing (y direction) and hence, a portion of the connecting pattern is overlapped to the branch-like pattern and the rest of the connecting pattern is not overlapped to the branch-like pattern.

Due to this constitution, when observing one divided pixel region, on the upper side of the pixel region, the pixel electrode PX (branch-like pattern) is formed without being overlapped to the counter electrode CT (connecting pattern), while below the pixel region, the counter electrode CT (connecting pattern) is formed without being overlapped to the pixel electrode PX (branch-like pattern). This implies that, the influence of the pixel electrode PX (branch-like pattern) is large at the upper side of the pixel region, while the influence of the counter electrode CT (connecting pattern) is large at the lower side of the pixel region.

That is, this implies that each of respective divided pixel regions obtains an advantageous effect similar to the advantageous effect obtained by the respective pixel regions shown in FIG. 43A.

Accordingly, in the divided pixel region close to the counter voltage signal line CL within the pixel region which is surrounded by the drain signal lines DL and the gate signal lines GL, although there is no connecting pattern which is overlapped to the pixel electrode PX (branch-like pattern), the connecting pattern is formed as if the connecting pattern which is overlapped to the pixel electrode PX (branch-like pattern) is translated or displaced in parallel in the (−) y direction. Similarly, at a side opposite to the side close to the counter voltage signal line CL within the pixel region which is surrounded by the drain signal lines DL and the gate signal lines GL, the divided pixel regions have substantially the same constitution.

In this embodiment, the branch-like pattern of the pixel electrode PX and the connecting pattern of the counter electrode CT are partially overlapped relative to each other for forming capacitive elements Cstg at the overlapped portions.

Further, with respect to the counter electrode CT and the counter voltage signal line CL which are integrally formed, although the material thereof may be a metal, in this embodiment, the pixel electrode is formed of a light transmitting conductive layer made of ITO (Indium Tin Oxide), ITZO (Indium Tin Zinc Oxide), IZO (Indium Zinc Oxide), $SnO_2$ (Tin Oxide), $In_2O_3$ (Indium Oxide) or the like, for example. These materials are used for improving the so-called numerical aperture as much as possible.

Further, in this embodiment, for example, on the liquid-crystal-side surface of the other transparent substrate which is arranged to face the transparent substrate SUB1 in an opposed manner with liquid crystal disposed therebetween, black matrixes BM are formed. The black matrixes BM are formed along the gate signal line GL while covering regions where the thin film transistors TFT are formed.

This black matrixes BM are formed without covering the respective divided pixel regions. As explained above, the liquid crystal can be normally operated at any portions within the respective pixel regions and hence, there is no need to perform light shielding of the portions which may form so-called domain regions.

Then, even when the pixel electrodes PX and the counter electrode CT which define the respective divided pixel regions are used as light-transmitting conductive layers, by using liquid crystal for a normally white mode, for example, the pixel electrodes PX and the counter electrodes CT can perform the function of the light shielding films.

Due to such a constitution, it is possible make the black matrixes BM cover only the thin film transistors TFT and hence, the degradation of the characteristics of the thin film transistor TFT attributed to the irradiation of light can be prevented.

Embodiment 31

Figure 45A:
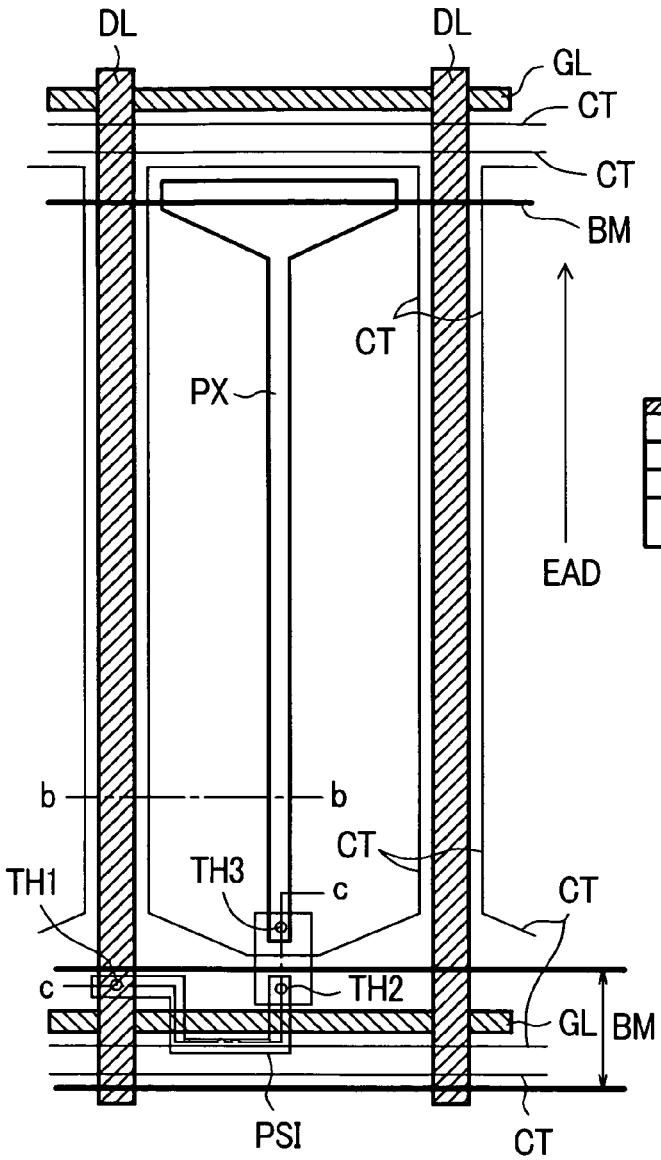
FIG. 45A is a plan view showing another embodiment of a pixel of the liquid crystal display device according to the present invention.
Figure 45B:
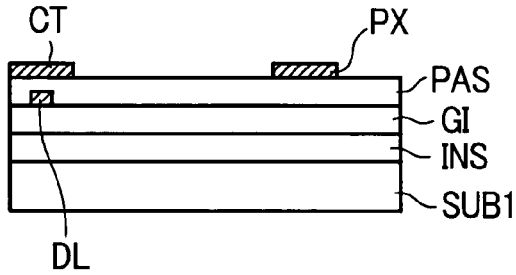
FIG. 45B is a cross-sectional view taken along line b-b and FIG. 45C is a cross-sectional taken alone line c-c in FIG. 45A.
Figure 45C:
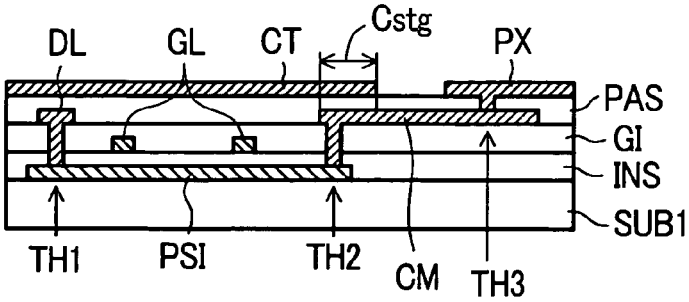

FIG. 45A is a plan view showing another embodiment of the pixel of the liquid crystal display device according to the present invention. Further, FIG. 45B is a cross-sectional view taken along a line b-b in FIG. 45A and FIG. 45C is a cross-sectional view taken along a line c-c in FIG. 45A.

The constitution which makes this embodiment different from the embodiment shown in FIG. 44A lies in the fact that, first of all, the pixel electrodes PX and the counter electrodes CT (the counter voltage signal lines CL) are formed on the same layer and are respectively formed on the surface of the third insulation film PAS.

Then, the pixel region which is surrounded by the drain signal lines CL and the gate signal lines GL is divided into two regions by the pixel electrode PX. That is, the pixel electrode PX extends in the y direction from one end thereof at the gate signal line GL side which drives the thin film transistor TFT and is formed such that the width thereof is gradually increased in an obtuse angle (>90°) state at another end which is adjacent to another gate signal line GL.

On the other hand, the counter electrodes CT, as shown in FIG. 45A, are configured such that the counter electrodes CT extend along the respective drain signal lines DL from the counter voltage signal line CL which covers the gate signal line GL side which drives the thin film transistor TFT and the width thereof is gradually decreased at a connecting portion between the counter electrode CT and the counter voltage signal line CL. Due to such a constitution, the width of the counter electrode CT is gradually increased in an obtuse angle (>90°) state as the counter electrode CT approaches the counter voltage signal line CL. Further, an angle forming the obtuse angle is substantially equal to an angle which increases gradually at another end of the pixel electrode PX.

Here, one end of the pixel electrode PX is connected to a connection line CM which is formed on the second insulation film GI surface via a through hole TH3 which is formed in a penetrating manner in the third insulation film PAS disposed below the one end of the pixel electrode PX. The connection line CM is connected to the source region of the thin film transistor TFT via a through hole TH2 which is formed in a penetrating manner in the second insulation film GI and the first insulation film INS which are disposed under the connection line CM. Here, the connection line CM is configured such that a portion thereof forms an overlapped portion with the counter voltage signal line CL. At this overlapped portion, a capacitive element Cstg which uses the third insulation film PAS as a dielectric film is formed.

In the pixel of the liquid crystal display device having such a constitution, a pixel region surrounded by the drain signal lines DL and the gate signal lines GL is divided into two regions by the pixel electrode PX and the counter electrode CT. Further, in the respective regions, it is possible to obtain the advantageous effects as explained in conjunction with FIGS. 43A to 43D. That is, a strong electric field can be generated in the vicinity of the pixel electrodes PX and the counter electrodes CT and hence, the rotational direction of the liquid crystal on the rest of surface can be controlled by using the strong electric field as a drive force.

Embodiment 32

Figure 46A:
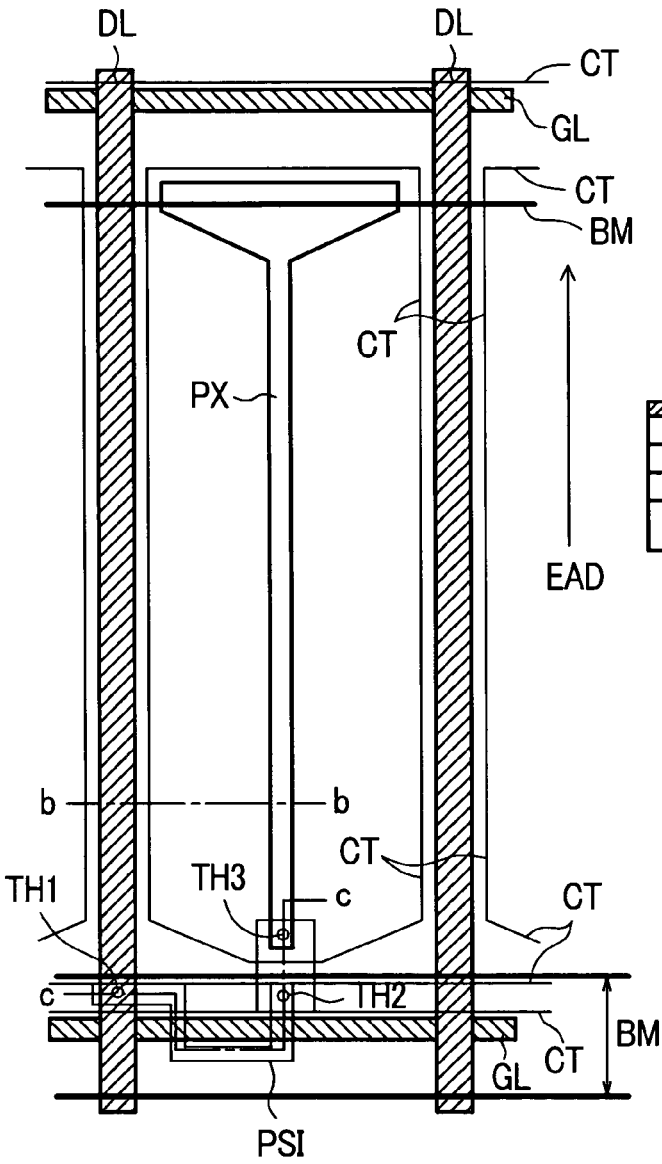
FIG. 46A is a plan view showing another embodiment of a pixel of the liquid crystal display device according to the present invention.
Figure 46B:
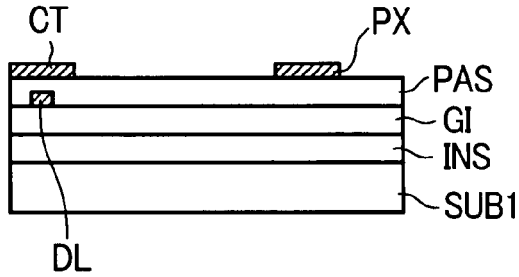
FIG. 46B is a cross-sectional view taken along line b-b and FIG. 46C is a cross-sectional view taken along line c-c in FIG. 46A.
Figure 46C:
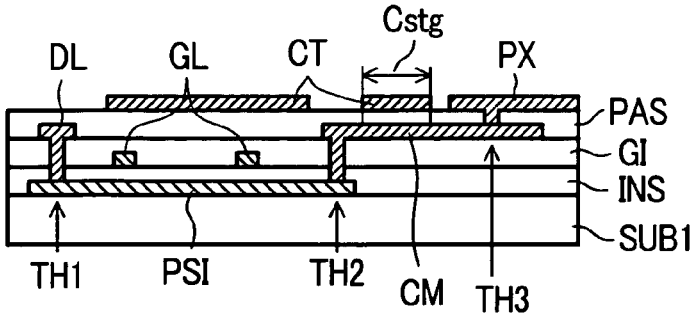

FIG. 46A is a plan view showing another embodiment of the pixel of the liquid crystal display device according to the present invention. Further, FIG. 46B is a cross-sectional view taken along a line b-b in FIG. 46A and FIG. 46C is a cross-sectional view taken along a line c-c in FIG. 46A.

The constitution which makes this embodiment different from the embodiment shown in FIG. 45A lies in the constitution of the counter voltage signal lines CL. That is, the counter voltage signal line CL which covers the gate signal line GL which drives the pixel is electrically separated from the counter electrode CT which is formed on the pixel. Further, the counter electrode CT is electrically connected to the counter voltage signal line CL which covers one gate signal line GL which drives the pixel and another gate signal line GL which is formed to sandwich the pixel with one gate signal line GL.

Further, a portion where the counter voltage signal line CL covering the gate signal line GL which drives the pixel and the counter electrode CT of the pixel are electrically separated from each other is covered with a light shielding film BM.

Due to such a constitution, as explained in connection with the above-mentioned embodiment, during the writing period of the gate signal line GL, it is possible to make the counter voltage signal line CL on the gate signal line GL assume a floating state and hence, the writing characteristics can be improved.

Further, in the same manner as the constitution shown in FIG. 45A, a strong electric field can be formed in the vicinity of the pixel electrode PX and the counter electrode CT and the rotational direction of the liquid crystal on the rest of surface can be controlled by using the strong electric field as a drive force. Accordingly, it is necessary to make the generated electric field stronger and hence, the above-mentioned constitution which can, during the writing period of the gate signal line GL, make the counter voltage signal line CL on the gate signal line GL assume a floating state becomes extremely advantageous.

Embodiment 33

Figure 47A:
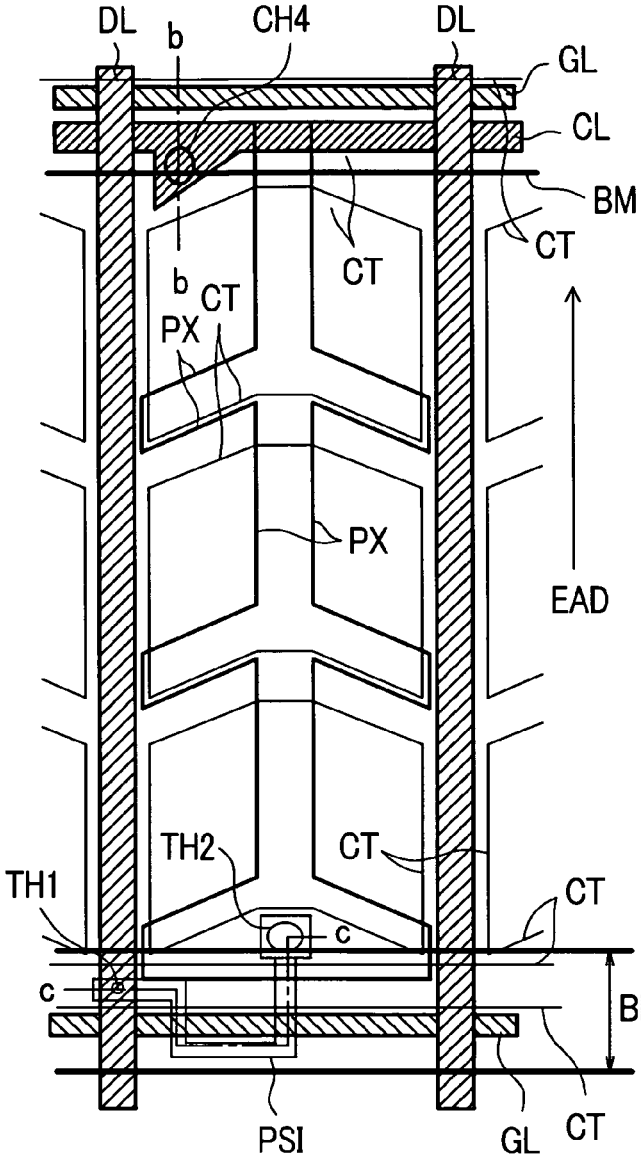
FIG. 47A is a plan view showing another embodiment of a pixel of the liquid crystal display device according to the present invention.
Figure 47B:
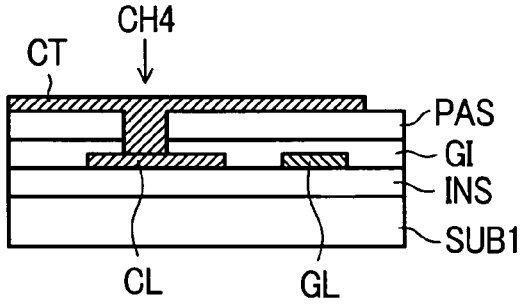
FIG. 47B is a cross-sectional view taken along line b-b and FIG. 47C is a cross-sectional view taken along line c-c in FIG. 47A.
Figure 47C:
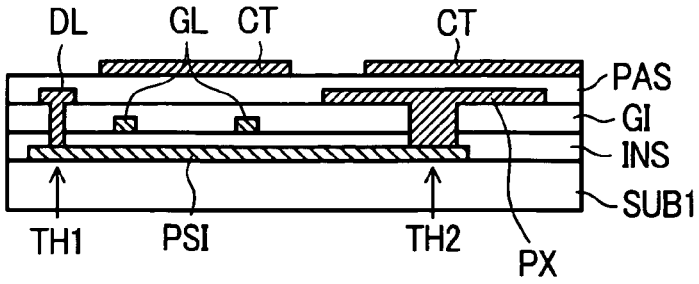

FIG. 47A is a plan view showing another embodiment of the pixel of the liquid crystal display device according to the present invention. Further, FIG. 47B is a cross-sectional view taken along a line b-b in FIG. 47A and FIG. 47C is a cross-sectional view taken along a line c-c in FIG. 47A.

The constitution which makes this embodiment different from the embodiment shown in FIG. 44A lies in the fact that, first of all, the counter electrode CT and the counter voltage signal line CL are formed on the surface of the third insulation film PAS and these counter electrode CT and the counter voltage signal line CL are formed of a light transmitting conductive layer such as ITO (Indium Tin Oxide), ITZO (Indium Tin Zinc Oxide), IZO (Indium Zinc Oxide), $SnO_2$ (Tin Oxide), $In_2O_3$ (Indium Oxide) or the like, for example.

Further, for reducing the whole electric resistance of these counter electrode CT and the counter voltage signal line CL, the counter voltage signal line CL' which is formed of metal is additionally provided and the counter voltage signal line CL' and the above-mentioned counter voltage signal line CL are connected.

The counter voltage signal line CL' is formed close to another gate signal line GL which is formed such that another gate signal line GL sandwiches the pixel with the gate signal line GL which drives the pixel.

Further, since the counter voltage signal line CL' is formed, for example, at the time of forming another gate signal line GL, the counter voltage signal line CL' is formed of the same material as another gate signal line GL. The connection between this counter voltage signal line CL' and the counter voltage signal line CL on the third insulation film PAS is performed via a through hole TH4 which is formed in a penetrating manner in the third insulation film PAS and the second insulation film GI (see FIG. 47B).

Here, the counter voltage signal line CL' and the gate signal line GL arranged close to the counter voltage signal line CL' are covered with the counter voltage signal line CL formed on the third insulation film PAS and, at the same time, the counter voltage signal line CL' is integrally connected to the counter electrode CT of the pixel. Then, the counter electrode CT of the pixel is configured to be electrically separated from the counter voltage signal line CL in the vicinity of the counter voltage signal line CL, wherein the counter voltage signal line CL is formed such that the counter voltage signal line CL covers the gate signal line GL which drives the pixel.

Due to such a constitution, the light shielding film BM which is formed in the vicinity is formed so as to cover at least the portion where the counter voltage signal line CL and the counter electrode CT are electrically separated.

Further, in the same manner as the constitution shown in FIG. 44A, the region which is surrounded by the drain signal line DL and the gate signal line GL is divided into six regions by the pixel electrodes PX and the counter electrodes CT. However, the constitution which makes this embodiment different from the embodiment shown in FIG. 44A lies in the fact that the patterns formed at the outermost frames of the respective regions are set upside down compared with the patterns shown in FIG. 44A.

That is, with respect to the constitution shown in FIG. 44A, the pixel electrode PX which extends in the y direction has a branch-like pattern which has an obtuse angle (>90°) directed from the side which is connected to the thin film transistor TFT to the side opposite to the above-mentioned side of the pixel. Further, due to such a branch-like pattern, the connecting pattern of the counter electrode CT on one drain signal line DL and the counter electrode CT on another drain signal line DL has substantially the same constitution as the above-mentioned branch-like pattern.

To the contrary, in this embodiment, the pixel electrode PX which extends in the y direction has a branch-like pattern which has an obtuse angle (>90°) directed toward the thin film transistor TFT from the side opposite to the side which is connected to the thin film transistor TFT of the pixel. Further, due to such a branch-like pattern, the connecting pattern of the counter electrode CT on one drain signal line DL and the counter electrode CT on another drain signal line DL has substantially the same constitution as the above-mentioned branch-like pattern.

The connecting pattern of the counter electrodes CT is arranged at the position where the branch-like pattern of the pixel electrode PX is shifted to the thin film transistor TFT side leaving a region where the connecting pattern is partially overlapped with the branch-pattern of the pixel electrode PX. The partially overlapped region of the connecting pattern of the counter electrodes CT and the branch-pattern of the pixel electrode PX is provided for generating the capacitive element Cstg which uses the third insulation film PAS as a dielectric film at the portion.

Here, although the pixel electrode PX may be formed of metal, it is needless to say that the pixel electrode may be formed of a light transmitting conductive layer made of ITO (Indium Tin Oxide), ITZO (Indium Tin Zinc Oxide), IZO (Indium Zinc Oxide), $SnO_2$ (Tin Oxide), $In_2O_3$ (Indium Oxide) or the like, for example. In this case, the so-called numerical aperture can be enhanced as much as possible.

Embodiment 34

Figure 48:
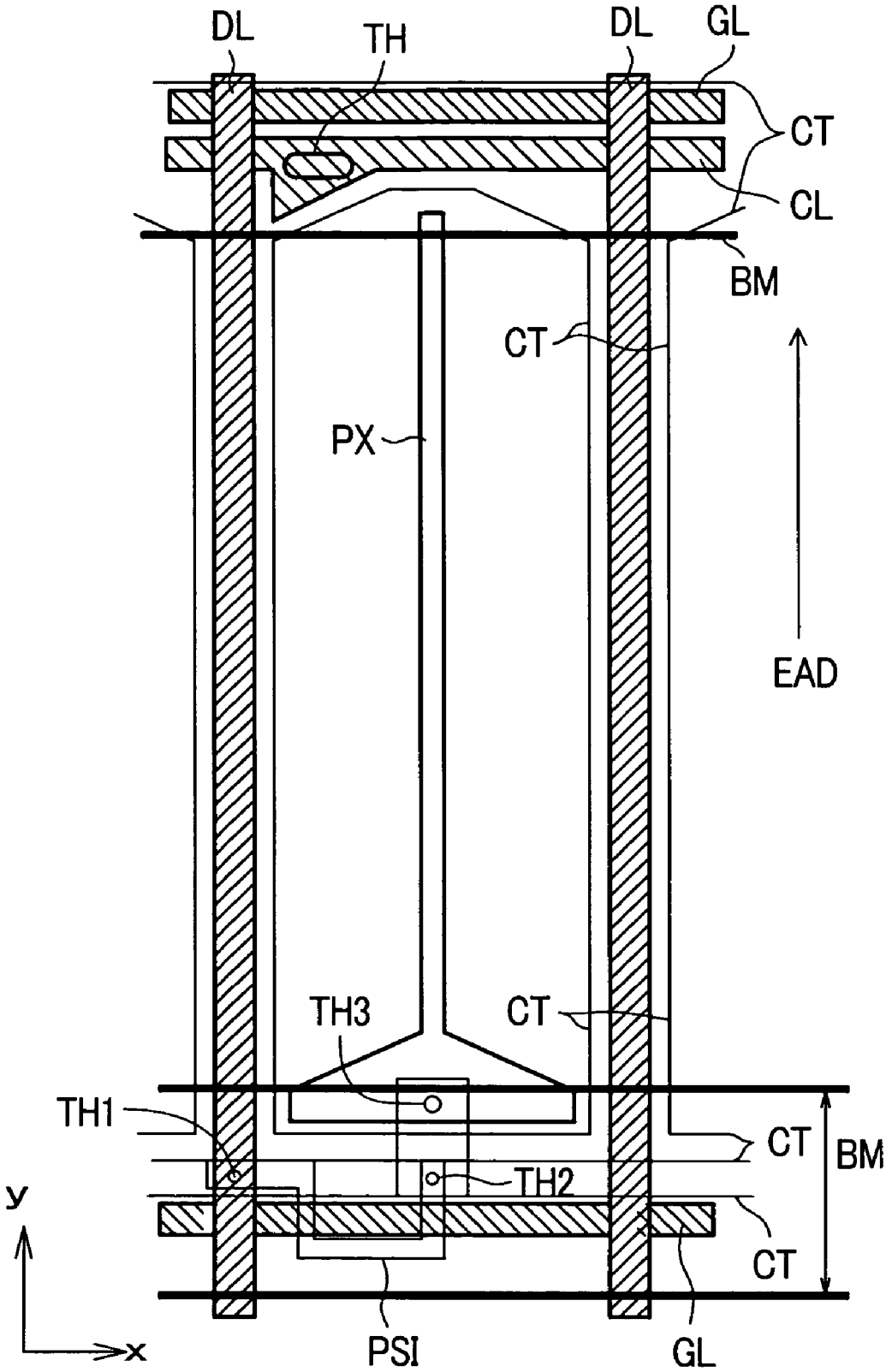
FIG. 48 is a plan view showing another embodiment of a pixel of the liquid crystal display device according to the present invention.

FIG. 48 is a plan view showing another embodiment of the pixel of the liquid crystal display device according to the present invention.

The constitution which makes this embodiment different from the embodiment shown in FIG. 46A lies in the fact that, first of all, the counter voltage signal line CL' is arranged close to another gate signal line GL which is arranged to sandwich the pixel region with the gate signal line GL which drives the pixel and the counter voltage signal line CL' is made of metal.

On an upper surface of the third insulation film PAS which is arranged above the counter voltage signal line CL' and another gate signal line GL arranged close to the counter voltage signal line CL', the counter voltage signal line CL which is formed of a light transmitting conductive film is formed such that the counter voltage signal line CL covers the counter voltage signal line CL' and another gate signal line GL. Here, the counter voltage signal line CL is integrally formed with the counter electrode CT of the pixel.

Further, in the same manner as the constitution shown in FIG. 46A, the pixel region which is surrounded by the gate signal lines GL and the drain signal lines DL is divided into two regions by the pixel electrode PX and the counter electrodes CT. However, these respective regions differ from the regions shown in FIG. 46A in that these regions have an upside-down pattern compared to the pattern of the respective regions shown in FIG. 46A.

That is, the pixel electrode PX which extends in the y direction in the drawing has a pattern in which the width thereof is gradually increased in an obtuse angle (>90°) as the pixel electrode PX approaches the connecting portion with the thin film transistor TFT. On the other hand, although the counter electrodes CT are formed in the peripheral portions of the pixel region except for the center portion, the counter electrodes CT which are formed in an overlapped manner to the respective drain signal lines DL have a pattern in which the width of the counter electrode CT is gradually increased in an obtuse angle (>90°) as the counter electrode CT approaches the side opposite to the thin film transistor TFT side.

Due to such a constitution, the expansion angle of the pixel electrode PX is constituted substantially the same as the expansion angle of the counter electrode CT.

The pixel having such a constitution is formed with the pattern in which the respective divided regions are formed by arranging the respective divided regions shown in FIG. 46A upside down and hence, the pixel can obtain substantially the same advantageous effects as the advantageous effects of the constitution shown in FIG. 46A.

Embodiment 35

Figure 49:
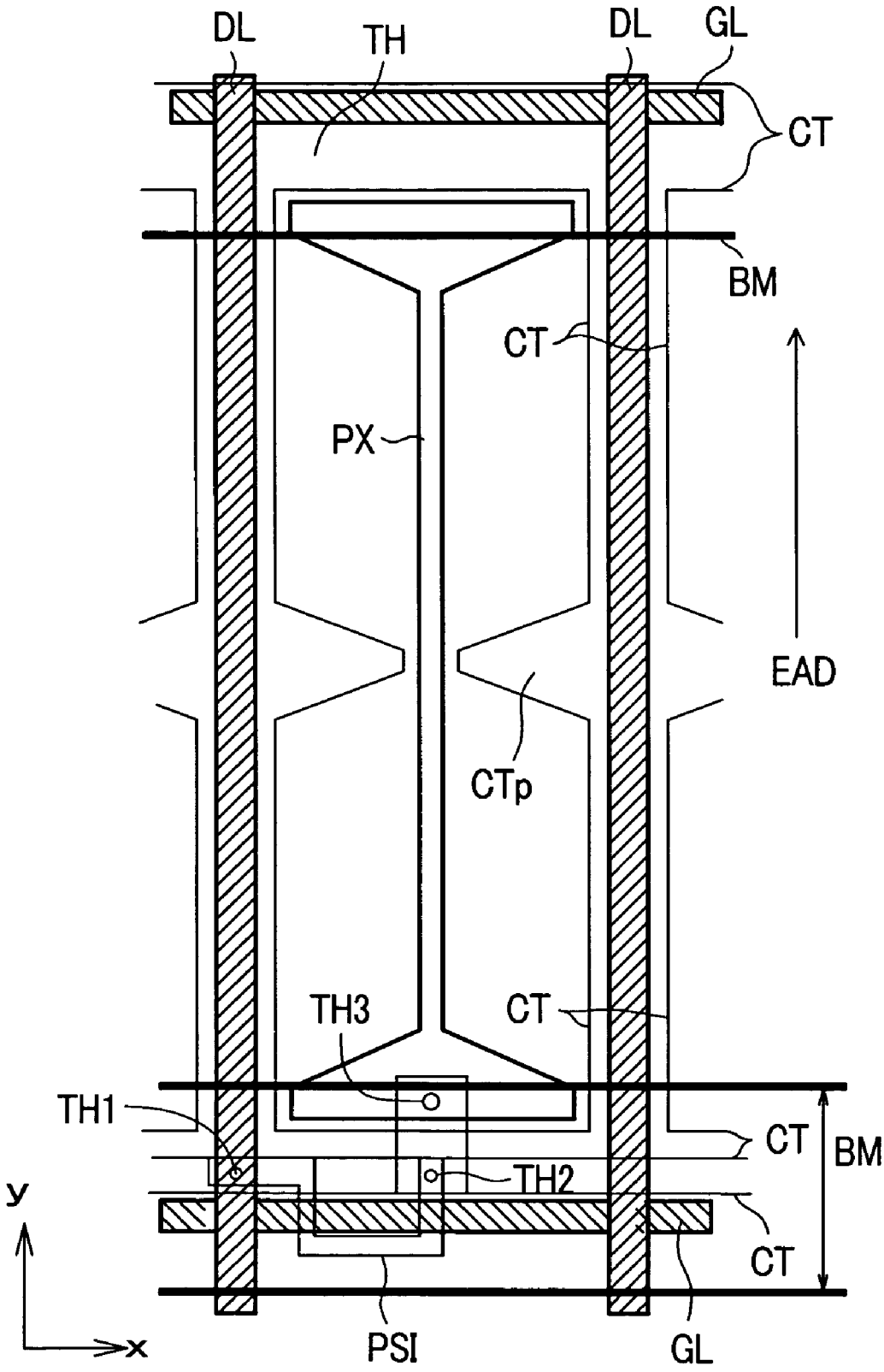
FIG. 49 is a plan view showing another embodiment of a pixel of the liquid crystal display device according to the present invention.

FIG. 49 is a plan view showing another embodiment of the pixel of the liquid crystal display device according to the present invention.

The constitution which makes this embodiment different from the embodiment shown in FIG. 48 lies in the fact that, the pixel region which is surrounded by the drain signal lines DL and the gate signal lines GL is divided into four divided regions by the pixel electrode PX and the counter electrodes CT.

That is, the pixel electrode PX which extends in the y direction in the center of the pixel region is arranged and one end of the pixel electrode PX and another end which is arranged opposite to one end are respectively formed such that widths of these ends are gradually increased in the extending direction until the ends reach the vicinities of the counter voltage signal lines CL. Accordingly, the respective end portions of the pixel electrode PX assume a shape which expands radially and respective sides of the expansion surface are configured to make an obtuse angle (>90°) with respect to respective portions which extend in a straight line.

On the other hand, with respect to the respective counter electrodes CT which are formed to cover the respective drain signal lines DL which sandwich the pixel region therebetween, projecting portions CTp which extend toward the pixel electrode PX side are formed at substantially center portions thereof. The projecting portion CTp is formed in a shape such that the width of the projecting portion CTp is gradually narrowed as the projecting portion CTp approaches the pixel electrode PX and the respective sides of an inclined surface are configured to make an obtuse angle (>90°) with respect to respective portions which extend in a straight line.

In such a constitution also, the respective divided regions of the pixel region which are divided by the pixel electrode PX and the counter electrodes CT have substantially the same constitution as the regions shown in FIG. 46A and hence, it is possible to obtain the advantageous effects described in conjunction with the constitution shown in FIG. 46A.

Further, by forming two or more divided regions, the areas of the respective regions become comparatively small and the strength of electric field which is generated by the pixel electrode PX and the counter electrodes CT within the pixel region is increased and hence, the response speed can be improved.

Embodiment 36

Figure 50:
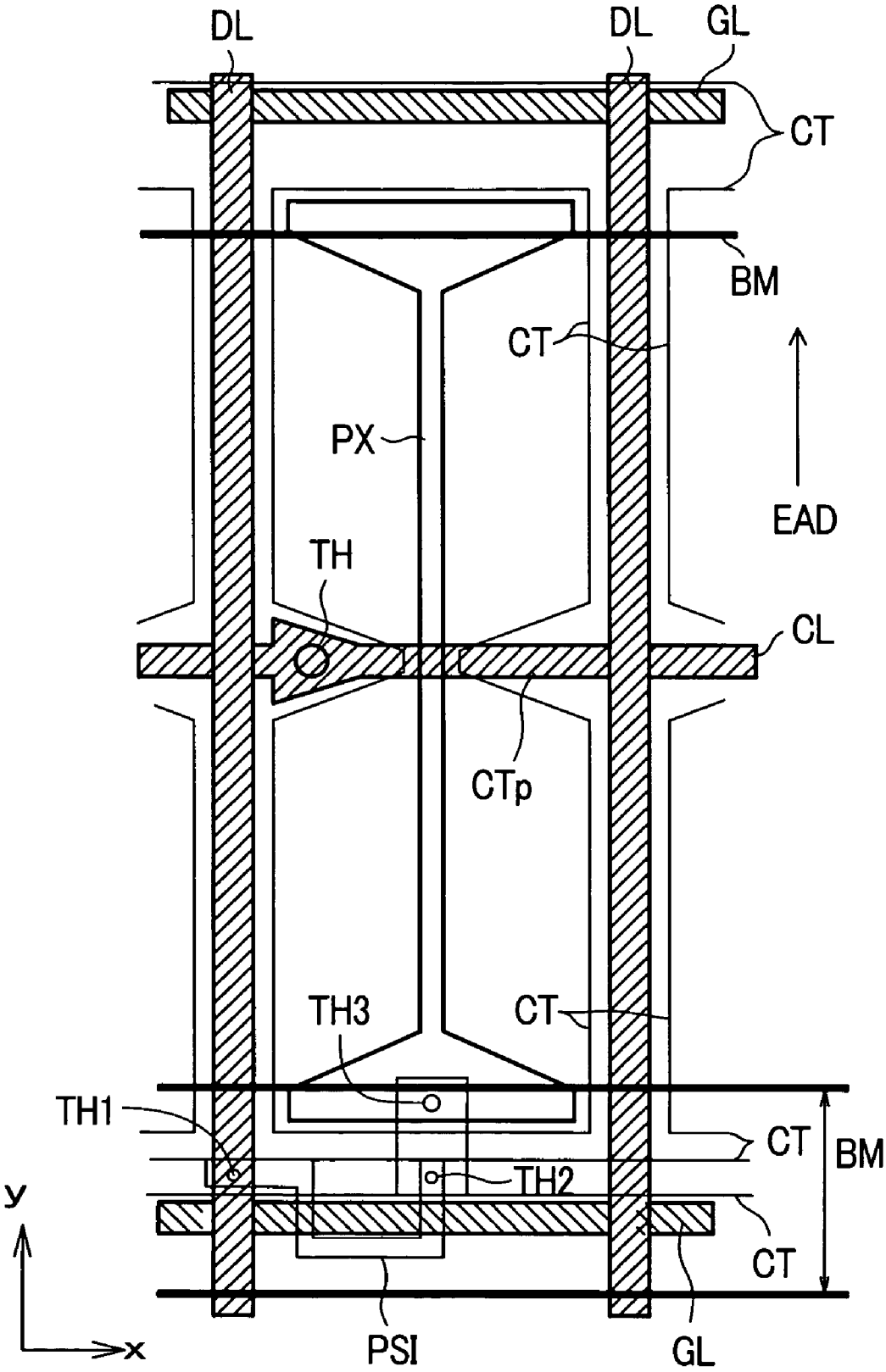
FIG. 50 is a plan view showing another embodiment of a pixel of the liquid crystal display device according to the present invention.

FIG. 50 is a plan view showing another embodiment of the pixel of the liquid crystal display device according to the present invention.

The constitution which makes this embodiment different from the embodiment shown in FIG. 49 lies in the fact that the counter voltage signal line CL' which extends in the x direction in the drawing is formed so as to run at the center of the pixel region. Further, the counter voltage signal line CL' is simultaneously formed along with the formation of the gate signal line GL, for example. Still further, at a portion of the projecting portion CTp of the counter electrode CT, the counter voltage signal line CL' is connected with the counter electrode CT (counter voltage signal line CL) via a through hole TH which is formed in a penetrating manner in the third insulation film PAS, the second insulation film GI and the first insulation film INS.

This counter voltage signal line CL' is made of a material which has a comparatively small electric resistance such as metal or the like and is formed for reducing the electric resistance value of the counter voltage signal line CL which is integrally formed with the counter electrode CT.

Accordingly, it is needless to say that the counter electrode CT and the counter voltage signal line CL may be formed of a light transmitting conductive layer made of ITO (Indium Tin Oxide), ITZO (Indium Tin Zinc Oxide), IZO (Indium Zinc Oxide), $SnO_2$ (Tin Oxide), $In_2O_3$ (Indium Oxide) or the like, for example. In this case, the so-called numerical aperture of the pixel can be enhanced as much as possible.

Embodiment 37

Figure 51:
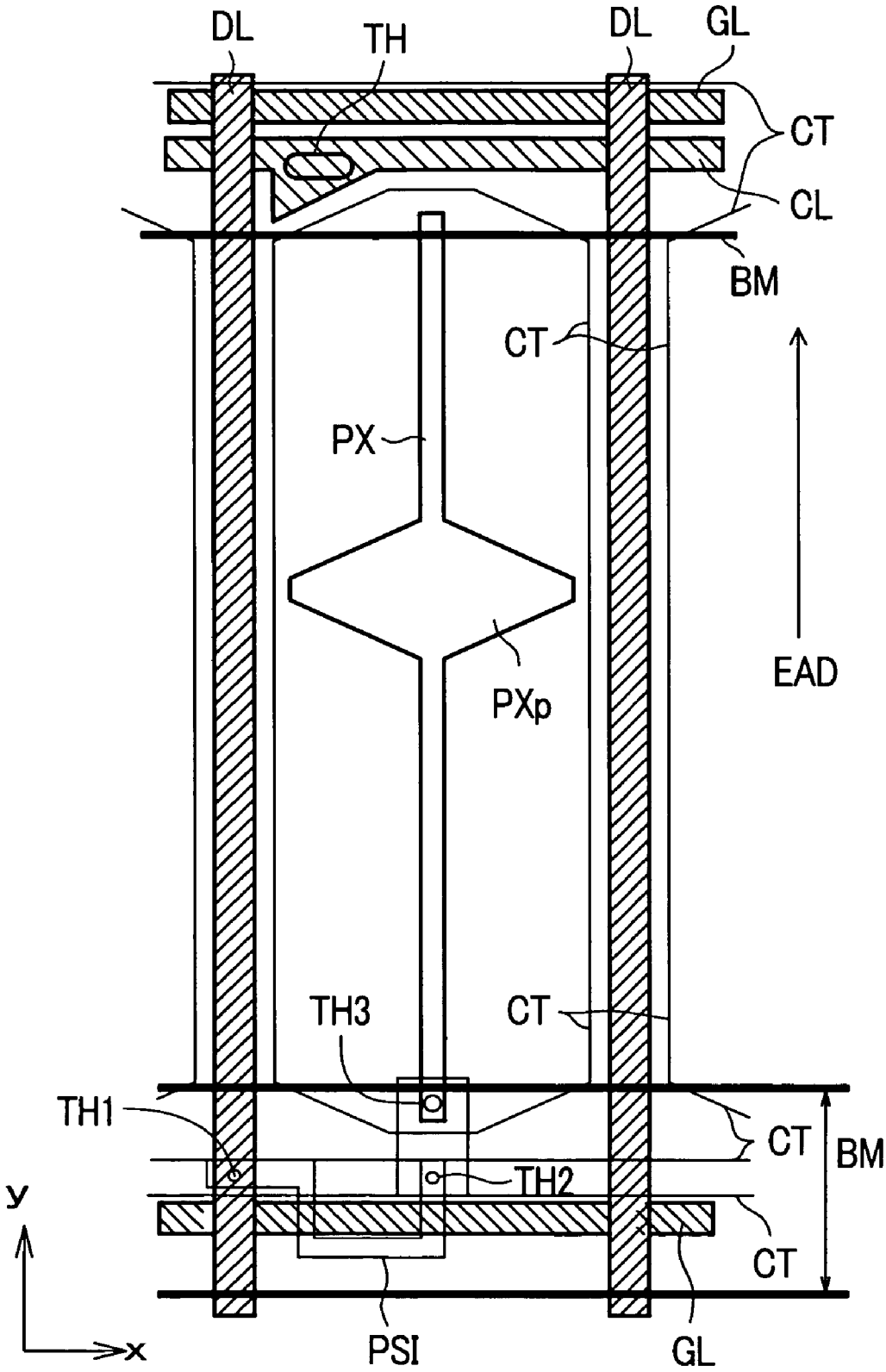
FIG. 51 is a plan view showing another embodiment of a pixel of the liquid crystal display device according to the present invention.

FIG. 51 is a view showing another embodiment of the pixel of the liquid crystal display device according to the present invention.

To compare this embodiment with the embodiment shown in FIG. 49, the constitution of this embodiment is substantially as same as the constitution shown in FIG. 49 with respect to the point that the pixel region which is surrounded by the drain signal lines DL and the gate signal lines GL is divided into four divided regions by the pixel electrode PX and the counter electrodes CT. However, this embodiment differs from the embodiment shown in FIG. 49 with respect to the respective patterns of the pixel electrode PX and the counter electrode CT.

That is, the pixel electrode PX which extends in the y direction at a center of the pixel region is provided with, at a substantially center portion thereof, projecting portions PXp which extend toward the counter electrodes CT which are arranged to sandwich the pixel region PX therebetween. The projecting portion PXp has a shape in which a width thereof is gradually narrowed as the projecting portion PXb approaches the respective counter electrodes CT and inclined surfaces of the projecting portion PXb are configured to make an obtuse angle (>90°) with respect to portions which extend in a straight line.

On the other hand, the respective counter electrodes CT which are formed to cover the respective drain signal lines DL which sandwich the pixel region have a shape which expands radially at portions of respective ends thereof which are connected to the counter voltage signal lines CL and expansion surfaces are configured to make obtuse angles (>90°) with respect to portions which extend in a straight line.

Due to such a constitution also, the respective regions of the pixel region which are divided by the pixel electrode PX and the counter electrodes CT have substantially the same constitution as the constitution shown in FIG. 46A and hence, the respective regions can obtain the advantageous effect explained in conjunction with the embodiment shown in FIG. 46A.

Further, by forming two or more divided regions, areas of the respective regions become comparatively small and the strength of electric field which is generated by the pixel electrode PX and the counter electrodes CT within the pixel region is increased and hence, the response speed can be improved.

Embodiment 38

Figure 52:
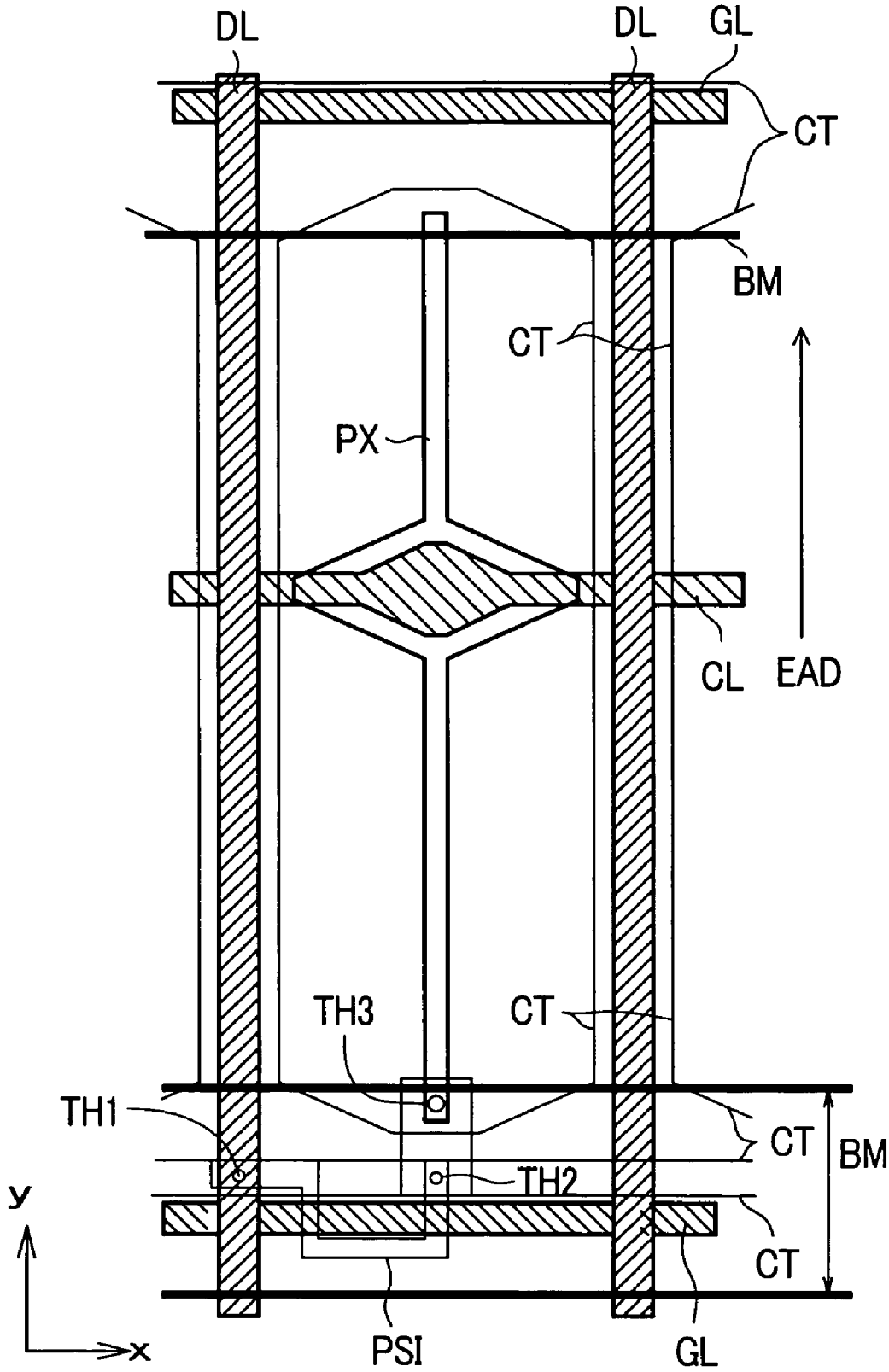
FIG. 52 is a plan view showing another embodiment of a pixel of the liquid crystal display device according to the present invention.
Figure 53:
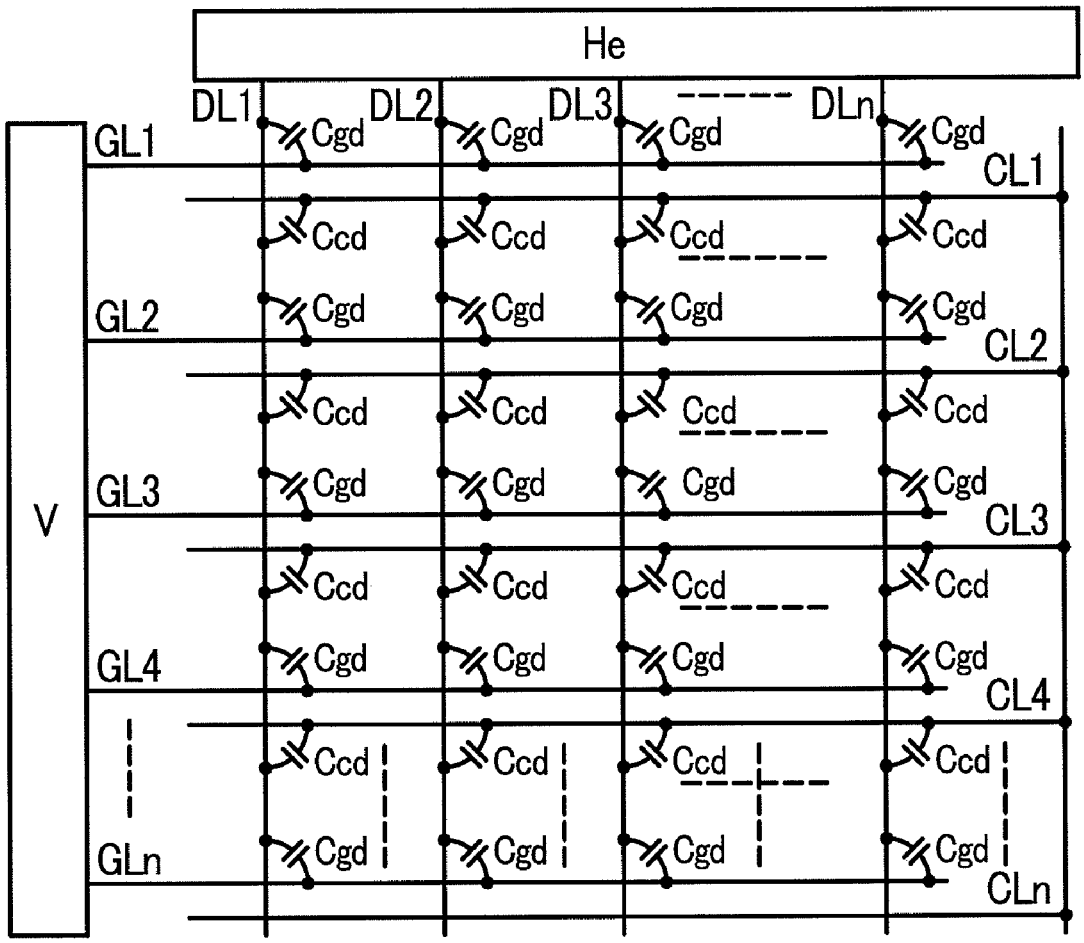
FIG. 53 (PRIOR ART)
FIG. 53 is an equivalent circuit diagram showing one example of a conventional liquid crystal display device.

FIG. 52 is a plan view showing another embodiment of the pixel of the liquid crystal display device according to the present invention.

The constitution which makes this embodiment different from the embodiment shown in FIG. 50 lies in the fact that the counter voltage signal line CL' which extends in the x direction in the drawing is formed such that the counter voltage signal line CL' runs at the center of the pixel region. Further, the counter voltage signal line CL' is formed simultaneously with the formation of the gate signal line GL, for example. In this case, below a projecting portion PXp which is disposed below the pixel electrode PX, the counter voltage signal line CL' is formed so as to have the width thereof slightly widened to an extent that the counter voltage signal line CL' does not extend beyond the projecting portion PXp. This provision is made for reducing the electrical resistance of the counter voltage signal line CL' as much as possible.

The counter voltage signal line CL' is connected to the counter voltage signal line CL in the region outside the liquid crystal display part AR and is provided for reducing the electrical resistance value of the counter voltage signal line CL.

Accordingly, it is needless to say that the counter electrode CT and the counter voltage signal line CL may be formed of a light transmitting conductive layer made of ITO (Indium Tin Oxide), ITZO (Indium Tin Zinc Oxide), IZO (Indium Zinc Oxide), $SnO_2$ (Tin Oxide), $In_2O_3$ (Indium Oxide) or the like, for example. This is for improving the so-called numerical aperture of pixel as much as possible.

The above-mentioned respective embodiments may be used in a single form or in combination. This is because the advantageous effect of the respective embodiments can be obtained in a single form or synergistically.

As clearly explained heretofore, by using the liquid crystal display device according to the present invention, the generation of undesired power consumption at the time of supplying the video signal to the drain signal line can be drastically reduced.

What is claimed is:

1. A liquid crystal display device comprising respective pixels which are arranged in a matrix array by arranging a plurality of pixel rows each of which includes a plurality of pixels arranged in parallel in one direction in another direction which crosses one direction, selects each pixel row in response to a scanning signal, and supplies a video signal and a reference signal which becomes the reference with respect to the video signal to the respective pixels in each selected pixel row, wherein drain signal lines which supply the video signal are arranged to cross gate signal lines which supply the scanning signal and counter voltage signal lines which supply the reference signal, and the reference signal is supplied to the pixels for every selected pixel row and, at the same time, the counter voltage signal lines in other pixel rows except for the selected pixel rows are respectively configured to assume a floating state.

2. A liquid crystal display device according to claim 1, wherein with respect to respective counter voltage signal lines, a plurality of selected counter voltage signal lines are formed into groups.

3. A liquid crystal display device according to claim 2, wherein the respective groups of counter voltage signal lines have end portions thereof opposite to the counter-voltage-signal supply side connected to each other.

4. A liquid crystal display device according to claim 1, wherein the respective counter voltage signal lines are formed such that the respective counter voltage signal lines are connectable with correction wiring to which the counter voltage signal can be always supplied at respective end portions thereof opposite to the counter-voltage-signal supply side.

5. A liquid crystal display device according to claim 4, wherein the scanning signal is supplied to the respective gate signal lines through switches which are turned on in response to the signal scanned by the drive circuit, when the signal is scanned and supplied to the next gate signal line, the switches are turned off in response to an OFF signal, and when the scanning signal is supplied to the further next gate signal line, the gate signal line to which the scanning signal is supplied at the two preceding stage is made to assume a floating state.

6. A liquid crystal display device according to claim 4, wherein the polarities of the video signals which are respectively supplied to the respective drain signal lines have the same phase with respect to the neighboring drain signal lines.

7. A liquid crystal display device according to claim 6, wherein the polarity of the counter voltage signal which is supplied to the respective counter voltage signal lines by scanning is inverted every supply of the counter voltage signal.

8. A liquid crystal display device according to claim 4, wherein to each counter voltage signal line, a counter voltage signal is supplied through a switch which is turned on in response to a signal scanned by a drive circuit thereof, and when the signal is scanned and supplied to the next counter voltage signal line, the counter voltage signal line to which the counter voltage signal is supplied before the supply of the next counter voltage signal line is made to assume a floating state.

9. A liquid crystal display device according to claim 8, wherein with respect to respective counter voltage signal lines, a plurality of selected counter voltage signal lines are formed into groups.

10. A liquid crystal display device according to claim 9, wherein the respective groups of counter voltage signal lines have end portions thereof opposite to the counter-voltage-signal supply side connected to each other.

11. A liquid crystal display device according to claim 8, wherein the respective counter voltage signal lines are formed such that the respective counter voltage signal lines are connectable with correction wiring to which the counter voltage signal can be always supplied at respective end portions thereof opposite to the counter-voltage-signal supply side.

12. A liquid crystal display device defining regions which are surrounded by gate signal lines which extend in the first direction and are arranged in parallel in the second direction and drain signal lines which extend in the second direction and are arranged in parallel in the first direction as pixel regions, wherein each pixel region includes a thin film transistor which is driven in response to a scanning signal from the gate signal line, a pixel electrode to which a video signal is supplied from the drain signal line by way of the thin film transistor and a counter electrode which generates an electric field between the counter electrode and the pixel electrode, the liquid crystal display device includes counter voltage signal lines which run between respective gate signal lines and are connected to the counter electrodes;

the liquid crystal display device includes means which makes most of other gate signal lines except for the gate signal line for supplying scanning signal assume a floating state, and the liquid crystal display device includes means which supplies counter voltage signal to the counter voltage signal lines which run in the pixel regions which the thin film transistors drive by the gate signal lines to which the scanning signal is supplied and makes the other counter voltage signal lines assume a floating state.

13. A liquid crystal display device according to claim 12, wherein the scanning signal is supplied to the respective gate signal lines through switches which are turned on in response to a signal scanned by the drive circuit, when the signal is scanned and supplied to the next gate signal line, the switches are turned off in response to an OFF signal, and when the scanning signal is supplied to the further next gate signal line, the gate signal line to which the scanning signal is supplied at the two preceding stage is made to assume a floating state.

14. A liquid crystal display device according to claim 12, wherein the polarities of the video signals which are respectively supplied to the respective drain signal lines have the same phase with respect to the neighboring drain signal lines.

15. A liquid crystal display device according to claim 14, wherein the polarity of the counter voltage signal which is supplied to the respective counter voltage signal lines by scanning is inverted every supply of the counter voltage signal.

16. A liquid crystal display device according to claim 12, wherein to each counter voltage signal line, a counter voltage signal is supplied through a switch which is turned on in response to a signal scanned by a drive circuit thereof, and when the signal is scanned and supplied to the next counter voltage signal line, the counter voltage signal line to which the counter voltage signal is supplied before the supply of the next counter voltage signal line is made to assume a floating state.

17. A liquid crystal display device according to claim 16, wherein with respect to respective counter voltage signal lines, a plurality of selected counter voltage signal lines are formed into groups.

18. A liquid crystal display device according to claim 17, wherein the respective groups of counter voltage signal lines have end portions thereof opposite to the counter-voltage-signal supply side connected to each other.

19. A liquid crystal display device according to claim 16, wherein the respective counter voltage signal lines are formed such that the respective counter voltage signal lines are connectable with correction wiring to which the counter voltage signal can be always supplied at respective end portions thereof opposite to the counter-voltage-signal supply side.

20. A liquid crystal display device comprising pixels which are surrounded by gate signal lines which extend in the first direction and are arranged in parallel in the second direction which crosses the first direction and drain signal lines which extend in the second direction and are arranged in parallel in the first direction, wherein each pixel includes a switching element which is turned on in response to a scanning signal from the gate signal line, a pixel electrode to which a video signal is supplied from the drain signal line through the switching element, and a counter electrode which is an electrode for generating an electric field between the counter electrode and the pixel electrode and to which a counter voltage signal scanned from a counter voltage signal line arranged substantially parallel to the gate signal line is supplied, the counter voltage signal line is formed to cover the gate signal line by way of an insulation film and, at the same time, the counter electrode is connected to gate lines connected with the switching element of the pixel and counter voltage signal lines which cover the gate signal line which is formed to sandwich the pixel with the gate signal line, and most of other gate signal lines except for the gate signal line to which the scanning signal is supplied are made to assume a floating state, and other counter voltage signal lines other than counter voltage signal lines to which counter video signal is supplied are made to assume a floating state.

21. A liquid crystal display device according to claim 20, wherein the counter voltage signal lines and the counter electrodes which are connected to the counter voltage signal lines are formed of a light transmitting conductive layer.

22. A liquid crystal display device according to claim 21, wherein the counter voltage signal lines are electrically connected with metal conductive layers which are arranged on the same layer as and close to the gate signal lines which are covered with the counter voltage signal lines via through hole.

23. A liquid crystal display device comprising respective pixels which are arranged in a matrix array by arranging a plurality of pixel rows each of which includes a plurality of pixels arranged in parallel in one direction in another direction which crosses one direction, selects each pixel row in response to a scanning signal, and supplies a video signal and a reference signal which becomes the reference with respect to the video signal to the respective pixels in each selected pixel row, wherein drain signal lines which supply the video signal are arranged to cross gate signal lines which supply the scanning signal and counter voltage signal lines which supply the reference signal, the reference signal is supplied to the pixels for every selected pixel row and, at the same time, most of the gate signal lines and the counter voltage signal lines in other pixel rows except for the selected pixel rows are respectively configured to assume a floating state, and the scanning signal and the reference signal are respectively supplied from a single circuit and signals containing ON/OFF of the scanning signal and the reference signal are transmitted by shifting transmitting times from each other.

24. A liquid crystal display device according to claim 23, wherein the circuit includes terminals to which the signal containing ON/OFF of the scanning signal is always supplied and terminals to which the reference signal is always supplied, and the scanning signal and the reference signal are respectively transmitted to the gate signal lines and the counter voltage signal lines from the respective terminals selected through a switch circuit.

25. A liquid crystal display device comprising respective pixels which are arranged in a matrix array by arranging a plurality of pixel rows each of which includes a plurality of pixels arranged in parallel in one direction in another direction which crosses one direction, selects each pixel row in response to a scanning signal, and supplies a video signal and a reference signal which becomes the reference with respect to the video signal to the respective pixels in each selected pixel row, wherein drain signal lines which supply the video signals are arranged to cross gate signal lines which supply the scanning signal and counter voltage signal lines which supply the reference signal, the reference signal is supplied to the pixels for every selected pixel row and, at the same time, the counter voltage signal lines of other pixel rows except for the selected pixel row are made to assume a floating state, and a drive circuit which transmits the reference signal is arranged parallel to a drive circuit which transmits the video signal.

26. A liquid crystal display device according to claim 25, wherein the drive circuit which transmits the reference signal and the drive circuit which transmits the video signal are respectively constituted of a plurality of semiconductor devices, the semiconductor devices which transmit the reference signal and the semiconductor devices which transmit the video signal are alternately arranged and, at the same time, these respective semiconductor devices are connected to each other through data transmission lines.

27. A liquid crystal display device comprising respective pixels which are arranged in a matrix array by arranging a plurality of pixel rows each of which includes a plurality of pixels arranged in parallel in one direction in another direction which crosses one direction, selects each pixel row in response to a scanning signal, and supplies a video signal to the respective pixels in each selected pixel row, wherein drain signal lines which supply the video signal are arranged to cross gate signal lines which supply the scanning signal, the scanning signal is supplied to the respective gate signal lines through switches which are turned on in response to signal scanned by a drive circuit thereof, when the signal is scanned and supplied to the next gate signal line, the switches are turned off in response to an OFF signal, and when the scanning signal is supplied to the further next gate signal line, the gate signal line to which the scanning signal is supplied at the two preceding stage is made to assume a floating state, and the respective gate signal lines are connected to a voltage signal line which is made to assume a floating state through portions thereof which assume a floating state and diodes.

28. A liquid crystal display device according to claim 27, wherein the diode is a double-way diode.

29. A liquid crystal display device according to claim 28, wherein the double-way diode has a semiconductor layer thereof formed of polysilicon and the double-way diodes are formed on a substrate on which the gate signal lines and the counter voltage signal lines are formed.

30. A liquid crystal display device comprising respective pixels which are arranged in a matrix array by arranging a plurality of pixel rows each of which includes a plurality of pixels arranged in parallel in one direction in another direction which crosses one direction, selects each pixel row in response to a scanning signal, and supplies a video signal to the respective pixels in each selected pixel row, wherein drain signal lines which supply the video signal are arranged to cross gate signal lines which supply the scanning signal, the scanning signal is supplied to the respective gate signal lines through switches which are turned on in response to signal scanned by a drive circuit thereof, when the signal is scanned and supplied to the next gate signal line, the switches are turned off in response to an OFF signal, and when the scanning signal is supplied to the further next gate signal line, the gate signal line to which the scanning signal is supplied at the two preceding stage is made to assume a floating state, and the respective gate signal lines are connected to a voltage signal line which is made to assume a floating state through portions thereof which assume a floating state and diodes.

31. A liquid crystal display device comprising respective pixels which are arranged in a matrix array by arranging a plurality of pixel rows each of which includes a plurality of pixels arranged in parallel in one direction in another direction which crosses one direction, wherein the pixel includes a counter electrode which generates an electric field between the counter electrode and a pixel electrode and a counter voltage signal line which supplies a counter voltage signal to counter electrodes of respective pixels of the sequentially selected pixel row in response to the selection, drain signal lines which supply the video signals to the pixel electrodes are arranged to cross the counter voltage signal line, the counter voltage signal is supplied to the respective counter voltage signal lines through switches which are turned on in response to a signal scanned by a drive circuit thereof, when the signal is scanned and supplied to the next counter voltage signal line, the counter voltage signal line to which the counter voltage signal is supplied before the supply of the counter voltage signal to the next counter voltage signal line is made to assume a floating state, and the respective counter voltage signal lines are connected to the signal line to which the counter voltage signal is supplied through portions thereof which assume a floating state and diodes.

32. A liquid crystal display device comprising respective pixels which are arranged in a matrix array by arranging a plurality of pixel rows each of which includes a plurality of pixels arranged in parallel in one direction in another direction which crosses one direction, wherein the pixel includes a counter electrode which generates an electric field between the counter electrode and a pixel electrode and a counter voltage signal line which supplies a counter voltage signal to the counter electrodes of the respective pixels of the sequentially selected pixel row in response to the selection, drain signal lines which supply the video signals to the pixel electrodes are arranged to cross the counter voltage signal line, the counter voltage signal is supplied to the respective counter voltage signal lines through switches which are turned on in response to a signal scanned by a drive circuit thereof, when the signal is scanned and supplied to the next counter voltage signal line, the counter voltage signal line to which the counter voltage signal is supplied before the supply of the counter voltage signal to the next counter voltage signal line is made to assume a floating state, and the respective counter voltage signal lines are connected to the voltage signal line which is made to assume a floating state through portions thereof which assume a floating state and diodes.

33. A liquid crystal display device comprising respective pixels which are arranged in a matrix array by arranging a plurality of pixel rows each of which includes a plurality of pixels arranged in parallel in one direction in another direction which crosses one direction, selects each pixel row in response to a scanning signal, and supplies a video signal and a reference signal which becomes the reference with respect to the video signal to the respective pixels in each selected pixel row, wherein drain signal lines which supply the video signal are arranged to cross gate signal lines which supply the scanning signal and counter voltage signal lines which supply the reference signal, the reference signal is supplied to the pixels for every selected pixel row and, at the same time, most of the gate signal lines and the counter voltage signal lines in other pixel rows except for the selected pixel rows are respectively configured to assume a floating state, the respective gate signal lines are connected to a first voltage signal line which is made to assume a floating state through portions thereof which assume a floating state and first diodes and the respective counter voltage signal lines are connected to a second voltage signal line which is made to assume a floating state through portions thereof which assume a floating state and second diodes, and the first voltage signal line and the second voltage signal line are connected to each other via a third diode.

34. A liquid crystal display device comprising respective pixels which are arranged in a matrix array by arranging a plurality of pixel rows each of which includes a plurality of pixels arranged in parallel in one direction in another direction which crosses one direction, selects each pixel row in response to a scanning signal, and supplies a video signal and a reference signal which becomes the reference with respect to the video signal to the respective pixels in each selected pixel row, wherein drain signal lines which supply the video signal are arranged to cross gate signal lines which supply the scanning signal and counter voltage signal lines which supply the reference signal, the reference signal is supplied to the pixels for every selected pixel row and, at the same time, most of the gate signal lines and the counter voltage signal lines in other pixel rows except for the selected pixel rows are respectively configured to assume a floating state, the respective gate signal lines are connected to a first voltage signal line which is made to assume a floating state through portions thereof which assume a floating state and first diodes and the respective counter voltage signal lines are connected to a second voltage signal line which is made to assume a floating state through portions thereof which assume a floating state and second diodes, and the first voltage signal line and the second voltage signal line are connected to a line which is grounded via a third diode and a fourth diode respectively.

* * * * *